US012312772B2

(12) United States Patent
Fukuda et al.

(10) Patent No.: US 12,312,772 B2
(45) Date of Patent: May 27, 2025

(54) HYDRAULIC SYSTEM FOR WORKING MACHINE

(71) Applicant: KUBOTA CORPORATION, Osaka (JP)

(72) Inventors: Yuji Fukuda, Sakai (JP); Toshihiko Takemura, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 18/385,962

(22) Filed: Nov. 1, 2023

(65) Prior Publication Data

US 2024/0060271 A1 Feb. 22, 2024

Related U.S. Application Data

(63) Continuation of application No. 17/841,716, filed on Jun. 16, 2022, now Pat. No. 11,840,825.

(30) Foreign Application Priority Data

Aug. 11, 2021 (JP) ..... 2021-131401

(51) Int. Cl.
*E02F 9/22* (2006.01)

(52) U.S. Cl.
CPC ..... *E02F 9/2253* (2013.01); *E02F 9/2235* (2013.01); *E02F 9/2246* (2013.01);
(Continued)

(58) Field of Classification Search
CPC ..... E02F 9/2235; E02F 9/2246; E02F 9/2253
See application file for complete search history.

(56) References Cited

U.S. PATENT DOCUMENTS 5,307,631 A 5/1994 Tatsumi et al.
5,335,750 A * 8/1994 Geringer ..... B60K 17/10 60/433

(Continued)

FOREIGN PATENT DOCUMENTS

JP H02153128 A 6/1990
JP H0579502 A 3/1993

(Continued)

OTHER PUBLICATIONS

Official Communication issued in corresponding Japanese Patent Application No. 2021-131401, mailed on Apr. 23, 2024, 9 pages.

(Continued)

*Primary Examiner* — Matthew Wiblin
(74) *Attorney, Agent, or Firm* — Keating & Bennett, LLP

(57) ABSTRACT

A hydraulic system for a working vehicle includes a first hydraulic pump to deliver pilot fluid to a control valve for a hydraulic actuator whose highest load pressure acts on a first fluid passage, and a second hydraulic pump to deliver hydraulic fluid whose pressure acts on a second fluid passage. A hydraulic controller is operable to control a load-sensing (LS) differential pressure between the highest load pressure and a delivery pressure of the hydraulic fluid from the second hydraulic pump. A third fluid passage to which the second hydraulic pump delivers the hydraulic fluid branches to a fourth fluid passage for flow of the pilot fluid. A solenoid valve is operable to change a pilot pressure of the pilot fluid for the hydraulic controller, and a controller is configured or programmed to control the solenoid valve to adjust the pilot pressure to change the LS differential pressure.

9 Claims, 41 Drawing Sheets

(52) U.S. Cl.
CPC ..... *E02F 9/2296* (2013.01); *E02F 9/2285* (2013.01); *E02F 9/2292* (2013.01)

(56) References Cited

U.S. PATENT DOCUMENTS

| | | | | |
|---|---|---|---|---|
| 9,772,018 | B2 * | 9/2017 | Aizawa ..... | B60W 10/06 |
| 2021/0071391 | A1 | 3/2021 | Takahashi et al. | |

FOREIGN PATENT DOCUMENTS

| | | | |
|---|---|---|---|
| JP | 2003113804 | A | 4/2003 |
| JP | 2019173880 | A | 10/2019 |

OTHER PUBLICATIONS

Fukuda et al., "Hydraulic System for Working Machine", U.S. Appl. No. 17/841,716, filed Jun. 16, 2022.

* cited by examiner

| Engine rotational speed [rpm] | LS Differential pressure [MPa] | Pump delivery amount [LPM] (With spool opening constant) |
|---|---|---|
| 1200 | 0.40 | 52 |
| 1400 | 0.51 | 58 |
| 1600 | 0.63 | 65 |
| 1800 | 0.77 | 72 |
| 2000 | 0.93 | 79 |
| 2200 | 1.10 | 86 |
| 2400 | 1.29 | 93 |
| 2600 | 1.50 | 100 |

Fig.2B

| Engine rotational speed [rpm] | Without change command | | With change command | |
|---|---|---|---|---|
| | LS Differential pressure [MPa] | Pump delivery amount [PPM] (With spool opening constant) | LS Differential pressure [MPa] | Pump delivery amount [PPM] (With spool opening constant) |
| 1200 | 0.40 | 52 | 0.60 | 63 |
| 1400 | 0.51 | 58 | 0.71 | 69 |
| 1600 | 0.63 | 65 | 0.83 | 74 |
| 1800 | 0.77 | 72 | 0.97 | 80 |
| 2000 | 0.93 | 79 | 1.13 | 87 |
| 2200 | 1.10 | 86 | 1 30 | 93 |
| 2400 | 1.29 | 93 | 1.49 | 99 |
| 2600 | 1.50 | 100 | 1,70 | 106 |

Fig.4B

| Operation amount of one accelerator member [%] (Operation amount of other accelerator member is maximum or predetermined amount or more) | LS Differential pressure [MPa] | Pump delivery amount [LPM] (With spool opening constant) |
|---|---|---|
| 0 | 1.50 | 100 |
| 10 | 1.50 | 100 |
| 30 | 1.54 | 101 |
| 50 | 1.61 | 104 |
| 70 | 1.70 | 106 |
| 90 | 1.80 | 110 |
| 100 | 1.80 | 110 |

Fig.6

| Engine rotational speed [rpm] | Normal time | During automatic idle control |
|---|---|---|
| | LS Differential pressure [MPa] | LS Differential pressure [MPa] |
| 1200 | 0.8 | 1.5 |
| 1400 | 0.9 | |
| 1600 | 1.0 | |
| 1800 | 1.1 | |
| 2000 | 1.2 | |
| 2200 | 1.3 | |
| 2400 | 1.4 | |
| 2600 | 1.5 | |

Fig.16A

| Engine rotational speed [rpm] | Normal time | During automatic idle control |
|---|---|---|
| | Traveling primary pressure or secondary pressure [MPa] | Traveling primary pressure or secondary pressure [MPa] |
| 1200 | 1.2 | 2.6 |
| 1400 | 1.4 | |
| 1600 | 1.6 | |
| 1800 | 1.8 | |
| 2000 | 2.0 | |
| 2200 | 2.2 | |
| 2400 | 2.4 | |
| 2600 | 2.6 | |

Fig.16B

HYDRAULIC SYSTEM FOR WORKING MACHINE

CROSS REFERENCE TO RELATED APPLICATIONS

This application claims the benefit of priority to Japanese Patent Application No. 2021-131401 filed on Aug. 11, 2021. The entire contents of this application are hereby incorporated herein by reference.

BACKGROUND OF THE INVENTION

1. Field of the Invention

The present invention relates to a hydraulic system for a working machine such as a skid-steer loader or a compact track loader, and a working machine including the hydraulic system.

2. Description of the Related Art

In the related art, there is known a working machine equipped with a load sensing system that controls the delivery amount of hydraulic fluid to be delivered from a hydraulic pump in accordance with a work load.

For example, a working machine disclosed in Japanese Unexamined Patent Application Publication No. 2016-125560 includes a first hydraulic pump that delivers pilot fluid to switch a control valve that controls activation of a hydraulic actuator; a second hydraulic pump that delivers hydraulic fluid to activate the hydraulic actuator; a first fluid passage on which the highest load pressure when the hydraulic actuator is activated can act; a second fluid passage on which a delivery pressure of the hydraulic fluid from the second hydraulic pump can act; a third fluid passage to which the pilot fluid is delivered from the first hydraulic pump; and a hydraulic control unit that controls the second hydraulic pump.

The hydraulic control unit controls the delivery amount of the hydraulic fluid from the second hydraulic pump so that a differential pressure between the highest load pressure acting on the first fluid passage and the delivery pressure of the hydraulic fluid from the second hydraulic pump acting on the second fluid passage becomes constant. Further, the hydraulic control unit controls the delivery amount of the hydraulic fluid from the second hydraulic pump on the basis of a differential pressure between a first pressure of the pilot fluid extracted from a first extraction unit in the third fluid passage and a second pressure of the pilot fluid extracted from a second extraction unit to perform horsepower control of the first hydraulic pump to reduce horsepower loss.

SUMMARY OF THE INVENTION

In recent years, a demand has arisen for accurate horsepower control by controlling a delivery amount of hydraulic fluid from a hydraulic pump in conjunction with driving of a working machine.

Preferred embodiments of the present invention provide hydraulic systems for working machines, in which accuracy of horsepower control can be improved.

Preferred embodiments of the present invention may include the technical features described as follows.

A hydraulic system for a working machine according to one or more aspects of a preferred embodiment of the present invention includes a prime mover, a hydraulic actuator, a control valve to control activation of the hydraulic actuator, a first hydraulic pump to be driven by power of the prime mover to deliver pilot fluid to switch the control valve, a second hydraulic pump to be driven by power of the prime mover to deliver hydraulic fluid to activate the hydraulic actuator, the second hydraulic pump being a variable displacement hydraulic pump, a first fluid passage to allow a highest load pressure, when the hydraulic actuator is activated, to act thereon, a second fluid passage to allow a delivery pressure of the hydraulic fluid from the second hydraulic pump to act thereon, a hydraulic controller operable to control the second hydraulic pump to set a load-sensing (LS) differential pressure, the LS differential pressure being a pressure difference between the delivery pressure of the hydraulic fluid from the second hydraulic pump and the highest load pressure, a third fluid passage to which the first hydraulic pump delivers the pilot fluid, a fourth fluid passage branched from the third fluid passage, a solenoid valve to change a pilot pressure, the pilot pressure being a pressure of the pilot fluid that flows through the fourth fluid passage and acts on the hydraulic controller, and a controller configured or programmed to control activation of the solenoid valve to adjust the pilot pressure to change the LS differential pressure.

A hydraulic system for a working machine according to one or more aspects of a preferred embodiment of the present invention includes a prime mover, a hydraulic actuator, a control valve to control activation of the hydraulic actuator, a first hydraulic pump to be driven by power of the prime mover to deliver pilot fluid to switch the control valve, a second hydraulic pump to be driven by power of the prime mover to deliver hydraulic fluid to activate the hydraulic actuator, the second hydraulic pump being a variable displacement hydraulic pump, a first fluid passage to allow a highest load pressure, when the hydraulic actuator is activated, to act thereon, a second fluid passage to allow a delivery pressure of the hydraulic fluid from the second hydraulic pump to act thereon, a hydraulic controller operable to control the second hydraulic pump to set a load-sensing (LS) differential pressure, the LS differential pressure being a pressure difference between the delivery pressure of the hydraulic fluid from the second hydraulic pump and the highest load pressure, a third fluid passage to which the first hydraulic pump delivers the pilot fluid, a fourth fluid passage branched from the third fluid passage, a solenoid valve to change a pilot differential pressure, the pilot differential pressure being a pressure difference between the pilot fluid that flows through the fourth fluid passage and acts on the hydraulic controller and discharge fluid from the hydraulic controller, and a controller configured or programmed to control activation of the solenoid valve to adjust the pilot differential pressure to change the LS differential pressure.

In one aspect of a preferred embodiment of the present invention, the fourth fluid passage may include a first branch fluid passage through which the pilot fluid is to be supplied to the hydraulic controller, a second branch fluid passage through which the pilot fluid discharged from the hydraulic controller is to return to the third fluid passage, and a bypass fluid passage connected to the third fluid passage. The solenoid valve may be connected to the bypass fluid passage and may change the pilot differential pressure, the pilot differential pressure being a pressure difference between the pilot fluid that flows through the first branch fluid passage and acts on the hydraulic controller and the pilot fluid that flows through the second branch fluid passage and returns to the third fluid passage.

In one aspect of a preferred embodiment of the present invention, the first hydraulic pump may be a fixed-displacement hydraulic pump having a delivery flow rate that varies in accordance with a rotational speed of the prime mover. The hydraulic controller include the solenoid valve, a swash-plate variable assembly capable of changing an angle of a swash plate included in the second hydraulic pump, a flow rate compensation valve connected to the first fluid passage to supply the hydraulic fluid to the swash-plate variable assembly to activate the swash-plate variable assembly, and an opening adjuster connected to the fourth fluid passage to change an opening of the flow rate compensation valve. The controller may control activation of the solenoid valve to cause the opening adjuster to change the opening of the flow rate compensation valve to change the LS differential pressure.

In one aspect of a preferred embodiment of the present invention, the fourth fluid passage may include a first branch fluid passage and a third branch fluid passage. The opening adjuster may include a first opening adjuster connected to the first branch fluid passage, and a second opening adjuster connected to the third branch fluid passage. The hydraulic controller may include one or more solenoid valves including the solenoid valve. The one or more solenoid valves may include a solenoid valve connected to the first opening adjuster and/or the second opening adjuster. The controller may control activation of the solenoid valve connected to the first opening adjuster and/or the second opening adjuster to cause the first opening adjuster and/or the second opening adjuster to change the opening of the flow rate compensation valve to change the LS differential pressure.

In one aspect of a preferred embodiment of the present invention, the hydraulic system for a working machine may further include a speedometer to measure an actual rotational speed of the prime mover. The controller may change the LS differential pressure, based on the actual rotational speed measured by the speedometer. Alternatively, the controller may change the LS differential pressure, based on a difference between the actual rotational speed measured by the speedometer and a predetermined target rotational speed. Alternatively, the controller may decrease the LS differential pressure in response to the actual rotational speed measured by the speedometer being lower than a predetermined target rotational speed.

In one aspect of a preferred embodiment of the present invention, the prime mover may be an internal combustion engine to be driven by combustion of injected fuel. The controller may change the LS differential pressure, based on an injection amount of fuel to the internal combustion engine or a load factor of the internal combustion engine.

In one aspect of a preferred embodiment of the present invention, the hydraulic system for a working machine may further include a command generator to provide a command to change the LS differential pressure. The controller may change the LS differential pressure such that the LS differential pressure is increased in response to a command being generated by the command generator to change the LS differential pressure.

In one aspect of a preferred embodiment of the present invention, the hydraulic system for a working machine may further include an accelerator to set a rotational speed of the prime mover. The accelerator may also define the command generator. The controller may determine a set value of the rotational speed of the prime mover in accordance with an operating state of the accelerator, and change the LS differential pressure, based on the determined set value.

In one aspect of a preferred embodiment of the present invention, the accelerator may include a first accelerator and a second accelerator. The controller may change the LS differential pressure, based on a smaller amount of operation among an amount of operation of the first accelerator and an amount of operation of the second accelerator.

Further, in one aspect of a preferred embodiment of the present invention, the controller may determine a set value of the rotational speed of the prime mover, based on a larger amount of operation among the amount of operation of the first accelerator and the amount of operation of the second accelerator, and control driving of the prime mover in accordance with the determined set value.

In one aspect of a preferred embodiment of the present invention, the hydraulic system for a working machine may further include a thermometer to measure a temperature of at least one of the hydraulic fluid that flows through a flow path provided in the working machine, cooling water that flows through a water passage provided in the working machine, or oil of the prime mover. The controller may change the LS differential pressure, based on the temperature measured by the thermometer.

In one aspect of a preferred embodiment of the present invention, the controller may execute automatic idle control to control driving of the prime mover to keep a rotational speed of the prime mover low. The controller may set a predetermined pressure as the LS differential pressure, the predetermined pressure being equal to or greater than a pressure corresponding to the rotational speed of the prime mover, if the rotational speed of the prime mover is changed while the controller is executing the automatic idle control.

In one aspect of a preferred embodiment of the present invention, the controller may change the LS differential pressure in accordance with the rotational speed of the prime mover while the controller is not executing the automatic idle control.

In one aspect of a preferred embodiment of the present invention, the controller may set a predetermined pressure corresponding to a maximum rotational speed of the prime mover as the LS differential pressure while the controller is executing the automatic idle control.

In one aspect of a preferred embodiment of the present invention, the hydraulic system for a working machine may further include an accelerator to set the rotational speed of the prime mover. The controller may set a predetermined pressure corresponding to the rotational speed set by the accelerator as the LS differential pressure while the controller is executing the automatic idle control.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

FIG. 2B is a table illustrating the relationship among the engine rotational speed, the LS differential pressure, and the pump delivery amount according to the first preferred embodiment of the present invention.

FIG. 4B is a table illustrating the relationship among the engine rotational speed, the LS differential pressure, and the pump delivery amount according to the second preferred embodiment of the present invention.

FIG. 6 is a table illustrating the relationship among the amount of operation of one of accelerator members when the amount of operation of the other accelerator member is the maximum amount or is the predetermined amount or more, the LS differential pressure, and the pump delivery amount according to the third preferred embodiment of the present invention.

FIG. 16A is a table illustrating a relationship between an engine rotational speed and an LS differential pressure according to a seventh preferred embodiment of the present invention.

FIG. 16B is a table illustrating a relationship between an engine rotational speed and a traveling primary pressure or secondary pressure according to the seventh preferred embodiment of the present invention.

DETAILED DESCRIPTION OF THE PREFERRED EMBODIMENTS

Figure 1A:
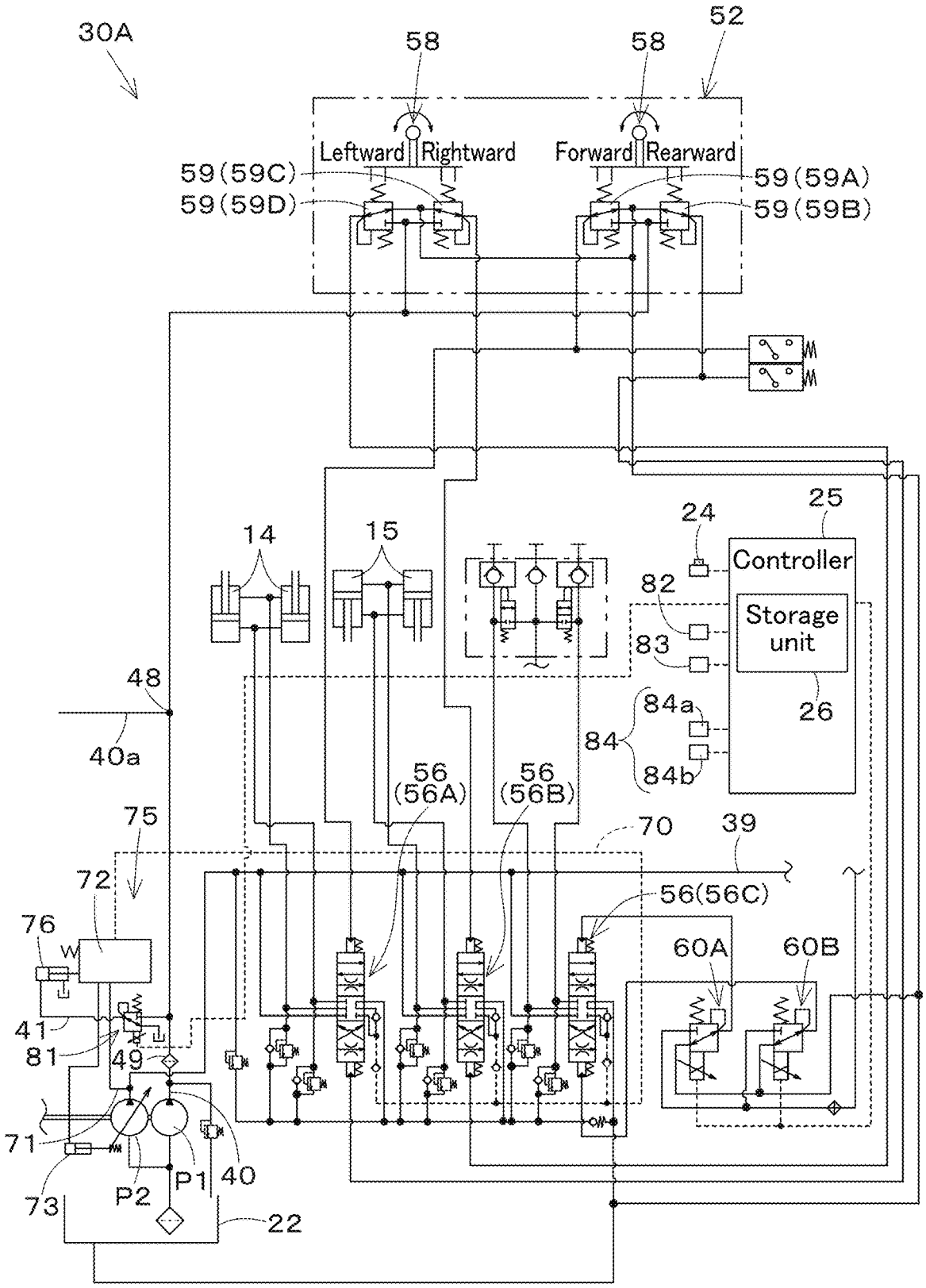
FIG. 1A is an overall view of a hydraulic system for a working system of a working machine according to a first preferred embodiment of the present invention.

The preferred embodiments will now be described with reference to the accompanying drawings, wherein like reference numerals designate corresponding or identical elements throughout the various drawings. The drawings are to be viewed in an orientation in which the reference numerals are viewed correctly.

Hydraulic systems for working machines and working machines including the hydraulic systems according to preferred embodiments of the present invention will be described hereinafter with reference to the drawings as appropriate.

Figure 24:
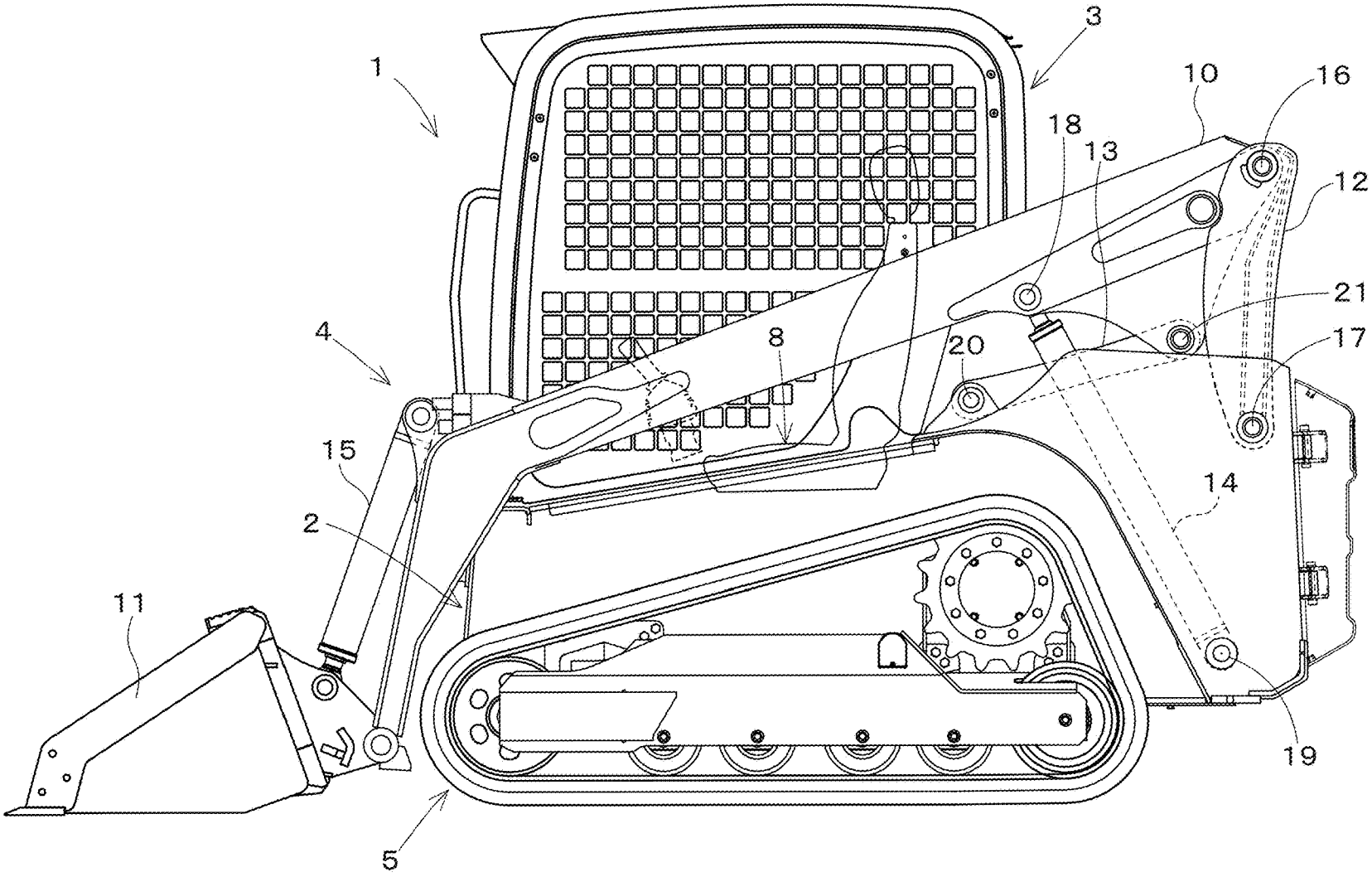
FIG. 24 is a side view of a working machine according to a preferred embodiment of the present invention.

FIG. 24 is a side view of a working machine 1 according to a preferred embodiment of the present invention. The working machine 1 includes a machine body 2, a cabin 3, a working device 4, and at least one traveling device 5. In this preferred embodiment, a compact track loader is presented as an example of the working machine 1. In some preferred embodiments of the present invention, the working machine 1 is not limited to the compact track loader and may be a tractor, a skid-steer loader, or a backhoe, for example.

The cabin 3 is mounted on the machine body 2. The cabin 3 includes an operator's seat 8. A direction ahead of a driver seated on the operator's seat 8 of the working machine 1 (a direction on the left side in FIG. 24) is defined as a front or forward direction, a direction behind the driver (a direction on the right side in FIG. 24) is defined as a rear or rearward direction, a direction to the left of the driver (a direction closer to the viewer in FIG. 24) is defined as a left direction, and a direction to the right of the driver (a direction farther away from the viewer in FIG. 24) is defined as a right direction.

Figure 25:
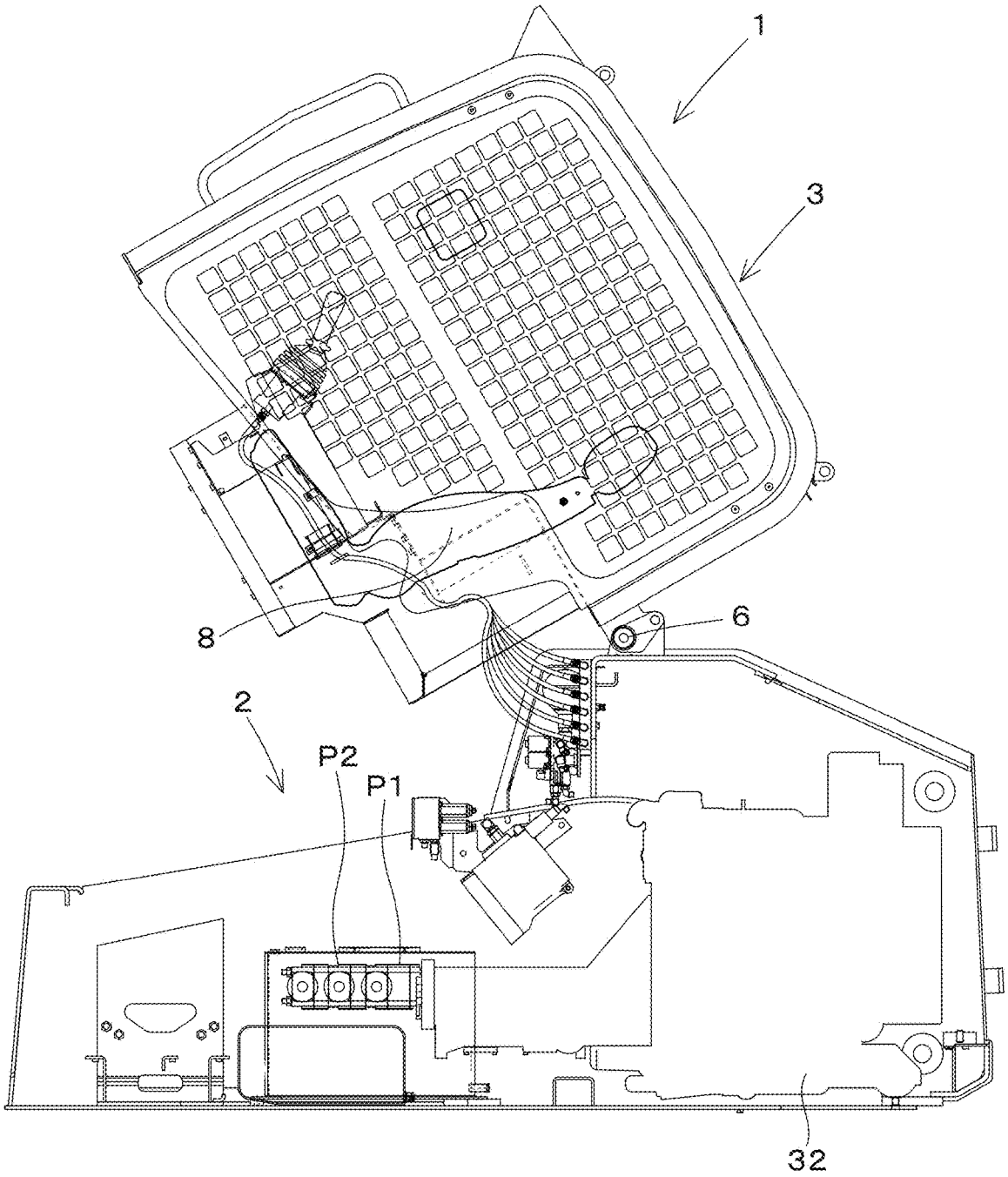
FIG. 25 is a side view of the working machine according to a preferred embodiment of the present invention, illustrating an internal structure of a machine body of the working machine.

FIG. 25 is a side view of the working machine 1, illustrating an internal structure of the machine body 2 of the working machine 1. As illustrated in FIG. 25, the cabin 3 is coupled to the machine body 2 by a coupling shaft 6 or the like and is rotatable upward about the coupling shaft 6.

The machine body 2 has mounted thereon hydraulic pumps P1 and P2 and a prime mover 32. The prime mover 32 includes an engine (diesel engine or gasoline engine), which is an internal combustion engine to be driven by petroleum-based fuel. In another example, the prime mover 32 may include an electric motor to be driven by electric power. In this preferred embodiment, the prime mover 32 will be described as an engine 32.

In FIG. 24, the working device 4 is attached to the machine body 2. The working device 4 includes booms 10, a working tool 11, lift links 12, control links 13, boom cylinders 14, and bucket cylinders 15.

The booms 10 are each disposed on a corresponding one of the right and left sides of the cabin 3 so as to be swingable up and down. The working tool 11 is a bucket, for example. In the following, the working tool 11 may also be referred to as the bucket 11. The bucket 11 is disposed at distal ends (front ends) of the booms 10 so as to be swingable up and down. The lift links 12 and the control links 13 support base portions (rear portions) of the booms 10.

Front portions of the left and right booms 10 are coupled to each other by an odd-shaped coupling pipe. The base portions (rear portions) of the booms 10 are coupled to each other by a circular-shaped coupling pipe. The lift links 12, the control links 13, and the boom cylinders 14 are disposed on the left and right sides of the machine body 2 such that the lift link 12, the control link 13, and the boom cylinder 14 on the left side of the machine body 2 correspond to the left boom 10 and the lift link 12, the control link 13, and the boom cylinder 14 on the right side of the machine body 2 correspond to the right boom 10.

The lift links 12 are disposed upright at the rear portions of the base portions of the respective booms 10. Upper portions of the lift links 12 are pivotally supported by the rear portions of the base portions of the respective booms 10 through respective pivot shafts 16 (first pivot shafts) so as to be rotatable about respective lateral axes defined by the pivot shafts 16. Lower portions of the lift links 12 are pivotally supported by a rear portion of the machine body 2 through respective pivot shafts 17 (second pivot shafts) so as to be rotatable about respective lateral axes defined by the pivot shafts 17. The second pivot shafts 17 are disposed below the first pivot shafts 16.

Upper portions of the boom cylinders 14 are pivotally supported through respective pivot shafts 18 (third pivot shafts) so as to be rotatable about respective lateral axes defined by the pivot shafts 18. The third pivot shaft 18 is disposed at front portions of the base portions of the booms 10. Lower portions of the boom cylinders 14 are pivotally supported through respective pivot shaft 19 (fourth pivot shafts) so as to be rotatable about respective lateral axes defined by the pivot shafts 19. The fourth pivot shafts 19 are disposed at a lower portion of the rear portion of the machine body 2 and below the third pivot shafts 18.

The control links 13 are disposed in front of the lift links 12. The control links 13 have first ends that are pivotally supported through respective pivot shafts 20 (fifth pivot shafts) so as to be rotatable about respective lateral axes defined by the pivot shafts 20. The fifth pivot shafts 20 are disposed in the machine body 2 at positions in front of the lift links 12. The control links 13 have second ends that are pivotally supported through respective pivot shafts 21 (sixth pivot shafts) so as to be rotatable about respective lateral axes defined by the pivot shafts 21. The sixth pivot shafts 21 are disposed at portions of the booms 10 in front of the second pivot shafts 17 and above the second pivot shafts 17.

In response to extension or contraction of the boom cylinders 14, the lift links 12 and the control links 13 allow the booms 10 to swing up or down around the first pivot shafts 16 while supporting the base portions of the booms 10. As a result, the distal ends of the booms 10 are raised or lowered. As the booms 10 swing up and down, the control links 13 swing up and down around the fifth pivot shafts 20. As the control links 13 swing up and down, the lift links 12 swing back and forth around the second pivot shafts 17.

In place of the bucket 11, another working tool is attachable to the front portions of the booms 10. Examples of the other working tool include auxiliary attachments such as a hydraulic crusher, a hydraulic breaker, an angle broom, an earth auger, a pallet fork, a sweeper, a mower, and a snow blower.

A hydraulic extraction unit (not illustrated) is disposed in the front portion of the left boom 10. The hydraulic extraction unit connects a hydraulic actuator (not illustrated) of the auxiliary attachment and a pipe (not illustrated) such as a hydraulic pipe disposed in the boom 10. The hydraulic extraction unit and the hydraulic actuator of the auxiliary attachment are connected by another hydraulic pipe. Hydraulic fluid supplied to the hydraulic extraction unit passes through the other hydraulic pipe and is supplied to the hydraulic actuator.

The bucket cylinders 15 are arranged near the front portions of the respective booms 10. In response to extension or contraction of the bucket cylinders 15, the bucket 11 swings up or down.

The traveling device 5 is disposed in either outer portion of the machine body 2. In this preferred embodiment, the traveling device 5 is disposed on each of the left and right sides of the machine body 2 and is a crawler (or semi-crawler) traveling device. A wheeled traveling device having at least one front wheel and at least one rear wheel may be used in place of the traveling devices 5.

In response to extension or contraction of the boom cylinders 14, the booms 10 swing up or down. In response to extension or contraction of the bucket cylinders 15, the bucket 11 swings up or down.

First Preferred Embodiment

FIG. 1A is a diagram illustrating a hydraulic system 30A for a working system of the working machine 1 according to a first preferred embodiment.

As illustrated in FIG. 1A, the hydraulic system 30A includes a first hydraulic pump P1 and a second hydraulic pump P2. The first hydraulic pump P1 is a hydraulic pump to be driven by the power of the engine 32. The first hydraulic pump P1 is capable of delivering hydraulic fluid stored in a hydraulic fluid tank 22. The first hydraulic pump P1 includes a fixed-displacement gear pump whose delivery flow rate varies in accordance with the rotational speed of the engine 32.

The second hydraulic pump P2 is a hydraulic pump to be driven by the power of the engine 32, and is installed at a position different from the first hydraulic pump P1. The second hydraulic pump P2 includes a swash-plate variable displacement axial pump. The second hydraulic pump P2 is capable of delivering the hydraulic fluid stored in the hydraulic fluid tank 22.

The second hydraulic pump P2 delivers hydraulic fluid to activate hydraulic actuators for performing work in the working machine 1. Examples of such hydraulic actuators include the boom cylinders 14, the bucket cylinders 15, a hydraulic actuator disposed in the auxiliary attachment, and a hydraulic actuator disposed in the traveling device 5. The first hydraulic pump P1 delivers pilot fluid to switch a control valve (such as control valves 56 in FIG. 1A) to control activation of hydraulic devices (such as hydraulic valves and hydraulic actuators) of the working machine 1.

The hydraulic system 30A is a hydraulic system to activate the booms 10, the bucket 11, the auxiliary attachment, and the like, and includes a plurality of control valves 56. The plurality of control valves 56 are disposed in a fluid passage 39 connected to a delivery port of the second hydraulic pump P2. The plurality of control valves 56 include a boom control valve 56A, a bucket control valve 56B, and an auxiliary control valve 56C. The boom control valve 56A is a valve to control activation of the boom cylinders 14. The bucket control valve 56B is a valve to control activation of the bucket cylinders 15. The auxiliary control valve 56C is a valve to control activation of the hydraulic actuator of the auxiliary attachment.

The booms 10 and the bucket 11 are operable with an operation member 58 such as a lever operation member disposed around the operator's seat 8. The operation member 58 is included in an operation device (work operation device) 52. The operation member 58 is supported so as to be tiltable to the front, rear, left, and right from a neutral position and tiltable diagonally forward to the left, diagonally rearward to the left, diagonally forward to the right, and diagonally rearward to the right from the neutral position. In response to the operation member 58 being tilted in any direction, any one of a plurality of operation valves 59 (a lowering operation valve 59A, a raising operation valve 59B, a bucket-dumping operation valve 59C, and a bucket-shoveling operation valve 59D) disposed below the operation member 58 can be operated. The plurality of operation valves 59 are connected to a fluid passage (third fluid passage) 40 connected to the first hydraulic pump P1 such that the hydraulic fluid can be supplied from the first hydraulic pump P1.

When the operation member 58 is tilted to the front, the lowering operation valve 59A is operated, and a pilot pressure is output from the lowering operation valve 59A. The pilot pressure acts on a pressure receiver of the boom control valve 56A to lower the booms 10.

When the operation member 58 is tilted to the rear, the raising operation valve 59B is operated, and a pilot pressure is output from the raising operation valve 59B. The pilot pressure acts on a pressure receiver of the boom control valve 56A to raise the booms 10.

When the operation member 58 is tilted to the right, the bucket-dumping operation valve 59C is operated, and the pilot pressure acts on a pressure receiver of the bucket control valve 56B. As a result, the bucket control valve 56B is activated in a direction to extend the bucket cylinders 15, and the bucket 11 performs a dumping operation at a speed proportional to the amount of tilt of the operation member 58.

When the operation member 58 is tilted to the left, the bucket-shoveling operation valve 59D is operated, and the pilot pressure acts on a pressure receiver of the bucket control valve 56B. As a result, the bucket control valve 56B is activated in a direction to contract the bucket cylinders 15, and the bucket 11 performs a shoveling operation at a speed proportional to the amount of tilt of the operation member 58.

The auxiliary attachment is operable with an operation switch 24 disposed around the operator's seat 8. The operation switch 24 includes, for example, a swingable seesaw switch, a slidable slide switch, or a depressible push switch. An electric signal corresponding to the operation of the operation switch 24 is input to a controller 25.

The controller 25 is implemented by a semiconductor device such as a central processing unit (CPU), a microprocessor unit (MPU), or a memory, and electric and electronic circuits, for example. The controller 25 outputs a command (electric signal) corresponding to the amount of operation of the operation switch 24 to a first solenoid valve 60A and a second solenoid valve 60B. The first solenoid valve 60A and the second solenoid valve 60B are opened in accordance with a command output from the controller 25, that is, in accordance with the amount of operation of the operation switch 24. As a result, the pilot fluid is supplied to the auxiliary control valve 56C connected to the first solenoid valve 60A and the second solenoid valve 60B, and the auxiliary actuator of the auxiliary attachment is activated by the hydraulic fluid supplied from the auxiliary control valve 56C.

The hydraulic system 30A includes a load sensing system that controls the delivery amount of fluid from the second hydraulic pump P2 in accordance with the work performed with the working machine 1. The load sensing system includes a first fluid passage 70, a second fluid passage 71, and a hydraulic control unit 75. The hydraulic control unit 75 includes a flow rate compensation valve 72, a swash-plate variable unit 73, an opening changing unit 76, and a solenoid valve 81.

The first fluid passage 70 (also referred to as "PLS fluid passage") is connected to the control valves 56A, 56B, and 56C and the flow rate compensation valve 72. The first fluid passage 70 is a fluid passage to detect load pressures, which are pressures of hydraulic fluid applied to the control valves 56A, 56B, and 56C, when the control valves 56A, 56B, and 56C are activated. The first fluid passage 70 transmits a PLS signal pressure, which is the highest load pressure among the load pressures of the control valves 56A, 56B, and 56C, to the flow rate compensation valve 72. That is, the highest load pressure when the boom cylinders 14, the bucket cylinders 15, or any other hydraulic actuator is activated can act on the first fluid passage 70.

The second fluid passage 71 (also referred to as "PPS fluid passage") is connected to the delivery port of the second hydraulic pump P2 and the flow rate compensation valve 72. The second fluid passage 71 transmits a PPS signal pressure, which is the pressure (delivery pressure) of the hydraulic fluid delivered from the second hydraulic pump P2, to the flow rate compensation valve 72. That is, the delivery pressure of the hydraulic fluid from the second hydraulic pump P2 can act on the second fluid passage 71. The second hydraulic pump P2 delivers the hydraulic fluid to the fluid passage 71 or 39 in accordance with the opening state of spools of the control valves 56A, 56B, and 56C.

Figure 1B:
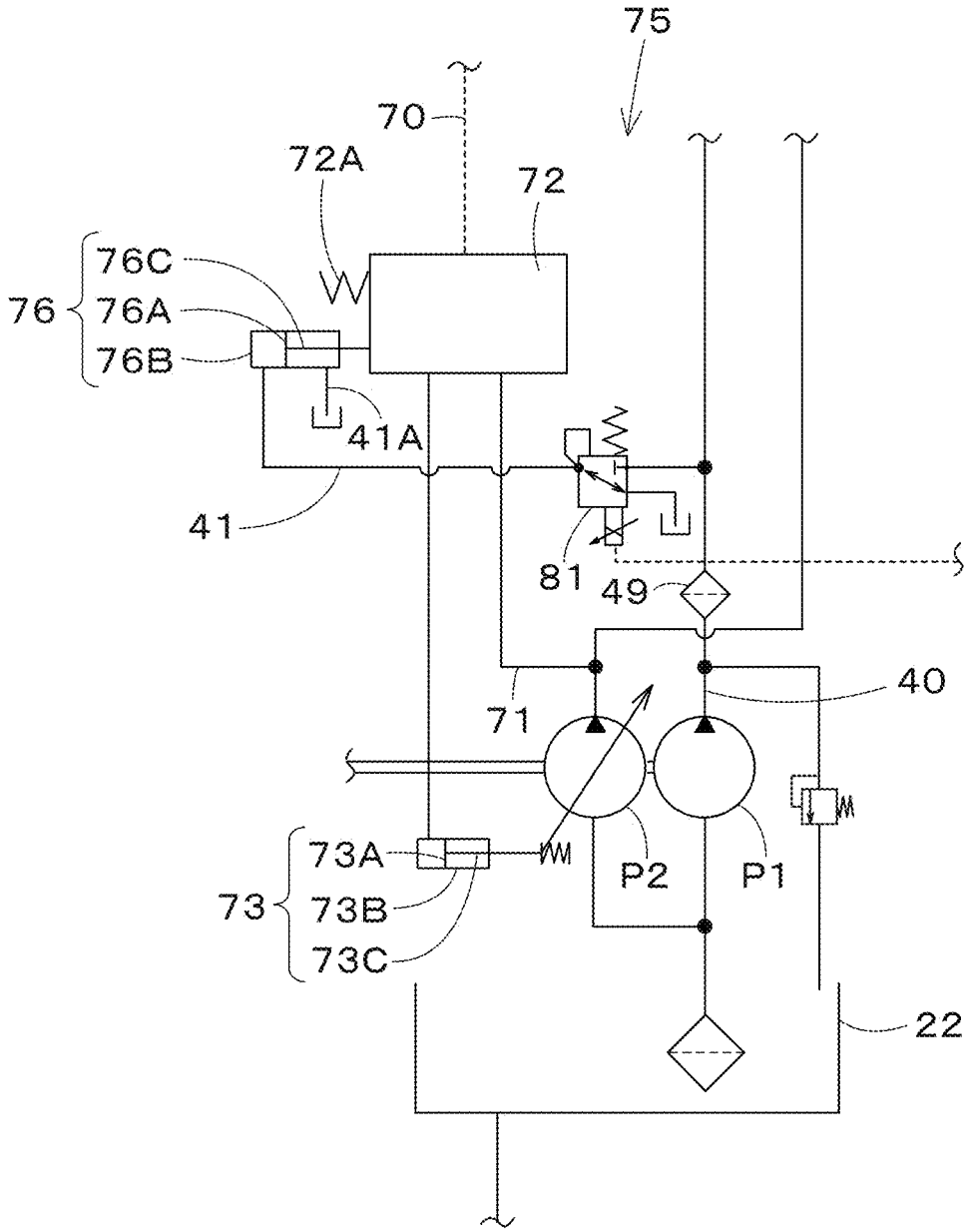
FIG. 1B is an enlarged view of a portion of the hydraulic system around a hydraulic control unit according to the first preferred embodiment of the present invention.

FIG. 1B is an enlarged view of a portion of the hydraulic system 30A around the hydraulic control unit 75. The swash-plate variable unit 73 is, for example, a hydraulic cylinder. The swash-plate variable unit 73 includes a piston 73A, a housing 73B that houses the piston 73A, and a rod (movable portion) 73C coupled to the piston 73A. The rod 73C has a first end connected to the piston 73A, and a second end connected to a swash plate of the second hydraulic pump P2. In response to supply of the hydraulic fluid from the flow rate compensation valve 72 into the housing 73B of the swash-plate variable unit 73 from a bottom of the housing 73B, the piston 73A moves to extend or contract the rod 73C, and the angle of the swash plate of the second hydraulic pump P2 can be changed. That is, the swash-plate variable unit 73 is capable of changing the angle of the swash plate of the second hydraulic pump P2. The hydraulic fluid supplied into the housing 73B is discharged to the hydraulic fluid tank 22 from, for example, a fluid passage (not illustrated) connected to a top of the housing 73B (i.e., a portion of the housing 73B closer to the rod 73C than to the piston 73A).

The flow rate compensation valve 72 is a control valve and is connected to the first fluid passage 70 and the second fluid passage 71. The flow rate compensation valve 72 is a control valve capable of controlling activation of the swash-plate variable unit 73 on the basis of the PLS signal pressure and the PPS signal pressure. The flow rate compensation valve 72 has a supply port from which the hydraulic fluid is to be supplied to the swash-plate variable unit 73, and the opening of the supply port is set so that a load-sensing (LS) differential pressure, which is a pressure difference between the PPS signal pressure and the PLS signal pressure (given by PPS signal pressure−PLS signal pressure), is kept constant. The flow rate compensation valve 72 supplies the hydraulic fluid to the swash-plate variable unit 73 in accordance with the set opening to apply a hydraulic pressure to the swash-plate variable unit 73 to move the piston 73A of the swash-plate variable unit 73 to extend or contract the rod 73C.

In the load sensing system having the configuration described above, the angle of the swash plate of the second hydraulic pump P2 is changed by the flow rate compensation valve 72, the swash-plate variable unit 73, and the like so that the LS differential pressure, which is the pressure difference between the PPS signal pressure and the PLS signal pressure, is kept constant, and the delivery amount of the hydraulic fluid from the second hydraulic pump P2 is adjusted.

The hydraulic system 30A includes a horsepower control circuit. The horsepower control circuit includes the hydraulic control unit 75. The hydraulic control unit 75 is also activated by the pilot fluid delivered from the first hydraulic pump P1, and controls the second hydraulic pump P2 to keep the LS differential pressure constant.

The pilot fluid delivered from the first hydraulic pump P1 flows through the third fluid passage 40. A fourth fluid passage 41 branched from the third fluid passage 40 is provided with the solenoid valve 81. The solenoid valve 81 includes a solenoid proportional valve, a pilot check valve, or a variable relief valve, for example. In the example illustrated in FIGS. 1A and 1B, the solenoid valve 81 is a solenoid proportional valve. The opening of the solenoid valve 81 is changeable as appropriate in response to energization of the solenoid or the like of the solenoid valve 81. The activation (change in the opening) of the solenoid valve 81 is electrically controlled by the controller 25.

The third fluid passage 40 is provided with a filter 49 at an intermediate portion upstream of the fourth fluid passage 41 (adjacent to the first hydraulic pump P1). A fluid passage (without a reference numeral assigned) reaching the hydraulic fluid tank 22 is branched from the third fluid passage 40 at a portion upstream of the filter 49, and is provided with a relief valve.

The pilot fluid delivered from the first hydraulic pump P1 to the third fluid passage 40 flows to the opening changing unit 76 through the filter 49, the fourth fluid passage 41, and the solenoid valve 81. In response to a change in the opening of the solenoid valve 81, the solenoid valve 81 changes the flow rate of the pilot fluid reaching the opening changing unit 76 through the fourth fluid passage 41 to adjust the pilot pressure to be applied to the opening changing unit 76. More specifically, as the opening of the solenoid valve 81 decreases, the flow rate of the pilot fluid flowing to the opening changing unit 76 decreases, and the pilot pressure acting on the opening changing unit 76 increases. The filter 49 also increases the pilot pressure acting on the opening changing unit 76 from the fluid passages 40 and 41.

As described above, the solenoid valve 81 adjusts the pilot pressure of the pilot fluid to activate the opening changing unit 76. Further, in response to a change in the opening of the solenoid valve 81, a pilot differential pressure (pressure difference in pilot fluid, which is given by PA−Pi) is generated, in the pilot fluid flowing through the fourth fluid passage 41, between a first pressure Pi of the pilot fluid flowing into the solenoid valve 81 and a second pressure PA of the pilot fluid flowing out of the solenoid valve 81, and the pilot differential pressure changes.

The opening changing unit 76 is, for example, a hydraulic cylinder. The opening changing unit 76 includes a piston 76A, a housing 76B that houses the piston 76A, and a rod 76C coupled to the piston 76A. The rod 76C has a first end connected to the piston 76A, and a second end connected to the flow rate compensation valve 72. The fourth fluid passage 41 is connected to a bottom of the housing 76B (a portion of the housing 76B adjacent to the first end of the rod 76C).

In response to the pilot pressure (second pressure PA) of the pilot fluid flowing into the housing 76B from the fourth fluid passage 41 through the bottom of the housing 76B (the portion of the housing 76B adjacent to the first end of the rod 76C), the piston 76A moves in the housing 76B. More specifically, when the pilot pressure of the pilot fluid flowing into the housing 76B from the fourth fluid passage 41 decreases, the piston 76A moves in a direction to contract the rod 76C (a direction away from the flow rate compensation valve 72). When the pilot pressure of the pilot fluid flowing into the housing 76B from the fourth fluid passage 41 increases, the piston 76A moves in a direction to extend the rod 76C (a direction approaching the flow rate compensation valve 72). In response to extension or contraction of the rod 76C, the opening of the flow rate compensation valve 72 is changed.

That is, the opening changing unit 76 is activated in accordance with the pilot pressure adjusted by the solenoid valve 81 to change the opening of the flow rate compensation valve 72. The pilot fluid in the housing 76B of the opening changing unit 76 is discharged from a discharge fluid passage 41A connected to a portion of the housing 76B adjacent to the second end of the rod 76C.

The opening of the flow rate compensation valve 72 is set so that the LS differential pressure, which is the differential pressure between the PLS signal pressure and the PPS signal pressure, is kept constant. In addition, the opening of the flow rate compensation valve 72 is changed in accordance with the movement of the piston 76A of the opening changing unit 76. In response to the change in the opening of the flow rate compensation valve 72, the flow rate and pressure of the hydraulic fluid to be supplied from the flow rate compensation valve 72 to the swash-plate variable unit 73 are also changed.

When the opening changing unit 76 is not in operation, a spool (not illustrated) included in the flow rate compensation valve (control valve) 72 is biased in a predetermined direction by a spring 72A to set the opening of the flow rate compensation valve 72 so that the LS differential pressure is kept constant. When the opening changing unit 76 is activated and the rod 76C extends or contracts, the spool of the flow rate compensation valve 72 moves against the elastic force of the spring 72A, and the opening of the flow rate compensation valve 72 is changed. Accordingly, the flow rate and pressure of the hydraulic fluid to be supplied from the flow rate compensation valve 72 to the swash-plate variable unit 73 are changed. In response to the change in flow rate and pressure, the piston 73A of the swash-plate variable unit 73 moves to extend or contract the rod 73C. As a result, the angle of the swash plate of the second hydraulic pump P2 is changed.

The controller 25 illustrated in FIG. 1A controls activation of the solenoid valve 81 to also control the hydraulic control unit 75 and the second hydraulic pump P2, and changes the LS differential pressure to be kept constant by the flow rate compensation valve 72. The change of the LS differential pressure will be described in detail hereinafter.

The controller 25 is connected to a first measurement device 82 that measures the rotational speed of the engine 32. In the following, the rotational speed of the engine 32 is simply referred to as "engine rotational speed", and the value measured by the first measurement device 82 is referred to as "actual rotational speed". The controller 25 outputs a control signal (current signal) to the solenoid valve 81 in accordance with the engine rotational speed (actual rotational speed) measured by the first measurement device 82, and controls the opening of the solenoid valve 81. The pilot pressure (second pressure PA) acting on the opening changing unit 76 is changed in accordance with the opening of the solenoid valve 81, and the opening changing unit 76 changes the opening of the flow rate compensation valve 72. In response to the change in the opening of the flow rate compensation valve 72, the pressure of the hydraulic fluid acting on the swash-plate variable unit 73 from the flow rate compensation valve 72 is changed, the angle of the swash plate of the second hydraulic pump P2 is changed by the swash-plate variable unit 73, and the flow rate of the hydraulic fluid to be delivered from the second hydraulic pump P2 is changed. Accordingly, the LS differential pressure, which is the differential pressure (pressure difference) between the PLS signal pressure acting on the first fluid passage 70 and the PPS signal pressure acting on the second fluid passage 71, is changed. The changed LS differential pressure is kept constant by the flow rate compensation valve 72 or the like.

Figure 2A:
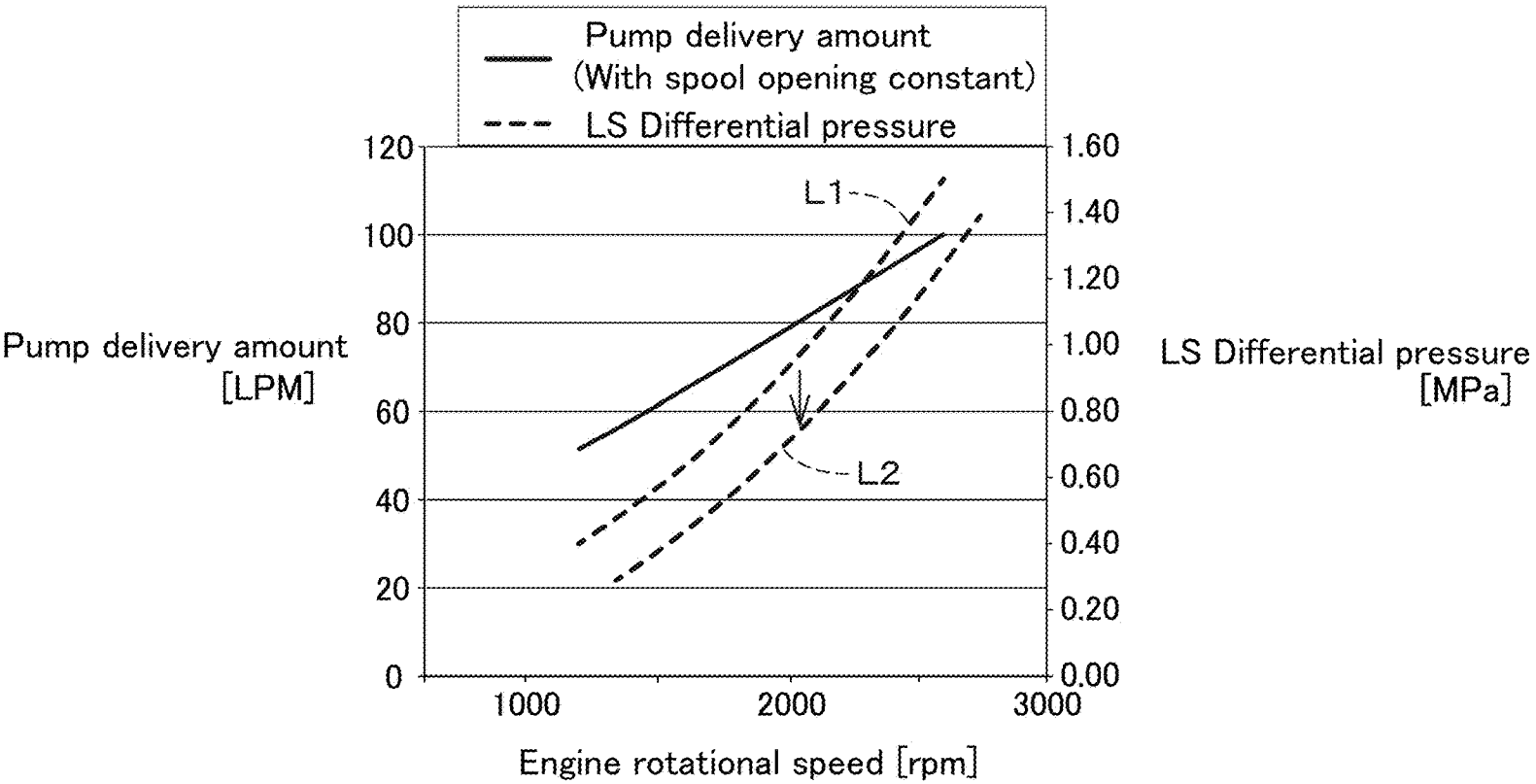
FIG. 2A is a graph illustrating a relationship among an engine rotational speed, an LS differential pressure, and a pump delivery amount according to the first preferred embodiment of the present invention.

FIG. 2A is a graph illustrating a relationship among the engine rotational speed, the LS differential pressure, and a pump delivery amount in the working machine 1. FIG. 2B is a table illustrating the same relationship as that illustrated in FIG. 2A. In FIGS. 2A and 2B, the pump delivery amount is the delivery amount of the hydraulic fluid from the second hydraulic pump P2 when the spools of the control valves 56 (the boom control valve 56A, the bucket control valve 56B, and the auxiliary control valve 56C) have a constant (maximum) opening area.

The relationship among the engine rotational speed, the LS differential pressure, and the pump delivery amount illustrated in FIGS. 2A and 2B is derived based on results of experiments or simulations performed in advance, for example. Data indicating the relationship is stored in a storage unit 26 included in the controller 25. The data indicating the relationship may be, for example, data of a graph as illustrated in FIG. 2A, data of a table as illustrated in FIG. 2B, or data of a function for calculating the LS differential pressure from the actual rotational speed of the engine 32. That is, the relationship among the engine rotational speed, the LS differential pressure, and the pump delivery amount may be data of any form that allows the corresponding LS differential pressure to be determined from the actual rotational speed of the engine 32. The relationship among the engine rotational speed, the LS differential pressure, and the pump delivery amount illustrated in FIGS. 2A and 2B is hereinafter referred to as a control map, for convenience of description.

In FIG. 2A, a control line L1 indicated by a broken line represents a change in the LS differential pressure relative to the engine rotational speed. The control line L1 corresponds to the relationship between the engine rotational speed and the LS differential pressure illustrated in FIG. 2B in a one-to-one manner. A thick solid line illustrated in FIG. 2A represents a change in the pump delivery amount relative to the engine rotational speed, and corresponds to the relationship between the engine rotational speed and the pump delivery amount illustrated in FIG. 2B in a one-to-one manner.

The first control line L1 in the control map illustrated in FIG. 2A or the first and second columns from the left of the control map illustrated in FIG. 2B represent the change in the LS differential pressure when the engine rotational speed changes from a rotational speed (1200 rpm) during idling to a maximum rotational speed (2600 rpm). The term "idling"

refers to a state in which the engine rotational speed is kept low in the working machine 1. In the first control line L1 illustrated in FIG. 2A and the table illustrated in FIG. 2B, as the engine rotational speed increases, the LS differential pressure also increases.

Upon acquiring the actual rotational speed of the engine 32, which is measured by the first measurement device 82, from the first measurement device 82, the controller 25 sets the LS differential pressure corresponding to the acquired actual rotational speed on the basis of the control map illustrated in FIG. 2A or 2B. Then, the controller 25 outputs a control signal corresponding to the set LS differential pressure to the solenoid valve 81 to change the opening of the solenoid valve 81. The control signal corresponding to the LS differential pressure set by the controller 25 may be generated by the controller 25 in accordance with an arithmetic expression or control data stored in advance in the storage unit 26. In response to a change in the opening of the solenoid valve 81 in accordance with the control signal from the controller 25 in the way described above, the pilot pressure (the second pressure PA) acting on the opening changing unit 76 is changed. The second hydraulic pump P2 is controlled by the opening changing unit 76, the flow rate compensation valve 72, and the swash-plate variable unit 73 to realize the LS differential pressure corresponding to the control signal. That is, the controller 25 causes the hydraulic control unit 75 to change the LS differential pressure in accordance with the actual rotational speed of the engine 32, which is measured by the first measurement device 82.

In response to a change in the LS differential pressure in the way described above, the angle of the swash plate of the second hydraulic pump P2 is changed, and the delivery amount of the hydraulic fluid from the second hydraulic pump P2 is adjusted. That is, the output of the second hydraulic pump P2 is adjusted in conjunction with the driving of the engine 32 of the working machine 1. Accordingly, the accuracy of horsepower control of the working system of the working machine 1 can be improved, and a maximum output of the second hydraulic pump P2 can be obtained in the controllable horsepower range.

Further, the controller 25 controls the opening of the solenoid valve 81 to change the pilot pressure (the second pressure PA) acting on the opening changing unit 76, and the LS differential pressure is changed by the opening changing unit 76, the flow rate compensation valve 72, and the swash-plate variable unit 73. As a result, the output of the second hydraulic pump P2 is adjusted. Accordingly, the output of the second hydraulic pump P2 can be flexibly adjusted, and the accuracy of the horsepower control of the working system of the working machine 1 can further be improved.

In another example, the controller 25 may change the LS differential pressure on the basis of the actual rotational speed of the engine 32 and a target engine rotational speed. The target engine rotational speed can be set by an operation of an accelerator member 84 (FIG. 1A).

The accelerator member 84 includes a first accelerator member 84*a* and a second accelerator member 84*b*. The accelerator members 84*a* and 84*b* are disposed near the operator's seat 8 and are connected to the controller 25. The first accelerator member 84*a* is a dial operation member having a rotatable knob. The target engine rotational speed can be set by the driver (or operator) rotating the knob of the first accelerator member 84*a* while holding it. The second accelerator member 84*b* is a pedal operation member having a swingable pedal. The target engine rotational speed can also be set by the driver depressing the pedal of the second accelerator member 84*b*.

The amounts of operation of the accelerator members 84*a* and 84*b* are detected by, for example, a potentiometer or other device and are input to the controller 25. The controller 25 adopts the larger one of a target engine rotational speed set by the first accelerator member 84*a* (referred to as "first target engine rotational speed") and a target engine rotational speed set by the second accelerator member 84*b* (referred to as "second target engine rotational speed"). For example, when the first target engine rotational speed is 1300 rpm and the second target engine rotational speed is 2200 rpm, the controller 25 sets the second target engine rotational speed set by the second accelerator member 84*b* as a target engine rotational speed EP2, and controls the driving of the engine 32 in accordance with the target engine rotational speed EP2.

If an actual rotational speed EP1 of the engine 32, which is measured by the first measurement device 82, is equal to or greater than the target engine rotational speed EP2 (actual rotational speed EP1≥target engine rotational speed EP2), the controller 25 sets the LS differential pressure on the basis of the first control line L1 in FIG. 2A and the actual rotational speed EP1, and outputs a control signal corresponding to the set LS differential pressure to the solenoid valve 81. That is, when the actual rotational speed EP1 of the engine 32 is equal to or greater than the target engine rotational speed EP2, the controller 25 changes the LS differential pressure in accordance with the actual rotational speed EP1 of the engine 32.

On the other hand, if the actual rotational speed EP1 of the engine 32, which is measured by the first measurement device 82, is lower than the target engine rotational speed EP2 (actual rotational speed EP1<target engine rotational speed EP2) or if the actual rotational speed EP1 is lower than a rotational speed obtained by subtracting a predetermined value A1 from the target engine rotational speed EP2 (actual rotational speed EP1<target engine rotational speed EP2−predetermined value A1, where A1=100 rpm, for example), as illustrated in FIG. 2A, the controller 25 calculates a second control line L2, which is shifted from the first control line L1 in a direction in which the LS differential pressure decreases. Then, the controller 25 sets the LS differential pressure on the basis of the second control line L2 and the actual rotational speed EP1, and outputs a control signal corresponding to the set LS differential pressure to the solenoid valve 81. That is, when the actual rotational speed EP1 of the engine 32 becomes lower than the target engine rotational speed EP2, the controller 25 decreases the LS differential pressure. The pump delivery amount indicated by the thick solid line in FIG. 2A corresponds to the first control line L1, but does not correspond to the second control line L2.

The controller 25 calculates the second control line L2 in accordance with, for example, Equation (1) below.

$$\text{Second control line L2} = \text{first control line L1} \times e^{2[\text{constant} \times \text{maximum load factor (load factor} - \text{constant}, 0)]} \quad (1)$$

In Equation (1), the load factor is a load factor of the engine 32, and the maximum load factor is a maximum load factor of the engine 32. The load factor of the engine 32 is the ratio of the output of the engine 32 when a device (the working device 4 or the traveling device 5) mounted on the working machine 1 is in operation (a load application state) to the output of the engine 32 when the device is not in operation (a no-load state). The output of the engine 32 is the amount of work (expressed in kW or horsepower (PS)) obtained by multiplying the torque of the engine 32 by the rotational speed of the engine 32. The torque of the engine 32 is detected by a torque sensor (not illustrated). When the value obtained by "load factor−constant" in Equation (1) is negative, the value of the "maximum load factor (given by load factor−constant)" is set to 0.

For example, when the hydraulic actuators (the boom cylinders 14, the bucket cylinders 15, and the hydraulic actuator of the auxiliary attachment) of the working device 4 are in stop state and the traveling device 5 is in stop state, the controller 25 determines that the engine 32 is in the no-load state. Then, the controller 25 calculates the output of the engine 32 at this time, and records the calculated value as the output of the engine 32 in the no-load state. The calculation of the output of the engine 32 in the no-load state and the recording of the calculated output may be executed by the controller 25 at intervals of a predetermined period. In another example, the output of the engine 32 in the no-load state may be set in advance and stored in the storage unit 26.

When at least one of the traveling device 5 and the hydraulic actuators of the working device 4 is activated, the controller 25 determines that the engine 32 is in the load application state. Then, the controller 25 calculates the output of the engine 32 at intervals of a predetermined period, and uses a calculated value as the output of the engine 32 in the load application state. Each time the controller 25 calculates the output of the engine 32 in the load application state, the controller 25 calculates the ratio of the output of the engine 32 in the load application state to the already recorded output of the engine 32 in the no-load state as a load factor of the engine 32, and records the calculated load factor. Further, the controller 25 detects the maximum load factor among the recorded load factors of the engine 32.

In another example, the controller 25 may calculate the second control line L2 in accordance with Equation (2) below.

$$\text{Second control line L2} = \text{first control line L1} \times e^2 - (\alpha \times \Delta E) \quad (2)$$

In Equation (2), ΔE is a rotational speed difference between the target engine rotational speed and the actual rotational speed (rotational speed difference ΔE=target engine rotational speed EP2−actual rotational speed EP1). Further, α is a coefficient that changes in accordance with whether the working machine 1 is in a travel-priority mode in which travel is prioritized or a work-priority mode in which work of the working machine 1 is prioritized. The coefficient α in the work-priority mode has a smaller value than the coefficient α in the travel-priority mode. The travel-priority mode and the work-priority mode can be switched by the operation of a switch or the like disposed around the operator's seat 8. In addition, a slight travel-priority mode in which travel is slightly prioritized over work and a slight work-priority mode in which work is slightly prioritized over travel may be provided between the travel-priority mode and the work-priority mode, and the coefficient α may be changed for each of these four modes.

In another example, when the actual rotational speed of the engine 32 slightly decreases (by less than several rotations, for example) from the target engine rotational speed, the controller 25 may calculate the second control line L2 in accordance with Equation (3) or (4) below without using Equation (2) above.

$$\text{Second control line L2} = \text{first control line L1} \times e^2 - (\alpha \times \Delta E^2) \quad (3)$$

$$\text{Second control line L2} = \text{first control line L1} \times e^2 - \{\alpha \times \text{maximum load factor}(\Delta E - \text{constant}, 0)\} \quad (4)$$

In the example described above, when the actual rotational speed of the engine 32 becomes lower than the target engine rotational speed, the controller 25 calculates the second control line L2 by shifting the first control line L1 in the direction in which the LS differential pressure decreases. Alternatively, the second control line L2 may be set in advance and stored in the storage unit 26.

As described above, when the actual rotational speed of the engine 32 becomes lower than the target engine rotational speed, the controller 25 changes the LS differential pressure on the basis of the second control line L2 and the actual rotational speed. Thus, even if the actual rotational speed decreases in response to the application of some load to the engine 32, the delivery amount of the hydraulic fluid from the second hydraulic pump P2 can be reduced in accordance with the load. Further, the controller 25 calculates the second control line L2 in accordance with the load or the rotational speed of the engine 32. Thus, the delivery amount of the hydraulic fluid from the second hydraulic pump P2 can be reduced in accordance with the load of the engine 32. As a result, the accuracy of horsepower control of the working system of the working machine 1 can be improved.

In another example, the controller 25 may change the LS differential pressure on the basis of the difference (the rotational speed difference ΔE) between the target engine rotational speed and the actual rotational speed. In this case, first, the controller 25 determines the rotational speed difference (ΔE) between the target engine rotational speed set by the accelerator member 84 and the actual rotational speed measured by the first measurement device 82. Then, the control the controller 25 shifts the first control line L1 in the direction in which the LS differential pressure decreases, in accordance with the rotational speed difference ΔE. At this time, the controller 25 increases the shift amount of the first control line L1 as the rotational speed difference ΔE increases. Further, the controller 25 multiplies a predetermined constant A (pressure expressed in MPa) by the rotational speed difference ΔE to determine the shift amount (shift amount=A×ΔE). Then, the controller 25 shifts the first control line L1 in the direction in which the LS differential pressure decreases by the obtained shift amount to calculate the second control line L2. Then, the controller 25 sets the LS differential pressure on the basis of the second control line L2 and the actual rotational speed of the engine 32, and outputs a control signal corresponding to the set LS differential pressure to the solenoid valve 81.

With the operation described above, even if the actual rotational speed decreases with respect to the target engine rotational speed due to the load of the engine 32, the delivery amount of the hydraulic fluid from the second hydraulic pump P2 can be reduced in accordance with the amount of decrease (the rotational speed difference ΔE). As a result, it is possible to accurately perform horsepower control of the working system of the working machine 1 in accordance with the load of the engine 32.

In another example, a second control line L2 corresponding to each shift amount may be set in advance and stored in the storage unit 26.

Further, the controller 25 may change the LS differential pressure on the basis of the amount of fuel injected into the engine 32. In this case, the controller 25 calculates the injection amount of fuel to be injected from an injector (not illustrated) when controlling the driving of the engine 32. The injection amount is calculated based on various conditions input to the controller 25, such as the target engine rotational speed, the actual rotational speed, or a crank angle. The specific calculation method is known in the art and will not be further discussed. When the engine 32 is a diesel engine, the injection amount of fuel is an injection amount (main injection amount) of fuel to generate an output of the engine 32, and is not a post injection amount to perform diesel particulate filter (DPF) regeneration (particulate combustion) or the like.

Upon calculating the injection amount of fuel, the controller 25 determines whether the injection amount is greater than a predetermined injection threshold. The injection threshold is set to a value larger than a standard injection amount determined in accordance with the engine rotational speed. If the calculated injection amount of fuel is greater than the injection threshold, the controller 25 calculates the second control line L2 by shifting the first control line L1 in the direction in which the LS differential pressure decreases. Then, the controller 25 sets the LS differential pressure on the basis of the second control line L2 and the actual rotational speed of the engine 32, and outputs a control signal corresponding to the set LS differential pressure to the solenoid valve 81. With this operation, even if the load of the engine 32 is large and the injection amount of fuel becomes greater than the injection threshold, the delivery amount of the hydraulic fluid from the second hydraulic pump P2 can be reduced. As a result, it is possible to accurately perform horsepower control of the working system of the working machine 1 in accordance with the load of the engine 32.

Further, the solenoid valve 81 may change the LS differential pressure on the basis of the load factor of the engine 32. In this case, the controller 25 calculates the load factor of the engine 32 in the way described above, and determines whether the load factor is greater than a predetermined threshold. If the load factor of the engine 32 is greater than the threshold, the controller 25 calculates the second control line L2 by shifting the first control line L1 in the direction in which the LS differential pressure decreases. Then, the controller 25 sets the LS differential pressure on the basis of the second control line L2 and the actual rotational speed of the engine 32, and outputs a control signal corresponding to the set LS differential pressure to the solenoid valve 81. With this operation, even if the load of the engine 32 is large and the load factor becomes large, the delivery amount of the hydraulic fluid from the second hydraulic pump P2 can be reduced. As a result, it is possible to accurately perform horsepower control in accordance with the load of the engine 32.

Further, the controller 25 may calculate the second control line L2 by increasing the shift amount of the first control line L1 as the temperature of at least one of the hydraulic fluid (including pilot fluid) provided in the working machine 1, cooling water for cooling various devices mounted on the working machine 1, or engine oil in the engine 32 increases. Then, the controller 25 may set the LS differential pressure on the basis of the second control line L2 and the actual rotational speed of the engine 32, and cause the hydraulic control unit 75 to realize the LS differential pressure.

Alternatively, the controller 25 may change the LS differential pressure on the basis of the temperature of at least one of the hydraulic fluid provided in the working machine 1, the cooling water, or the engine oil. The controller 25 is connected to a second measurement device 83 (FIG. 1A) that measures the temperature of fluid flowing through a flow path disposed in the working machine 1. The second measurement device 83 measures the temperature of at least one of hydraulic fluid flowing through a fluid passage disposed in the working machine 1, cooling water flowing through a water passage and to be used for cooling the engine 32 and other devices, or engine oil flowing through a fluid passage disposed in the engine 32. Upon acquiring the temperature measured by the second measurement device 83, the controller 25 executes a first determination and/or a second determination. The first determination is to determine whether the temperature of the fluid is equal to or less than a corresponding predetermined lower limit threshold. The second determination is to determine whether the temperature of the fluid is equal to or greater than a corresponding predetermined upper limit threshold.

The lower limit threshold and the upper limit threshold are predetermined temperatures of the fluid that are set to determine, based on the temperature of the fluid, whether the working machine 1 has good heat balance. For example, when the temperature of the hydraulic fluid or the temperature of the engine oil is equal to or less than −20° C., the controller 25 determines that the working machine 1 does not have good heat balance because the hydraulic fluid or the engine oil has high viscosity. Also when the temperature of the hydraulic fluid or the engine oil is equal to or greater than 60° C., the controller 25 determines that the working machine 1 does not have good heat balance.

As described above, the controller 25 acquires the temperature of the fluid (at least one of the hydraulic fluid, the cooling water, or the engine oil) measured by the second measurement device 83, makes a comparison between the temperature of the fluid with the upper limit threshold or the lower limit threshold, and determines whether the working machine 1 has good heat balance, based on the result of the comparison. If the working machine 1 does not have good heat balance, that is, if the temperature of the fluid is equal to or less than the lower limit threshold or if the temperature of the fluid is equal to or greater than the upper limit threshold, the controller 25 calculates the second control line L2 by shifting the first control line L1 in the direction in which the LS differential pressure decreases. At this time, the controller 25 may calculate the second control line L2 by increasing the shift amount of the first control line L1 as the difference between the temperature of the fluid and the upper limit threshold or the lower limit threshold increases. Upon calculating the second control line L2, the controller 25 sets the LS differential pressure on the basis of the second control line L2 and the actual rotational speed of the engine 32, and outputs a control signal corresponding to the set LS differential pressure to the solenoid valve 81 to realize the LS differential pressure.

With the operation described above, when the working machine 1 does not have good heat balance, the delivery amount of the hydraulic fluid from the second hydraulic pump P2 can be reduced. As a result, it is possible to accurately perform horsepower control of the working system of the working machine 1 in accordance with the load of the engine 32, and it is also possible to encourage the working machine 1 to have good heat balance.

Second Preferred Embodiment

Figure 3:
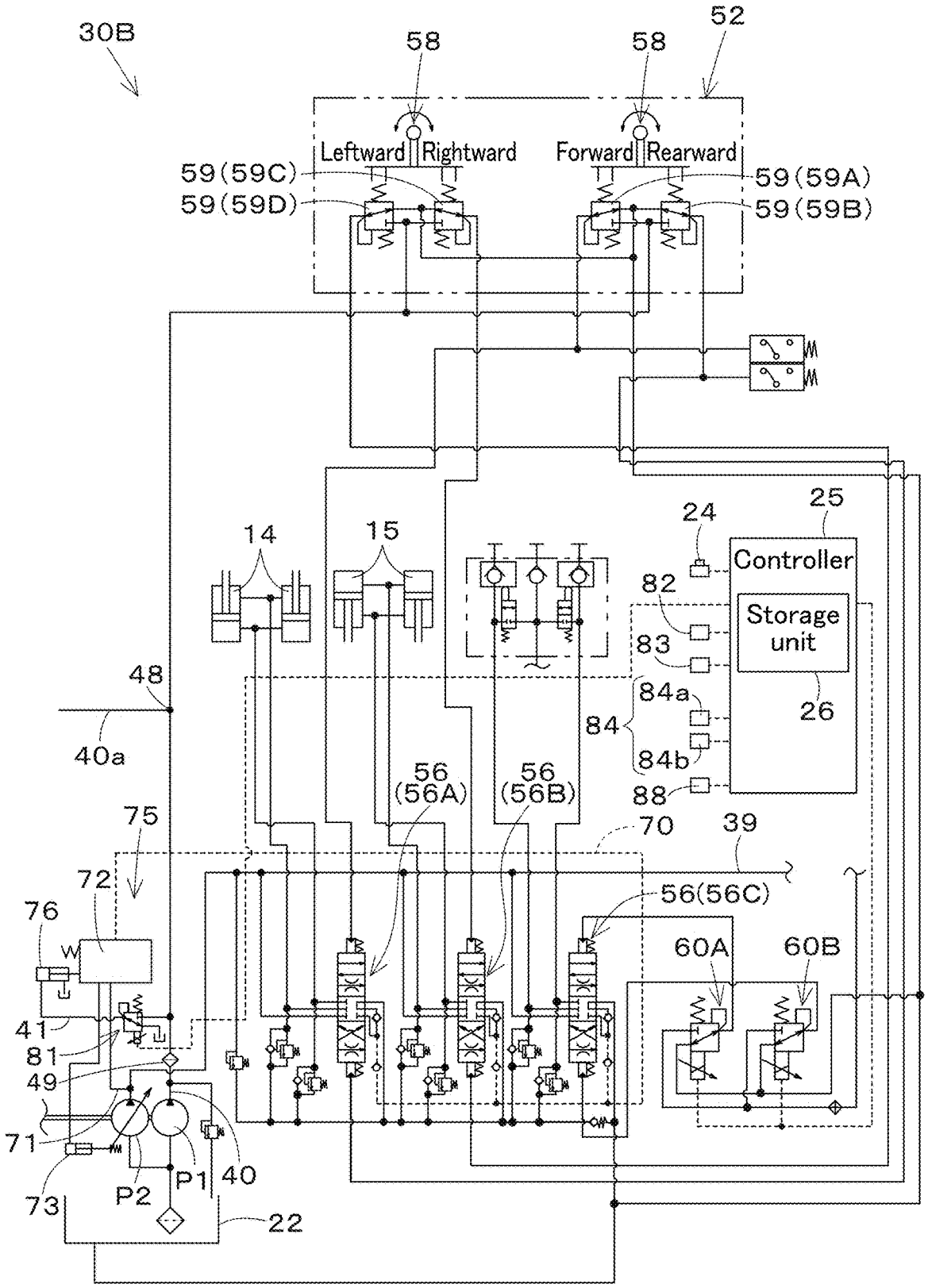
FIG. 3 is an overall view of a hydraulic system for a working system of a working machine according to a second preferred embodiment of the present invention.

FIG. 3 is a diagram illustrating a hydraulic system 30B for the working machine 1 according to a second preferred embodiment. In the second preferred embodiment, a configuration similar to that of the first preferred embodiment will not be described.

In the hydraulic system 30B according to the second preferred embodiment illustrated in FIG. 3, a command member 88 that gives a command to change the LS differential pressure is connected to the controller 25. The command member 88 is an operation switch disposed near the operator's seat 8. When the command member 88 is turned on, an electric signal to provide a command to change the LS differential pressure is generated from an electric circuit that operates in conjunction with the command member 88. The generated electric signal (hereinafter simply referred to as a "change command") is input to the controller 25. Before the command member 88 is turned on, or when the command member 88 is in an off state, the change command of the LS differential pressure is not generated or is not input to the controller 25.

Figure 4A:
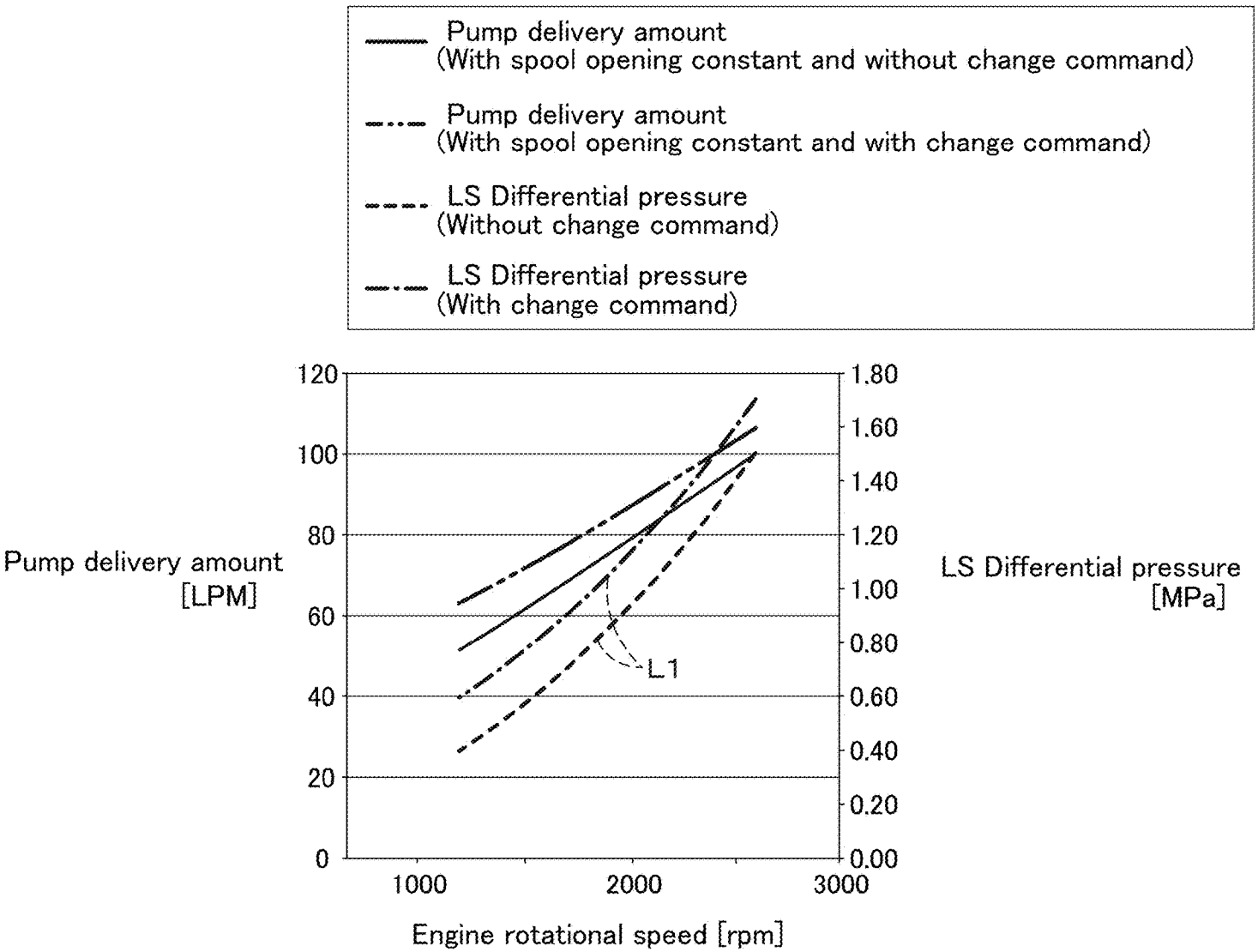
FIG. 4A is a graph illustrating a relationship among an engine rotational speed, an LS differential pressure, and a pump delivery amount according to the second preferred embodiment of the present invention.

FIG. 4A is a graph illustrating a relationship among the engine rotational speed, the LS differential pressure, and the pump delivery amount in the working machine 1 in accordance with whether the change command of the LS differential pressure is generated. FIG. 4B is a table illustrating the same relationship as that illustrated in FIG. 4A. Control maps illustrated in FIGS. 4A and 4B are stored in advance in the storage unit 26.

As illustrated in FIGS. 4A and 4B, in a case where the change command of the LS differential pressure is not input from the command member 88 to the controller 25 (without the change command), the relationship between the engine rotational speed, the LS differential pressure, and the pump delivery amount (a control line L1 indicated by a broken line in FIG. 4A and the first to third columns from the left in FIG. 4B) is the same as the relationship between the engine rotational speed, the LS differential pressure, and the pump delivery amount illustrated in FIGS. 2A and 2B. In a case where the change command of the LS differential pressure is input from the command member 88 to the controller 25 (with the change command generated), the LS differential pressure and the pump delivery amount corresponding to the engine rotational speed are higher than those in a case where the change command is not generated (a control line L1 indicated by a one dot chain line in FIG. 4A, and the first, fourth, and fifth columns from the left in FIG. 4B).

The controller 25 sets the LS differential pressure on the basis of whether the change command is generated from the command member 88, and on the basis of the actual rotational speed of the engine 32, which is measured by the first measurement device 82, and the control map illustrated in FIG. 4A or 4B, and outputs a control signal corresponding to the set LS differential pressure to the solenoid valve 81. Accordingly, the opening of the solenoid valve 81 is changed in accordance with the control signal, and the LS differential pressure corresponding to the control signal is realized. That is, in a case where the change command of the LS differential pressure is generated from the command member 88, the LS differential pressure is changed in accordance with the actual rotational speed of the engine 32, which is measured by the first measurement device 82.

Further, as illustrated in FIGS. 4A and 4B, the controller 25 sets the LS differential pressure obtained in a case where the change command of the LS differential pressure is generated from the command member 88 to a value larger than the LS differential pressure obtained in a case where the change command of the LS differential pressure is not generated from the command member 88. That is, in a case where the change command of the LS differential pressure is generated from the command member 88, the LS differential pressure is larger than that in a case where the change command of the LS differential pressure is not generated from the command member 88.

With the operation described above, for example, the driver of the working machine 1 who desires to operate the attachments of the working device 4, that is, the hydraulic actuators (the boom cylinders 14, the bucket cylinders 15, and the hydraulic actuator of the auxiliary attachment), more quickly than usual turns on the command member 88 to increase the LS differential pressure, thereby increasing the delivery amount of the hydraulic fluid from the second hydraulic pump P2. As a result, the working machine 1 enters a high-speed mode, which enables quick operation of the hydraulic actuators of the working device 4.

Third Preferred Embodiment

In a third preferred embodiment, the accelerator member 84 is also used as a command member. That is, in response to an operation of the first accelerator member 84*a* and/or the second accelerator member 84*b* of the accelerator member 84, the rotational speed of the engine 32 can be set, and the change command of the LS differential pressure can be generated. The configuration of a hydraulic system for the working machine 1 according to the third preferred embodiment is similar to the configuration of the hydraulic system 30A according to the first preferred embodiment illustrated in FIGS. 1A and 1B, and thus description thereof will be omitted.

For example, in response to an operation of the first accelerator member 84*a* and/or the second accelerator member 84*b*, a predetermined electric signal is input to the controller 25 from an electric circuit (not illustrated) that operates in conjunction with the operated accelerator member. In accordance with the electric signal, the controller 25 sets the target engine rotational speed and determines that the change command of the LS differential pressure is generated.

In a case where both the accelerator members 84*a* and 84*b* are operated, the controller 25 sets a first target engine rotational speed in accordance with an electric signal input in response to the operation of the first accelerator member 84*a*, and sets a second target engine rotational speed in accordance with an electric signal input in response to the operation of the second accelerator member 84*b*. The controller 25 adopts the larger one of the first target engine rotational speed and the second target engine rotational speed as the target engine rotational speed. Further, the controller 25 controls the driving of the engine 32 on the basis of the adopted target engine rotational speed and the actual rotational speed of the engine 32 so that the engine rotational speed of the engine 32 matches the target engine rotational speed. Further, the controller 25 sets the LS differential pressure (the change value of the LS differential pressure) on the basis of the rotational speed that is not adopted as the target engine rotational speed, that is, the smaller one of the first target engine rotational speed and the second target engine rotational speed.

For example, the first accelerator member 84*a* is operated by a maximum amount or a predetermined amount or more that is slightly smaller than the maximum amount to set the first target engine rotational speed to a maximum value or a value slightly smaller than the maximum value, and the second accelerator member 84*b* is operated by an operation amount smaller than the amount of operation of the first accelerator member 84*a* to set the second target engine rotational speed to a value smaller than the first target engine rotational speed. In this case, the controller 25 adopts the first target engine rotational speed as the target engine rotational speed, and sets the LS differential pressure on the basis of the second target engine rotational speed.

Conversely, the second accelerator member 84*b* is operated by a maximum amount or a predetermined amount or more that is slightly smaller than the maximum amount to set the second target engine rotational speed to a maximum value or a value slightly smaller than the maximum value, and the first accelerator member 84*a* is operated by an operation amount smaller than the amount of operation of the second accelerator member 84*b* to set the first target engine rotational speed to a value smaller than the second target engine rotational speed. In this case, the controller 25 adopts the second target engine rotational speed as the target engine rotational speed, and sets the LS differential pressure on the basis of the first target engine rotational speed.

Figure 5:
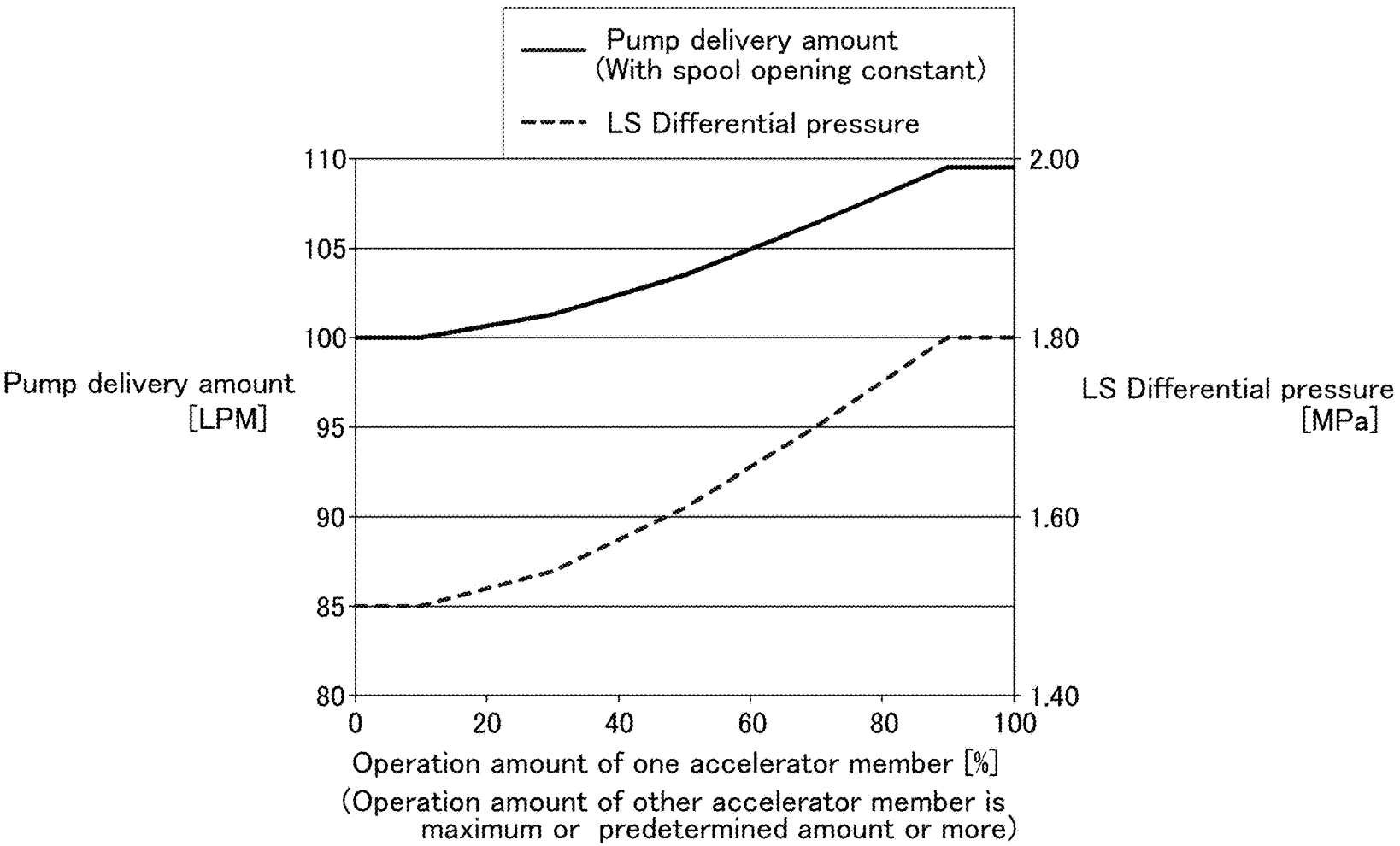
FIG. 5 is a graph illustrating a relationship among an amount of operation of one of accelerator members when an amount of operation of the other accelerator member is the maximum amount or is a predetermined amount or more, an LS differential pressure, and a pump delivery amount according to a third preferred embodiment of the present invention.

FIG. 5 is a graph illustrating a relationship among the amount of operation of one of the first accelerator member 84*a* and the second accelerator member 84*b* when the amount of operation of the other accelerator member is the maximum amount or is the predetermined amount or more, the LS differential pressure, and the pump delivery amount. FIG. 6 is a table illustrating the same relationship as that illustrated in FIG. 5. Control maps illustrated in FIGS. 5 and 6 are stored in advance in the storage unit 26.

When the amount of operation of one of the first accelerator member 84*a* and the second accelerator member 84*b* is equal to or less than a small (i.e., slightly larger than about 0%) predetermined amount (10%) and the amount of operation of the other accelerator member is the maximum amount (100%) or is a large (i.e., slightly smaller than 100%) predetermined amount (i.e., about 90%) or more, the control maps illustrated in FIGS. 5 and 6 indicate that the LS differential pressure is 1.50 MPa. As presented in the first preferred embodiment (FIGS. 2A and 2B) and the second preferred embodiment (FIGS. 4A and 4B), the minimum value (i.e., about 1.50 MPa) of the LS differential pressure is the same value as the LS differential pressure (i.e., about 1.50 MPa) when the engine rotational speed is the maximum value (i.e., about 2600 rpm) (in the second preferred embodiment, when the change command is not generated and the engine rotational speed is the maximum value). That is, even when one of the first accelerator member 84*a* and the second accelerator member 84*b* is not in operation, if the amount of operation of the other accelerator member is the maximum amount or is the large predetermined amount or more, the LS differential pressure is set to the minimum value.

In the control maps illustrated in FIGS. 5 and 6, furthermore, the LS differential pressure increases as the amount of operation of one accelerator member increases. When the amount of operation of one accelerator member becomes equal to or greater than the large (i.e., slightly smaller than about 100%) predetermined amount (i.e., about 90%), the LS differential pressure reaches the maximum value, i.e., about 1.80 MPa.

The controller 25 sets the LS differential pressure on the basis of the amount of operation of an accelerator member having a smaller amount of operation (including an amount of operation of about 0%) among the first accelerator member 84*a* and the second accelerator member 84*b* and on the basis of the control map illustrated in FIG. 5 or 6, and outputs a control signal corresponding to the set LS differential pressure to the solenoid valve 81. Accordingly, the opening of the solenoid valve 81 is changed in response to the control signal, and the LS differential pressure corresponding to the control signal is realized.

That is, in a case where the driver of the working machine 1 operates both the first accelerator member 84*a* and the second accelerator member 84*b*, the rotational speed of the engine 32 can be changed in accordance with the operation of an accelerator member having a larger amount of operation among the first accelerator member 84*a* and the second accelerator member 84*b* to operate the travel speed of the working machine 1. Further, the delivery amount of the hydraulic fluid from the second hydraulic pump P2 can also be changed by changing the LS differential pressure in accordance with the operation of the other accelerator member having a smaller amount of operation. In particular, in response to the operator operating both the first accelerator member 84*a* and the second accelerator member 84*b* with a large amount of operation, the LS differential pressure can be increased, and the delivery amount of the hydraulic fluid from the second hydraulic pump P2 can be increased. As a result, it is possible to accurately perform horsepower control of the working machine 1 in accordance with the operating states of the accelerator member 84 (the first accelerator member 84*a* and the second accelerator member 84*b*).

Figure 7A:
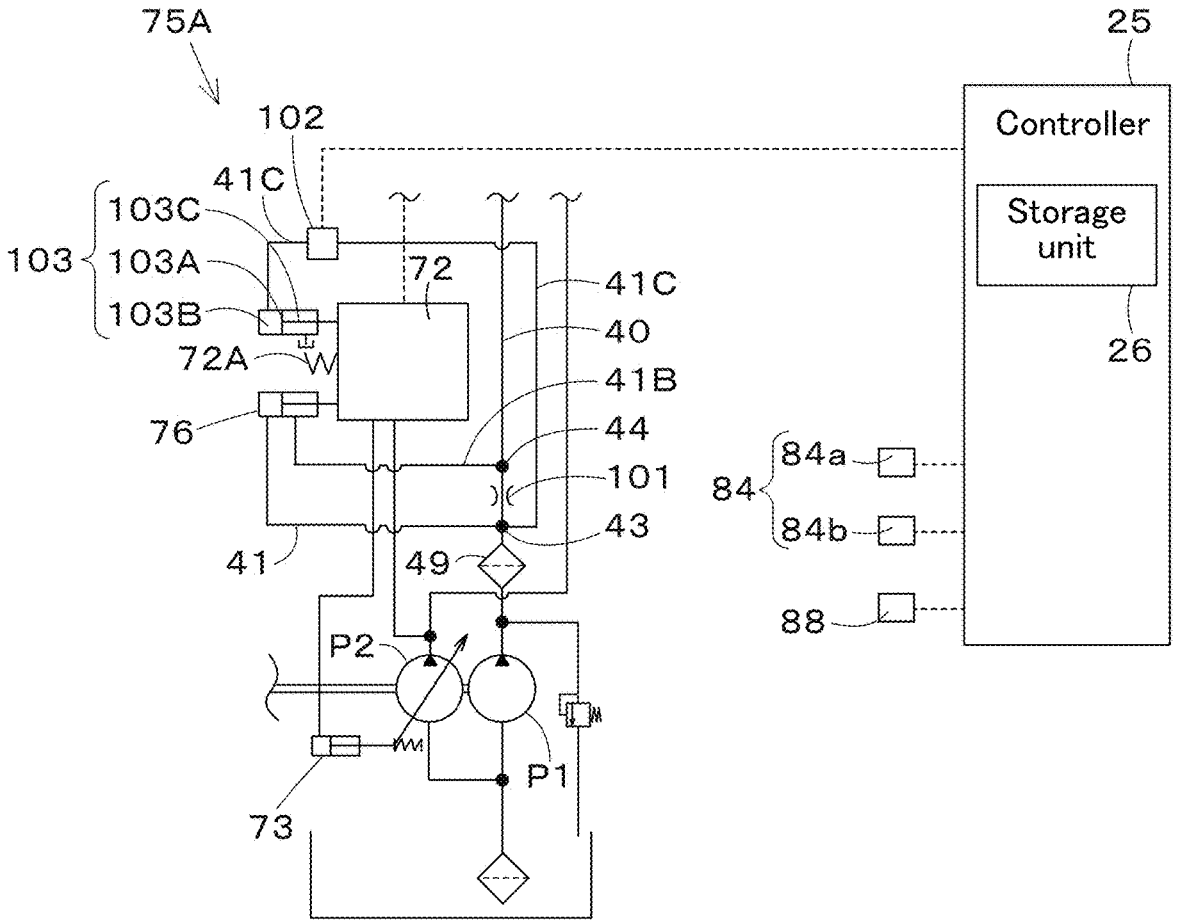
FIG. 7A is a diagram illustrating a first modification of the hydraulic control unit.

FIG. 7A is a diagram illustrating a first modification of the hydraulic control unit 75. A hydraulic control unit 75A illustrated in FIG. 7A includes a throttle 101, a solenoid valve 102, and an opening changing unit 103 (second opening changing unit) in addition to the flow rate compensation valve 72, the swash-plate variable unit 73, and the opening changing unit 76 (first opening changing unit). In the present preferred embodiment, a plurality of fluid passages, which include a second branch fluid passage 41B and a third branch fluid passage 41C in addition to a first branch fluid passage 41 corresponding to the fourth fluid passage 41 in the foregoing preferred embodiment illustrated in FIG. 1B and so on, serve as the fourth fluid passage branched from the third fluid passage 40. A first connection point (branch point) 43 between the third fluid passage 40 and the first branch fluid passage 41 is also connected to the third branch fluid passage 41C. A second connection point (branch point) 44 located downstream of the first connection point 43 (i.e., farther away from the first hydraulic pump P1 than the first connection point 43) is connected to the second branch fluid passage 41B. The housing 76B of the opening changing unit 76 is divided by the piston 76A in the housing 76B into a bottom-side chamber and a rod-side chamber opposite to the bottom-side chamber in the axial direction of the rod 76C extended from the piston 76A. The bottom-side chamber of the housing 76B is expanded from the piston 76A to a bottom of a cylinder defining the opening changing unit 76 so as not to incorporate the rod 76C extended from the piston 76A. The rod-side chamber of the housing 76B is a chamber incorporating the rod 76C extended from the piston 76A. In the following preferred embodiments in each of which the opening changing unit 76 is used, the chambers of the housing 76B defined by the piston 76A will also be referred to as the bottom-side chamber and the rod-side chamber. A distal end (an end opposite to the end adjacent to the first connection point 43) of the first branch fluid passage 41 is connected to the bottom-side chamber of the housing 76B. A distal end (an end opposite to the end adjacent to the second connection point 44) of the second branch fluid passage 41B is connected to the rod-side chamber of the housing 76B. Incidentally, reference numerals 76A, 76B, and 76C are not illustrated in FIG. 7A, but are to be considered as corresponding to reference numerals 76A, 76B, and 76C in FIG. 1B, respectively.

The throttle 101 is located between the first connection point 43 and the second connection point 44 of the third fluid passage 40. The throttle 101 decreases the flow rate of the pilot fluid flowing through the third fluid passage 40. The solenoid valve 102 includes a solenoid proportional valve, a variable relief valve, a solenoid switching valve, a solenoid throttle valve, or the like. The solenoid valve 102 is located in an intermediate portion of the third branch fluid passage 41C.

The opening changing unit 103 is a hydraulic cylinder. The opening changing unit 103 includes a piston 103A, a housing 103B that houses the piston 103A, and a rod 103C that is movable with the movement of the piston 103A. The housing 103B of the opening changing unit 103 is divided by the piston 103A in the housing 103B into a bottom-side chamber and a rod-side chamber opposite to the bottom-side chamber in the axial direction of the rod 103C extended from the piston 103A. The bottom-side chamber of the housing 103B is expanded from the piston 103A to a bottom of a cylinder defining the opening changing unit 103 so as not to incorporate the rod 103C extended from the piston 103A. A distal end (an end opposite to the end adjacent to the first connection point 43) of the third branch fluid passage 41C is connected to the bottom-side chamber of the housing 103B. The rod-side chamber of the housing 103B is a chamber incorporating the rod 103C extended from the piston 103A. The rod 103C is extended outward from an end of the rod-side chamber of the housing 103B and connected to the flow rate compensation valve 72. The piston 103A is movable by the pressure of the pilot fluid discharged from the solenoid valve 102 to the third branch fluid passage 41C.

When the pressure of the pilot fluid discharged from the solenoid valve 102 to the third branch fluid passage 41C adjacent to the piston 103A increases, the piston 103A moves in a direction to extend the rod 103C (in a direction approaching the flow rate compensation valve 72). When the pressure of the pilot fluid discharged from the solenoid valve 102 to the third branch fluid passage 41C adjacent to the piston 103A decreases, the piston 103A moves in a direction to contract the rod 103C (in a direction away from the flow rate compensation valve 72).

The controller 25 controls the opening of the solenoid valve 102. For example, when the command member 88 is in the off state, the solenoid valve 102 is in a fully closed state. When the command member 88 is turned on, the controller 25 inputs a control signal (electric signal) to the solenoid valve 102 to bring the solenoid valve 102 into a fully open state. When the command member 88 is in the off state, the controller 25 may input a control signal for fully closing to the solenoid valve 102 to bring the solenoid valve 102 into the fully closed state.

When the solenoid valve 102 is in the fully closed state, the pilot fluid delivered from the first hydraulic pump P1 to the third fluid passage 40 flows through the first branch fluid passage 41 and flows into the bottom-side chamber of the housing 76B of the opening changing unit 76. In this way, the pilot pressure of the pilot fluid that is to flow into the opening changing unit 76 is set by the throttle 101. The opening changing unit 76 causes the rod 76C to extend or contract using the pilot pressure applied from the first branch fluid passage 41 to set the opening of the flow rate compensation valve 72.

When the solenoid valve 102 is in the fully open state, the pilot fluid delivered from the first hydraulic pump P1 to the third fluid passage 40 flows through the third branch fluid passage 41C and flows via the solenoid valve 102 into the bottom-side chamber of the housing 103B of the opening changing unit 103. The opening of the solenoid valve 102 is changed by the controller 25 to change the pilot pressure of the pilot fluid that is to flow into the opening changing unit 103. The opening changing unit 103 causes the rod 103C to extend or contract using the pilot pressure applied from the third branch fluid passage 41C to change the opening of the flow rate compensation valve 72.

In another example, the controller 25 may control the opening of the solenoid valve 102 in accordance with the operating state of the accelerator member 84. For example, when the amount of operation (depression amount) of the second accelerator member 84*b* is 0% (the second accelerator member 84*b* is not in operation), the controller 25 brings the solenoid valve 102 into the fully closed state. In response to an operation of the second accelerator member 84*b*, the controller 25 increases the opening of the solenoid valve 102 as the amount of operation of the second accelerator member 84*b* increases.

When the second accelerator member 84*b* is not in operation, the solenoid valve 102 is in the fully closed state, and thus the pilot pressure acting on the opening changing unit 76 is set by the throttle 101. When the second accelerator member 84*b* is operated, the solenoid valve 102 is opened, and thus the pilot pressure acting on the opening changing unit 103 is increased. Since the opening of the solenoid valve 102 increases as the amount of operation of the second accelerator member 84*b* increases, the pilot pressure acting on the opening changing unit 103 also increases.

For example, when the amount of operation of the second accelerator member 84*b* is other than 0%, the controller 25 sets the pilot pressure acting on the opening changing unit 103 on the basis of the amount of operation of the second accelerator member 84*b* and the control map illustrated in FIG. 5 or 6, and inputs a control signal (electric signal) corresponding to the pilot pressure to the solenoid valve 102 to adjust the opening of the solenoid valve 102. As a result, the pilot pressure acting on the opening changing unit 103 is changed, and the opening changing unit 103 changes the opening of the flow rate compensation valve 72.

As in the case of the second accelerator member 84*b* described above, the controller 25 may adjust the opening of the solenoid valve 102 in accordance with the operating state of the first accelerator member 84*a* to change the pilot pressure acting on the opening changing unit 103.

Figure 7B:
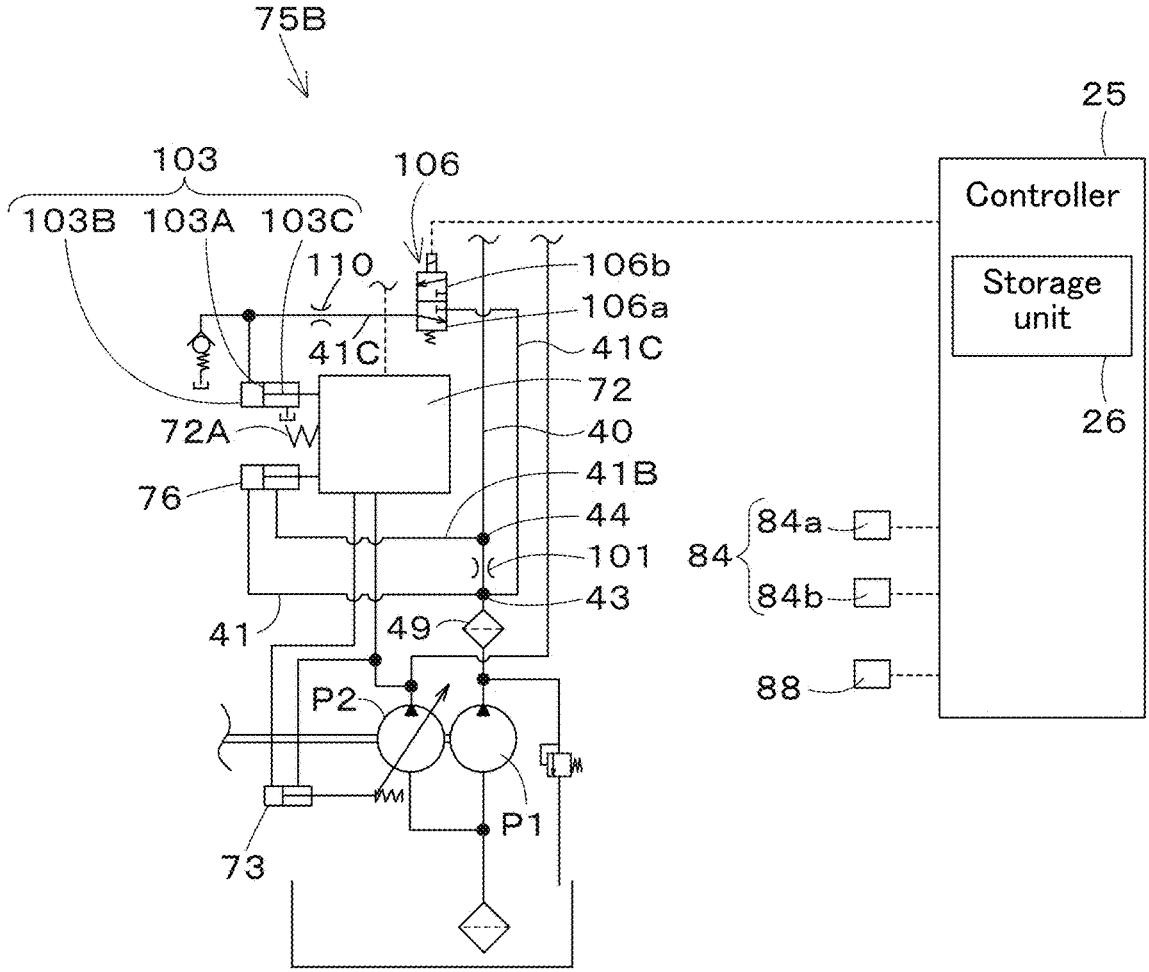
FIG. 7B is a diagram illustrating a second modification of the hydraulic control unit.

FIG. 7B is a diagram illustrating a second modification of the hydraulic control unit 75. A hydraulic control unit 75B illustrated in FIG. 7B is provided with a solenoid switching valve 106 and a throttle 110 in an intermediate portion of the third branch fluid passage 41C. The solenoid switching valve 106 is located closer to the first connection point 43 than the throttle 110. The solenoid switching valve 106 includes, for example, a two-position switching valve that is switchable between a first position 106*a* and a second position 106*b*.

The controller 25 inputs a control signal (electric signal) to the solenoid switching valve 106 to switch the position of the solenoid switching valve 106. For example, when the command member 88 is in the off state, as illustrated in FIG. 7B, the solenoid switching valve 106 is in the first position 106*a*. When the command member 88 is turned on, the controller 25 inputs a control signal to the solenoid switching valve 106 to switch the solenoid switching valve 106 to the second position 106*b*. When the command member 88 is in the off state, the controller 25 may input a control signal to the solenoid switching valve 106 to switch the solenoid switching valve 106 to the first position 106*a*.

In response to the solenoid switching valve 106 being switched to the first position 106*a*, even if the pilot fluid delivered from the first hydraulic pump P1 to the third fluid passage 40 flows to the third branch fluid passage 41C, the pilot fluid is not allowed to pass through the solenoid switching valve 106 and is not caused to flow to the opening changing unit 103. Accordingly, the pilot fluid delivered from the first hydraulic pump P1 to the third fluid passage 40 flows through the first branch fluid passage 41 and flows into the bottom-side chamber of the housing 76B of the opening changing unit 76. In this way, the pilot pressure of the pilot fluid that is to flow into the opening changing unit 76 is set by the throttle 101. Therefore, the opening changing unit 76 causes the rod 76C to extend or contract using the pilot pressure applied from the first branch fluid passage 41 to set the opening of the flow rate compensation valve 72. Incidentally, reference numerals 76A, 76B, and 76C are not illustrated in FIG. 7B, but are to be considered as corresponding to reference numerals 76A, 76B, and 76C in FIG. 1B, respectively.

When the solenoid switching valve 106 is switched to the second position 106*b*, the pilot fluid delivered from the first hydraulic pump P1 to the third fluid passage 40 flows through the third branch fluid passage 41C and flows into the opening changing unit 103 via the solenoid switching valve 106 and the throttle 110. In this way, the pilot pressure of the pilot fluid that is to flow into the opening changing unit 103 is set by the throttle 101. Therefore, the opening changing unit 103 causes the rod 103C to extend or contract using the pilot pressure applied from the third branch fluid passage 41C to change the opening of the flow rate compensation valve 72 so that the opening increases.

The opening of the flow rate compensation valve 72 can be changed using the hydraulic control unit 75A or 75B described above. The flow rate and pressure of the hydraulic fluid to be supplied from the flow rate compensation valve 72 to the swash-plate variable unit 73 are changed in response to the change in the opening of the flow rate compensation valve 72, and the angle of the swash plate of the second hydraulic pump P2 is changed by the swash-plate variable unit 73 such that the delivery amount of the hydraulic fluid from the second hydraulic pump P2 can also be changed. As a result, it is possible to change the operating speed of the hydraulic actuators (such as the cylinders 14 or 15). In addition, it is possible to improve the accuracy of horsepower control of the working system of the working machine 1 by changing the LS differential pressure, which is the differential pressure between the PPS signal pressure and the PLS signal pressure.

In another example, in the hydraulic control unit 75A or 75B illustrated in FIG. 7A or 7B, the solenoid valve 81 illustrated in FIG. 1B or the like may be connected to the first branch fluid passage 41, and the controller 25 may adjust the opening of the solenoid valve 81 to control the activation of the opening changing unit 76.

Figure 7C:
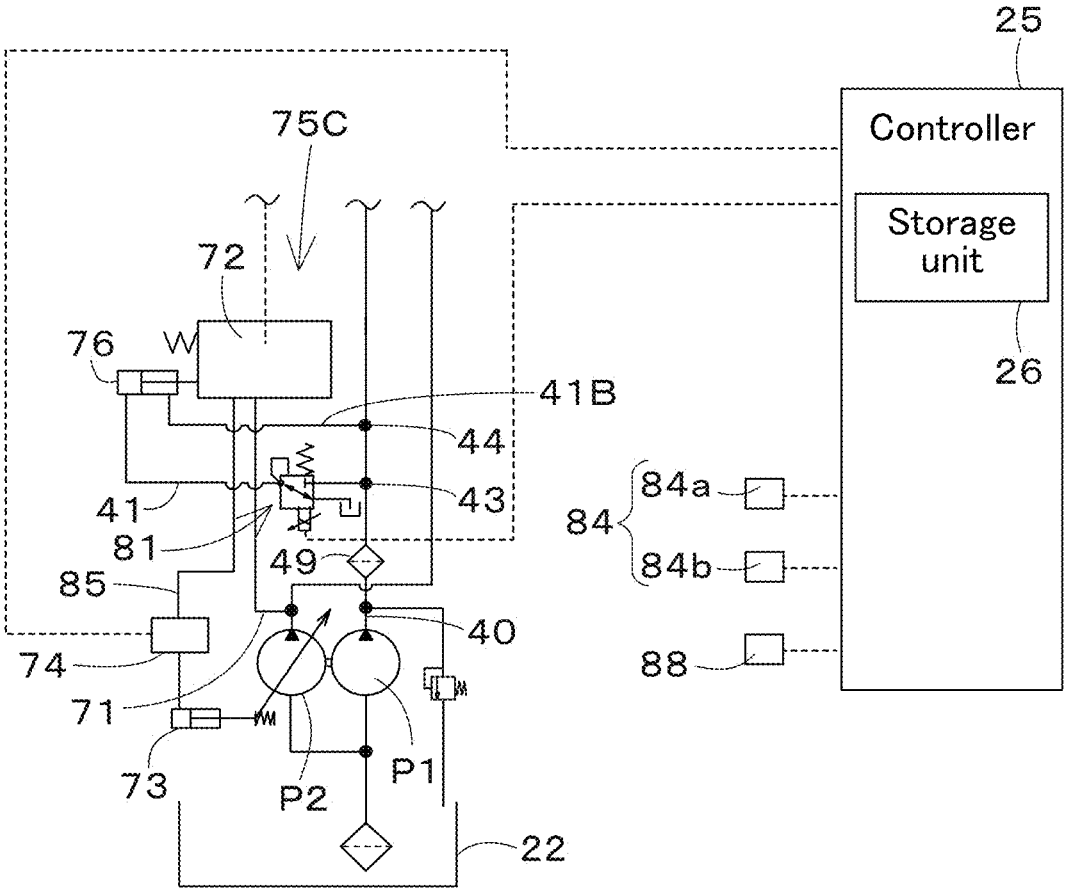
FIG. 7C is a diagram illustrating a third modification of the hydraulic control unit.

FIG. 7C is a diagram illustrating a third modification of the hydraulic control unit 75. In a hydraulic control unit 75C illustrated in FIG. 7C, the solenoid valve 81 is disposed in the first branch fluid passage 41. The second branch fluid passage 41B is connected to the second connection point (branch point) 44 of the third fluid passage 40. A fifth fluid passage 85 to supply the hydraulic fluid from the flow rate compensation valve 72 to the swash-plate variable unit 73 is provided with a solenoid valve 74. The controller 25 inputs a control signal (current signal) to the solenoid valve 81 or the solenoid valve 74 to change the opening of the solenoid valve 81 or 74, thereby changing the flow rate and pressure of the hydraulic fluid to be supplied from the flow rate compensation valve 72 to the swash-plate variable unit 73 to change the angle of the swash plate of the second hydraulic pump P2. In response to the change in the angle of the swash plate of the second hydraulic pump P2, the delivery amount of the hydraulic fluid from the second hydraulic pump P2 is changed, and the LS differential pressure, which is the differential pressure between the PPS signal pressure and the PLS signal pressure, is also changed. That is, the controller 25 changes the opening of the solenoid valve 81 or 74 to change the LS differential pressure.

Figure 8A:
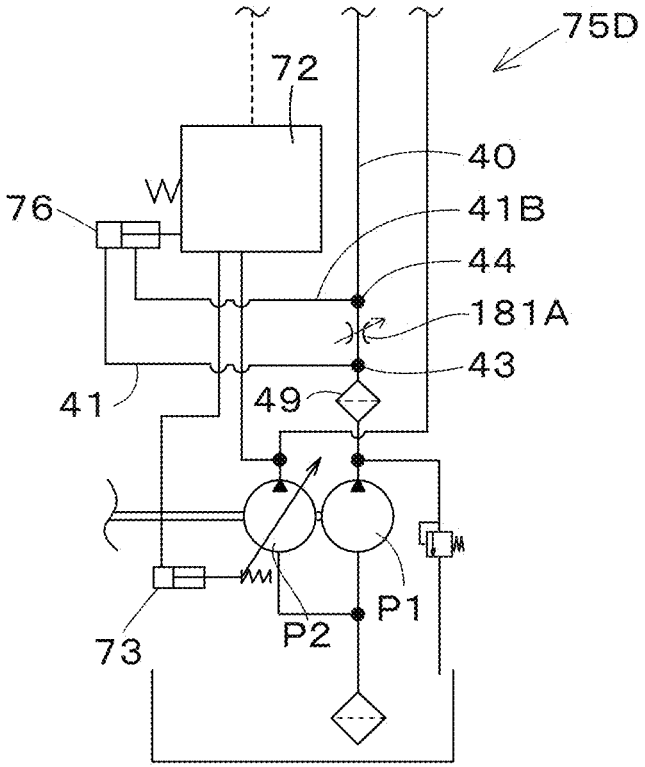
FIG. 8A is a diagram illustrating a fourth modification of the hydraulic control unit.

FIG. 8A is a diagram illustrating a fourth modification of the hydraulic control unit 75. A hydraulic control unit 75D illustrated in FIG. 8A includes a solenoid valve 181A, which is a variable throttle valve whose throttle area is electrically changeable. The solenoid valve 181A is located between the first connection point 43 and the second connection point 44 of the third fluid passage 40. The solenoid valve 181A increases or decreases the flow rate of the pilot fluid flowing through the third fluid passage 40. The controller 25 electrically changes the opening of the solenoid valve 181A to generate a pilot differential pressure (PA−Po) between the pilot pressure (the second pressure PA) acting on the bottom-side chamber of the housing 76B of the opening changing unit 76 from the first branch fluid passage 41 and the pilot pressure (a third pressure Po) acting on the second branch fluid passage 41B and the rod-side chamber of the housing 76B of the opening changing unit 76 incorporating the rod 76C, and the pilot differential pressure changes. In response to the change of the pilot differential pressure described above, the piston 76A of the opening changing unit 76 moves to extend or contract the rod 76C, and the opening of the flow rate compensation valve 72 is set or changed. More specifically, as the controller 25 decreases the opening of the solenoid valve 181A, the pilot differential pressure increases, and the opening changing unit 76 increases the opening of the flow rate compensation valve 72. Incidentally, reference numerals 76A, 76B, and 76C are not illustrated in FIG. 8A, but are to be considered as corresponding to reference numerals 76A, 76B, and 76C in FIG. 1B, respectively.

Figure 8B:
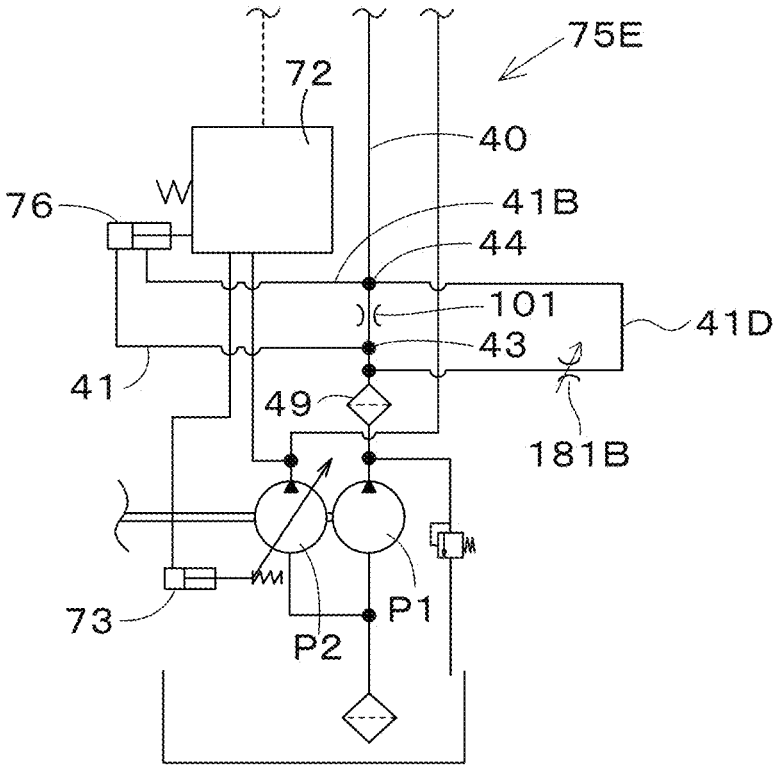
FIG. 8B is a diagram illustrating a fifth modification of the hydraulic control unit.

FIG. 8B is a diagram illustrating a fifth modification of the hydraulic control unit 75. A hydraulic control unit 75E illustrated in FIG. 8B includes a solenoid valve 181B, which is a variable throttle valve whose throttle area is electrically changeable. The third fluid passage 40 is branched into fourth fluid passages including the first branch fluid passage 41, the second branch fluid passage 41B, and a bypass fluid passage 41D. The solenoid valve 181B is connected to the bypass fluid passage 41D. The bypass fluid passage 41D has a first end connected between the throttle 101 and the first hydraulic pump P1 in the third fluid passage 40. The bypass fluid passage 41D has a second end connected to the second connection point 44 of the third fluid passage 40. The solenoid valve 181B increases or decreases the flow rate of the pilot fluid flowing through the bypass fluid passage 41D.

The controller 25 electrically changes the opening of the solenoid valve 181B. Accordingly, a pilot differential pressure (Pi−Po) is generated between the first pressure Pi, which is the pressure of the pilot fluid delivered from the first hydraulic pump P1, and the pilot pressure (the third pressure Po) acting on the second branch fluid passage 41B and a portion of the bypass fluid passage 41D, which is located downstream of the solenoid valve 181B and the throttle 101 and is away from first hydraulic pump P1, and the pilot differential pressure changes.

In response to the change of the pilot differential pressure described above, a pilot differential pressure (PA−Po) is generated between the pilot pressure (the second pressure PA) acting on the bottom-side chamber of the housing 76B of the opening changing unit 76 from the first branch fluid passage 41 and the pilot pressure (the third pressure Po) acting on the second branch fluid passage 41B and the rod-side chamber of the housing 76B of the opening changing unit 76 incorporating the rod 76C, and the pilot differential pressure changes. Accordingly, the piston 76A of the opening changing unit 76 moves to extend or contract the rod 76C, and the opening of the flow rate compensation valve 72 is set or changed. Incidentally, reference numerals 76A, 76B, and 76C are not illustrated in FIG. 8B, but are to be considered as corresponding to reference numerals 76A, 76B, and 76C in FIG. 1B, respectively.

More specifically, as the controller 25 decreases the opening of the solenoid valve 181B, the pilot differential pressure (Pi−Po) between the first pressure Pi and the third pressure Po described above increases, the pilot differential pressure (PA−Po) between the second pressure PA and the third pressure Po also increases, and the opening changing unit 76 increases the opening of the flow rate compensation valve 72.

The controller 25 can change the LS differential pressure by controlling the opening of the solenoid valve 181A or 181B described above in accordance with the rotational speed of the engine 32 or the like.

Figure 9A:
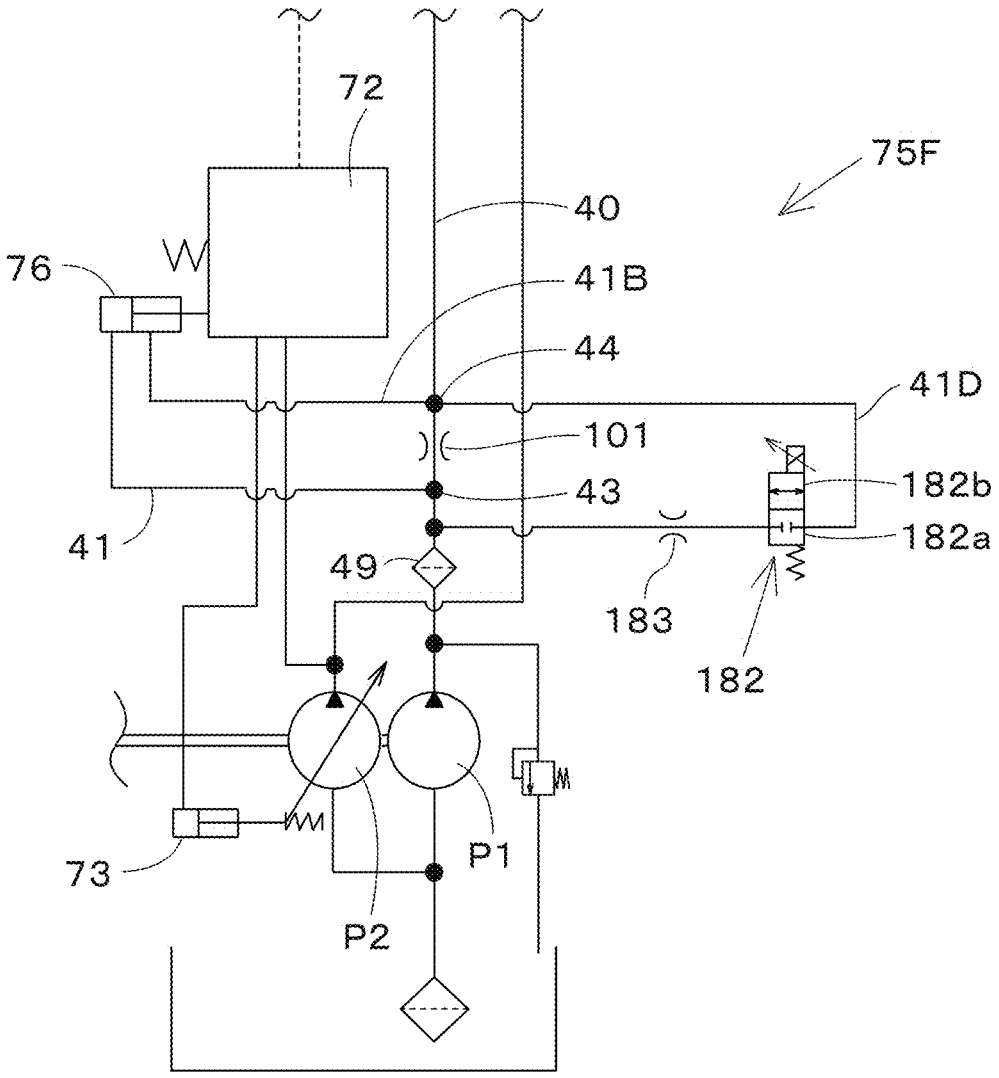
FIG. 9A is a diagram illustrating a sixth modification of the hydraulic control unit.

FIG. 9A is a diagram illustrating a sixth modification of the hydraulic control unit 75. In a hydraulic control unit 75F illustrated in FIG. 9A, the bypass fluid passage 41D is provided with a solenoid valve 182, which is a solenoid switching valve, and a throttle 183, in place of the solenoid valve 181B illustrated in FIG. 8B. The throttle 183 decreases the flow rate of the pilot fluid flowing through the bypass fluid passage 41D. In the illustrated example, the throttle 183 is located upstream of the solenoid valve 182 (i.e., closer to the first hydraulic pump P1 than the solenoid valve 182). However, the throttle 183 may be located downstream of the solenoid valve 182.

The solenoid valve 182 is electrically switchable by the controller 25 between a first position 182*a* and a second position 182*b*. For example, when no control signal is input from the controller 25 to the solenoid valve 182, the solenoid valve 182 is in the first position 182*a* due to the elastic force of a spring. At this time, all of the pilot fluid delivered from the first hydraulic pump P1 to the third fluid passage 40 passes through the throttle 101, and the flow rate of the pilot fluid flowing through the third fluid passage 40 is throttled by the throttle 101. Accordingly, the pilot differential pressure (Pi−Po) is generated between the pilot pressure (the first pressure Pi) of the pilot fluid flowing through the first branch fluid passage 41 located upstream of the throttle 101 and the pilot pressure (the third pressure Po) of the pilot fluid flowing through the second branch fluid passage 41B located downstream of the throttle 101, and the pilot differential pressure increases.

When the controller 25 inputs a control signal to the solenoid valve 182, the solenoid valve 182 is switched to the second position 182*b*. At this time, part of the pilot fluid delivered from the first hydraulic pump P1 to the third fluid passage 40 passes through the throttle 101, and the flow rate of the part of the pilot fluid is throttled by the throttle 101. The other part of the pilot fluid delivered from the first hydraulic pump P1 to the third fluid passage 40 flows through the bypass fluid passage 41D and passes through the throttle 183 and the solenoid valve 182, and the flow rate of the other part of the pilot fluid is throttled by the throttle 183. Accordingly, the pilot differential pressure (Pi−Po) is generated between the pilot pressure (the first pressure Pi) of the pilot fluid flowing through the first branch fluid passage 41 and the pilot pressure (the third pressure Po) of the pilot fluid flowing through the second branch fluid passage 41B, and the pilot differential pressure decreases.

In response to the change of the pilot differential pressure described above, a pilot differential pressure (PA−Po) is also generated between the pilot pressure (the second pressure PA) acting on the bottom-side chamber of the housing 76B of the opening changing unit 76 from the first branch fluid passage 41 and the pilot pressure (the third pressure Po) acting on the second branch fluid passage 41B and the rod-side chamber of the housing 76B of the opening changing unit 76 incorporating the rod 76C, and the pilot differential pressure (PA−Po) changes in a manner similar to that of the pilot differential pressure (Pi−Po). Accordingly, the piston 76A of the opening changing unit 76 moves to extend or contract the rod 76C, and the opening of the flow rate compensation valve 72 is set or changed. Further, the swash-plate variable unit 73 is activated in accordance with the opening of the flow rate compensation valve 72, the angle of the swash plate of the second hydraulic pump P2 is changed, and the output of the second hydraulic pump P2 and the LS differential pressure are changed. Incidentally, the reference numerals 76A, 76B and 76C are not illustrated in FIG. 9A, but are to be considered as corresponding to reference numerals 76A, 76B, and 76C in FIG. 1B, respectively.

Figure 9B:
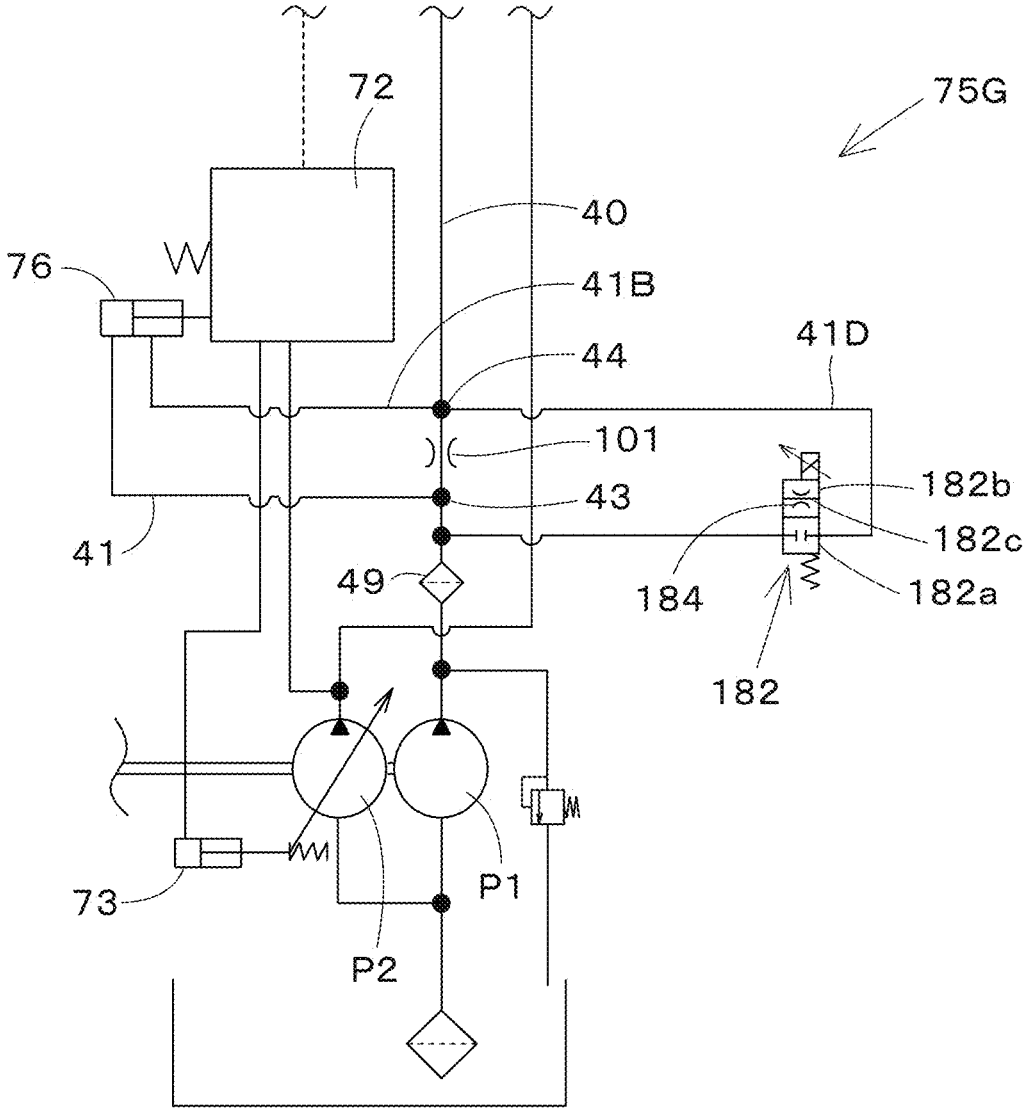
FIG. 9B is a diagram illustrating a seventh modification of the hydraulic control unit.

FIG. 9B is a diagram illustrating a seventh modification of the hydraulic control unit 75. In a hydraulic control unit 75G illustrated in FIG. 9B, instead of the throttle 183 illustrated in FIG. 9A, a throttle 184 is disposed in an internal fluid passage 182*c* located at the second position 182*b* of the solenoid valve 182. The throttle 184 decreases the flow rate of the pilot fluid flowing through the internal fluid passage 182*c*.

As described above, even when the internal fluid passage 182*c* of the solenoid valve 182 is provided with the throttle 184, the controller 25 switches the solenoid valve 182 to the first position 182*a* or the second position 182*b*, thereby allowing the throttle 101 or 184 to throttle the flow rate of the pilot fluid flowing through the third fluid passage 40 or the fluid passages 41D and 182*c*. As a result, the pilot differential pressure acting on the opening changing unit 76 is changed, the opening changing unit 76 is activated in response to the change of the pilot differential pressure described above, and the opening of the flow rate compensation valve 72 is set or changed. Further, the swash-plate variable unit 73 is activated in accordance with the opening of the flow rate compensation valve 72, the angle of the swash plate of the second hydraulic pump P2 is changed, and the output of the second hydraulic pump P2 and the LS differential pressure are changed.

The controller 25 can change the LS differential pressure by controlling the position of the solenoid valve 182 described above in accordance with the rotational speed of the engine 32 or the like.

Figure 9C:
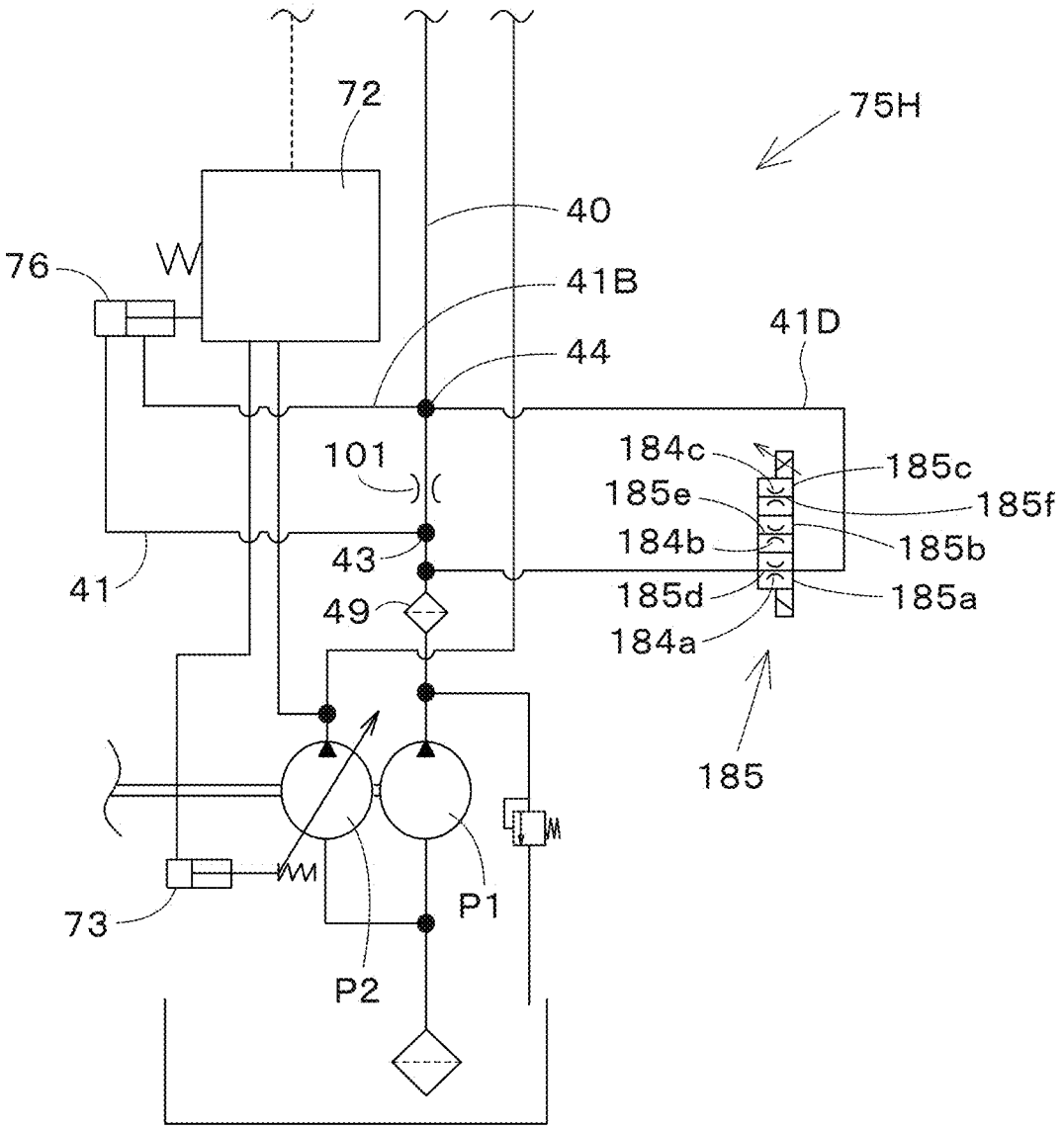
FIG. 9C is a diagram illustrating an eighth modification of the hydraulic control unit.

FIG. 9C is a diagram illustrating an eighth modification of the hydraulic control unit 75. A hydraulic control unit 75H illustrated in FIG. 9C is provided with a solenoid valve 185 in place of the solenoid valve 182 illustrated in FIGS. 9A and 9B. The solenoid valve 185 is a solenoid proportional valve that is switchable among three positions.

The solenoid valve 185 is electrically switchable by the controller 25 among a first position 185*a*, a second position

185*b*, and a third position 185*c*. Throttles 184*a*, 184*b*, and 184*c* are disposed in internal fluid passages 185*d*, 185*e*, and 185*f* at the positions 185*a*, 185*c*, and 185*c*, respectively. The throttles 184*a*, 184*b*, and 184*c* decrease the flow rates of the pilot fluid flowing through the internal fluid passages 185*d*, 185*e*, and 185*f*, respectively. The throttle 184*a* has a smaller opening area than the throttle 184*b*. The throttle 184*c* has a larger opening area than the throttle 184*b*.

In response to the controller 25 switching the solenoid valve 185 to one of the first position 185*a*, the second position 185*b*, and the third position 185*c*, the flow rates of the pilot fluid flowing through the fluid passages 40 and 41D and the corresponding one of the fluid passages 185*d*, 185*e*, and 185*f* are throttled by the throttle 101 and the corresponding one of the throttles 184*a*, 184*b*, and 184*c* located at the respective positions. Accordingly, a pilot differential pressure is generated between the pilot pressure (the first pressure Pi) of the pilot fluid flowing through portions of the fluid passages 40 and 41D located upstream of the throttles 101, 184*a*, 184*b*, and 184*c* and the pilot pressure (the third pressure Po) of the pilot fluid flowing through the second branch fluid passage 41B, and the pilot differential pressure changes.

In addition, a pilot differential pressure is also generated between the pilot pressure (the second pressure PA) acting from the first branch fluid passage 41 into the housing 76B (not illustrated in FIG. 9C but see FIG. 1B) of the opening changing unit 76 and the pilot pressure (the third pressure Po) acting on the second branch fluid passage 41B and the housing 76B of the opening changing unit 76, and the pilot differential pressure changes. In accordance with the pilot differential pressure, the opening changing unit 76 is activated, and the opening of the flow rate compensation valve 72 is set or changed.

Figure 9D:
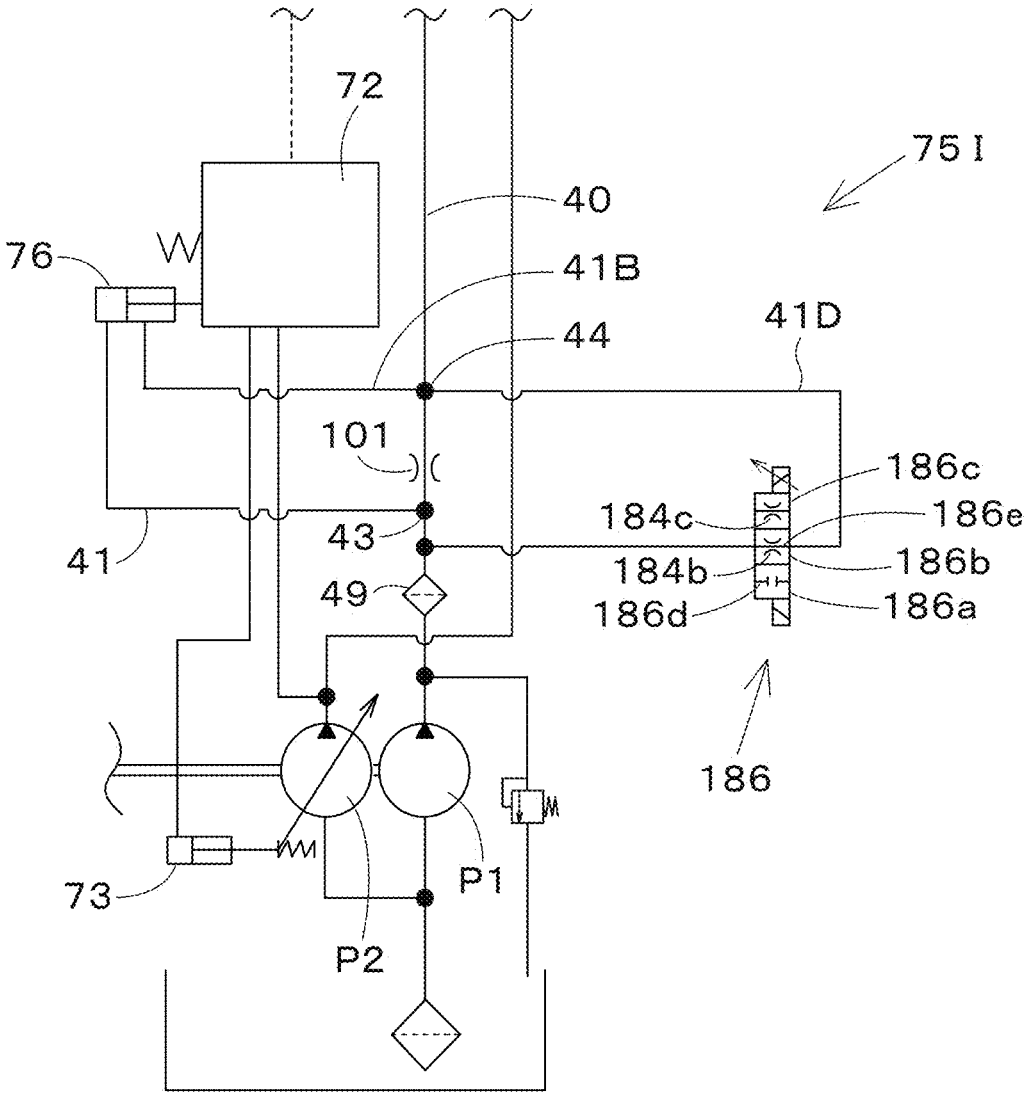
FIG. 9D is a diagram illustrating a ninth modification of the hydraulic control unit.

FIG. 9D is a diagram illustrating a ninth modification of the hydraulic control unit 75. A hydraulic control unit 751 illustrated in FIG. 9D is provided with a solenoid valve 186 in place of the solenoid valve 185 illustrated in FIG. 9C. The solenoid valve 186 is a solenoid proportional valve that is switchable among three positions.

The solenoid valve 186 is electrically switchable by the controller 25 among a first position 186*a*, a second position 186*b*, and a third position 186*c*. Throttles 184*b* and 184*c* are disposed in internal fluid passages 186*e* and 186*f* at the second position 186*b* and the third position 186*c*, respectively. The throttles 184*b* and 184*c* decrease the flow rates of the pilot fluid flowing through the internal fluid passages 186*e* and 186*f*, respectively. The throttle 184*c* has a larger opening area than the throttle 184*b*.

For example, when no control signal is input from the controller 25 to the solenoid valve 186, the solenoid valve 186 is in the first position 186*a* due to the elastic force of a spring, and the pilot fluid flowing into the bypass fluid passage 41D is not allowed to pass through the solenoid valve 186. When the controller 25 inputs a control signal to the solenoid valve 186, the solenoid valve 186 is switched to the second position 186*b* or the third position 186*c*, and the pilot fluid flowing into the bypass fluid passage 41D is allowed to pass through the second position 186*b* or the third position 186*c* of the solenoid valve 186.

Accordingly, in response to the pilot fluid passing through the second position 186*b* or the third position 186*c*, the throttles 101 and 184*b* or 184*c* throttle the flow rates of the pilot fluid flowing through the fluid passages 40 and 41D to generate a pilot differential pressure between the pilot pressure (the first pressure Pi) of the pilot fluid flowing through portions of the fluid passages 40 and 41D located upstream of the throttles 101 and 184*b* or 184*c* and the pilot pressure (the third pressure Po) of the pilot fluid flowing through the second branch fluid passage 41B, and the pilot differential pressure changes.

In addition, a pilot differential pressure (Pi−Po) is also generated between the pilot pressure (the second pressure PA) acting on the housing 76B (not illustrated in FIG. 9D but see FIG. 1B) of the opening changing unit 76 from the first branch fluid passage 41 and the pilot pressure (the third pressure Po) acting on the second branch fluid passage 41B and the housing 76B of the opening changing unit 76, and the pilot differential pressure changes. In response to the change of the pilot differential pressure (Pi−Po) described above, the opening changing unit 76 is activated, and the opening of the flow rate compensation valve 72 is set or changed. The swash-plate variable unit 73 is activated in accordance with the opening of the flow rate compensation valve 72, the angle of the swash plate of the second hydraulic pump P2 is changed, and the LS differential pressure is also changed.

When any one of the hydraulic control units 75H and 751 described above is used, in response to the change command of the LS differential pressure being generated from the command member 88, the controller 25 may switch the solenoid valve 185 or 186 to the first position 185*a* or 186*a* to change the LS differential pressure so that the LS differential pressure increases.

In the modifications illustrated in FIGS. 7A, 7B, 8B, and 9A to 9D, since the delivery flow rate of the pilot fluid from the first hydraulic pump P1 changes in accordance with the actual rotational speed of the engine 32, the differential pressure between the pilot pressure acting on the upstream side of the throttle 101 and the pilot pressure acting on the downstream side of the throttle 101 also changes. Accordingly, the LS differential pressure can be hydraulically (mechanically) set without setting a control parameter of the LS differential pressure in accordance with the rotational speed of the engine 32. Further, when the load of the engine 32 is increased, the LS differential pressure, which is hydraulically set in an automatic manner, can be reduced by the solenoid valve 181B, 182, 185, or 186. That is, in response to an increase in the load of the engine 32, the solenoid valve 181B, 182, 185, or 186 is opened to divert part of the pilot fluid delivered from the first hydraulic pump P1 to reduce the flow rate of the pilot fluid flowing through the throttle 101. Accordingly, the pilot differential pressure acting on the opening changing unit 76 can be reduced relative to the delivery amount of the pilot fluid from the first the hydraulic pump P1.

When the viscosity of the hydraulic fluid changes depending on the type of the hydraulic fluid used in the working machine 1, the temperature of the hydraulic fluid, or the like, the delivery amount of the hydraulic fluid from the second hydraulic pump P2 changes, and the LS differential pressure also changes. That is, as the viscosity of the hydraulic fluid increases, the LS differential pressure increases. Accordingly, delivering the hydraulic fluid from the second hydraulic pump P2 at a predetermined flow rate involves setting the LS differential pressure in accordance with the viscosity of the hydraulic fluid. To address this, the hydraulic circuit illustrated in FIG. 1B additionally requires a sensor to detect the viscosity of the hydraulic fluid or is required to perform complicated control. In the hydraulic circuits illustrated in FIGS. 7A, 7B, 8B, and 9A to and 9D, when the hydraulic fluid is highly viscous, the pilot differential pressure of the pilot fluid between the upstream and downstream sides of the throttles 101 and 181A or the solenoid valves 102, 185, and 186 is large, and the LS differential pressure is high. Thus, the LS differential pressure can be changed in the way described above without additionally requiring a sensor to detect the viscosity or the like of the hydraulic fluid or performing complicated control in consideration of the viscosity.

In the preferred embodiment described above, the delivery amount of the hydraulic fluid from the second hydraulic pump P2 is increased by the hydraulic control units 75 and 75A to 751, which enables an improvement (increase) in the operating speed of the hydraulic actuators. Alternatively, the operating speed of the hydraulic actuators may be improved by using the operation members 58 and 84 and a control valve 56D, as illustrated in FIG. 10A.

Fourth Preferred Embodiment

Figure 10A:
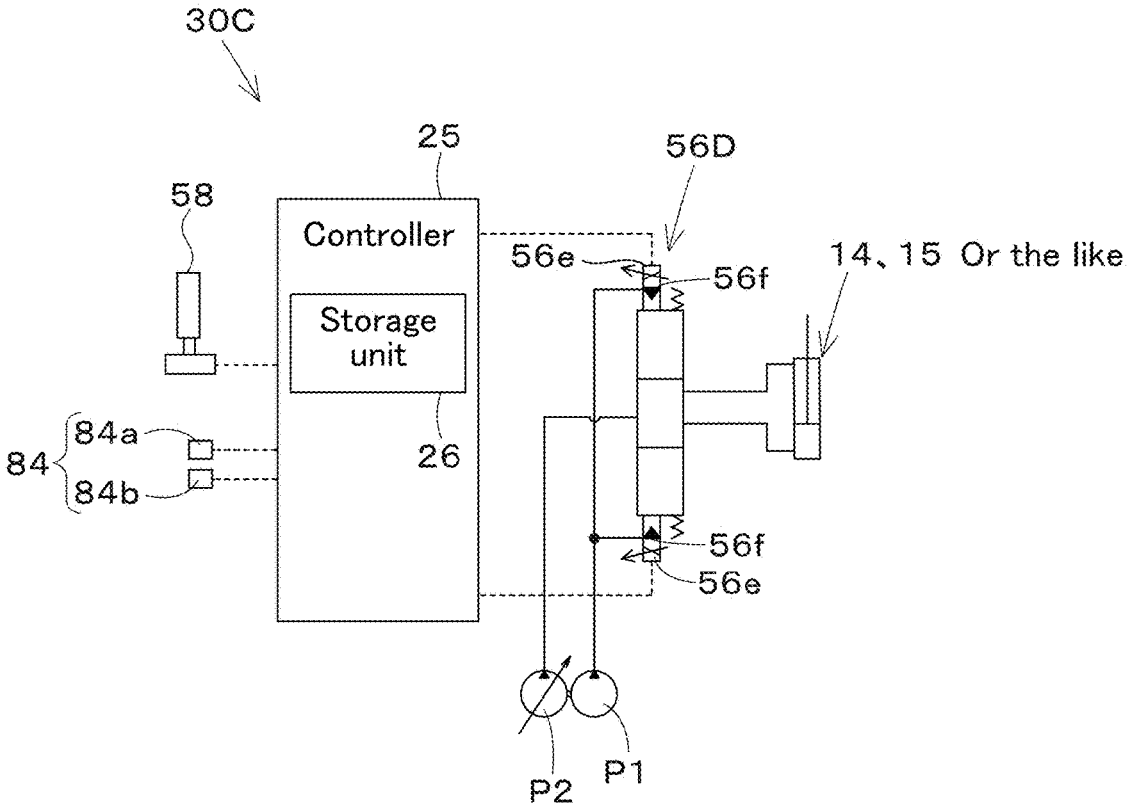
FIG. 10A is a diagram illustrating a main portion of a hydraulic system for a working system of a working machine according to a fourth preferred embodiment of the present invention.

FIG. 10A is a diagram illustrating a main part of a hydraulic system 30C for the working system of the working machine 1 according to a fourth preferred embodiment. In the hydraulic system 30C, the controller 25 is connected to the operation member 58, the accelerator member 84, and the control valve 56D. The operation member 58 is a lever or the like for operating the booms 10, the bucket 11, or the auxiliary attachment. The amount of operation of the operation member 58 is detected by, for example, a potentiometer or the like and is input to the controller 25.

The control valve 56D is a three-position switching valve and includes a pair of electrically driven solenoids 56*e* and a pair of hydraulically movable pressure receivers 56*f*. The controller 25 controls the driving of the solenoids 56*e* in accordance with the amount of operation of the operation member 58 to switch the position of the control valve 56D. The control valve 56D is connected to hydraulic actuators such as the boom cylinders 14, the bucket cylinders 15, or the hydraulic actuator mounted on the auxiliary attachment.

Figure 10B:
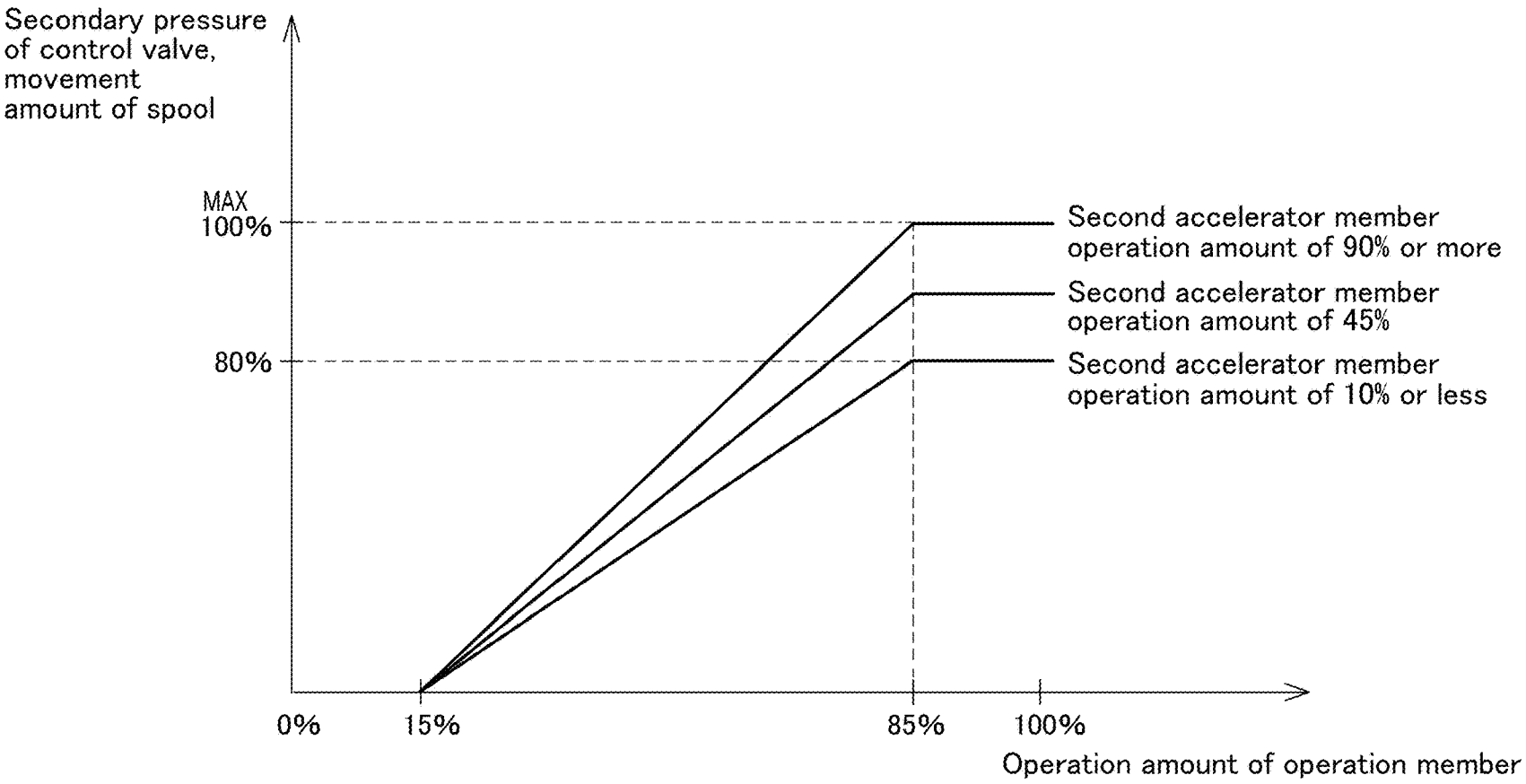
FIG. 10B is a graph illustrating a relationship among a secondary pressure of a control valve, an amount of movement of a spool of the control valve, and an amount of operation of an operation member according to the fourth preferred embodiment of the present invention.
Figure 10C:
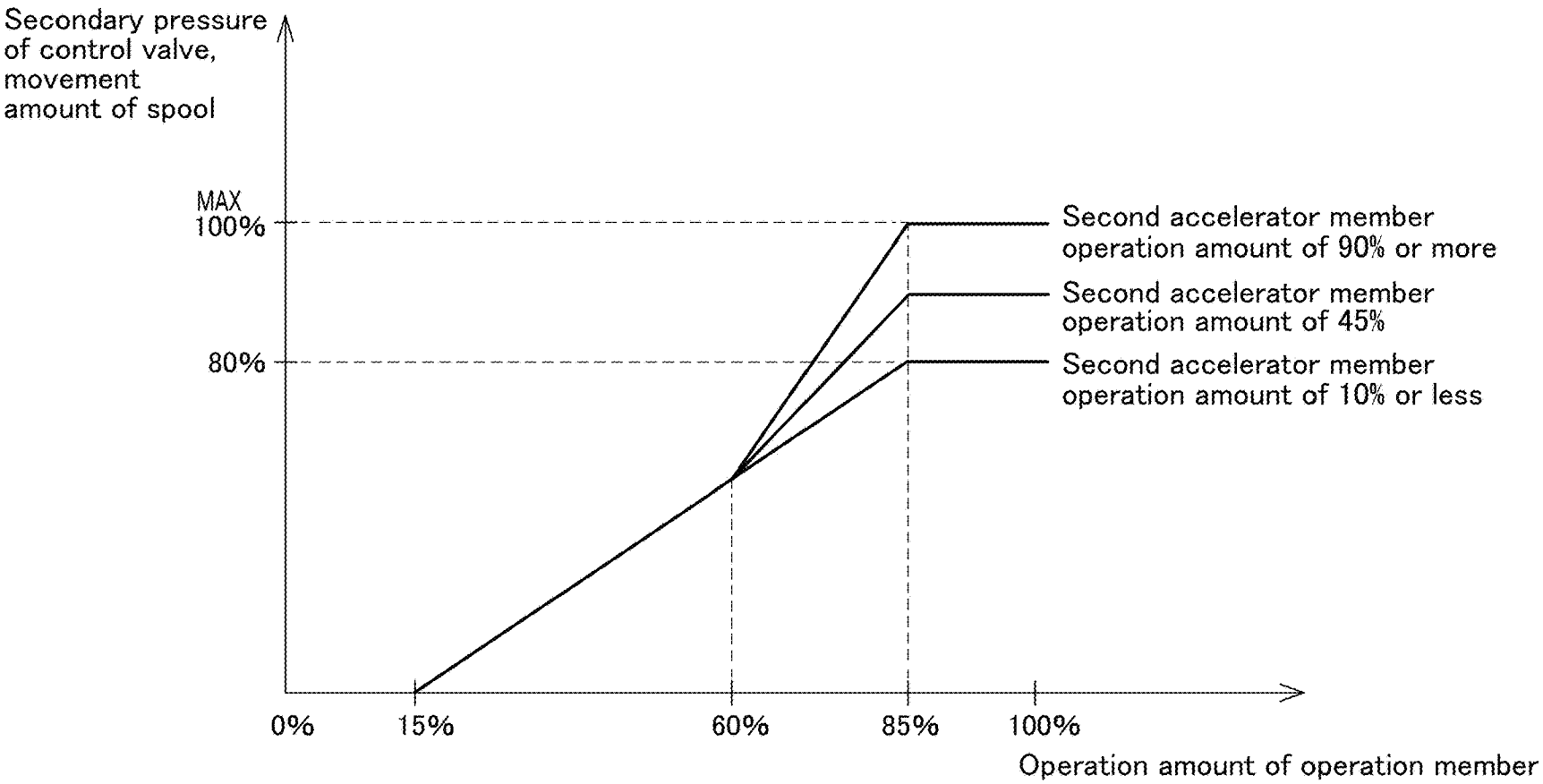
FIG. 10C is a graph illustrating another relationship among a secondary pressure of a control valve, an amount of movement of a spool of the control valve, and an amount of operation of an operation member according to the fourth preferred embodiment of the present invention.

FIG. 10B is a graph illustrating a relationship among a secondary pressure of the control valve 56D (the pressure of the hydraulic fluid discharged from the control valve 56D to the hydraulic actuators 14 or 15 or any other hydraulic actuator), the amount of movement of the spool of the control valve 56D, and the amounts of operation of the operation members 58 and 84*b*. FIG. 10C is a graph illustrating a relationship in the same manner as that illustrated in FIG. 10B. In FIG. 10B, the vertical axis represents the secondary pressure of the control valve 56D and the amount of movement of the spool of the control valve 56D, which are each denoted in percentage with the maximum being 100%.

As illustrated in FIGS. 10B and 10C, in response to an operation of the second accelerator member 84*b* with an amount of operation (depression amount) of about 10% or less, the controller 25 outputs a control signal to at least one of the solenoids 56*e* so that the amount of movement of the spool of the control valve 56D becomes about 80% even if the operation member 58 is operated to the maximum (at full stroke, or about 100%). That is, when the amount of operation of the second accelerator member 84*b* is less than a threshold, the controller 25 sets the opening area of the spool of the control valve 56D corresponding to a large amount of operation (about 85% to about 100%) near the maximum amount of operation of the operation member 58 to a value (about 80%) that is somewhat smaller than the maximum.

On the other hand, when the amount of operation of the second accelerator member 84*b* is about 90% or more, the controller 25 outputs a control signal to at least one of the solenoids 56*e* so that the amount of movement of the spool of the control valve 56D becomes the maximum (full stroke), or about 100%, at the time point when the amount of operation of the operation member 58 exceeds about 85%. That is, when the amount of operation of the second accelerator member 84*b* is greater than the threshold, the controller 25 sets the opening area of the spool of the control valve 56D corresponding to a large amount of operation (about 85% to about 100%) near the maximum amount of operation of the operation member 58 to the maximum (about 100%).

As described above, the amount of operation of the second accelerator member 84*b* is linked with the amount of operation of the operation member 58 to quickly operate the hydraulic actuators 14 or 15 or any other hydraulic actuator when the amount of operation of the second accelerator member 84*b* is large. When the amount of operation of the second accelerator member 84*b* is small, the hydraulic actuators 14 or 15 or any other hydraulic actuator can be operated at a standard speed.

In FIGS. 10B and 10C, the amount of operation of the second accelerator member 84*b* is indicated as percentage relative to the maximum amount of operation. However, the amount of operation of the second accelerator member 84*b* may be represented relative to a predetermined amount of operation other than the maximum amount of operation, such as about 80%. Alternatively, the first accelerator member 84*a* may be used instead of the second accelerator member 84*b*, and the first accelerator member 84*a*, the operation member 58, and the control valve 56D may be operated in conjunction with each other to change the operation speed of the hydraulic actuators 14 or 15 or any other hydraulic actuator.

Further, the operation valves 59 (the lowering operation valve 59A, the raising operation valve 59B, the bucket-dumping operation valve 59C, and the bucket-shoveling operation valve 59D) described above may be configured as solenoid valves, and the pilot pressures to be output from the operation valves 59 may be changed in accordance with the amount of operation of the operation member 58. In this case, upon acquiring the amount of operation of the operation member 58, the controller 25 sets the opening of the operation valves (solenoid valves) 59 on the basis of the acquired amount of operation, and outputs control signals corresponding to the set openings to the operation valves 59. Accordingly, the opening of the operation valves 59 can be set in accordance with the amount of operation of the operation member 58.

Fifth Preferred Embodiment

Figure 11:
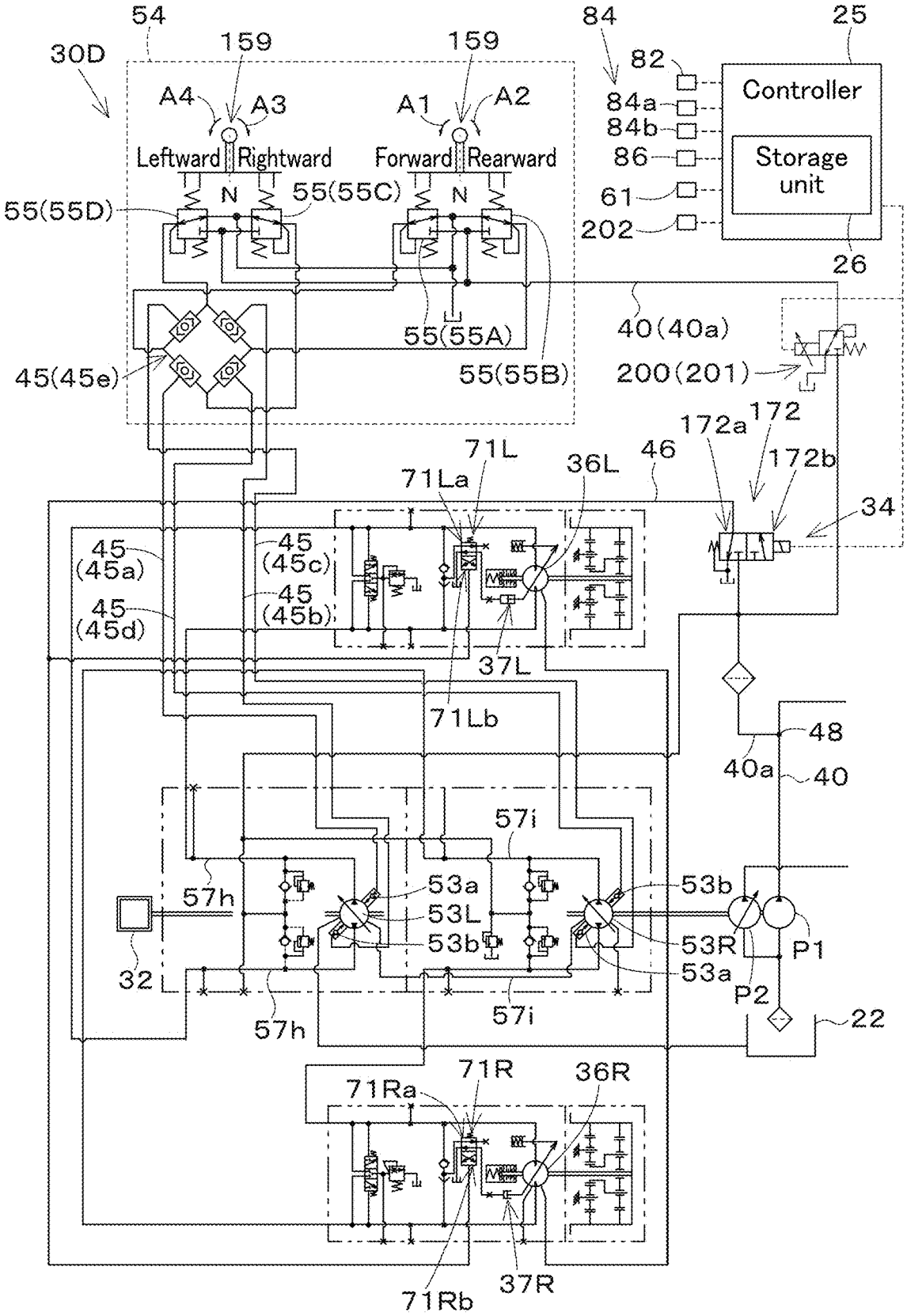
FIG. 11 is an overall view of a hydraulic system for a traveling system of a working machine according to a fifth preferred embodiment of the present invention.

FIG. 11 is a diagram illustrating a hydraulic system 30D for a traveling system of the working machine 1 according to a fifth preferred embodiment. The fifth preferred embodiment is applicable to all of the first to fourth preferred embodiments described above. That is, the hydraulic system 30D for the traveling system can be combined with any of the hydraulic systems 30A to 30C and the hydraulic control units 75 and 75A to 751 of the working system described above. The same applies to other hydraulic systems 30E to 30G for the traveling system, which will be described below. In the description of the fifth preferred embodiment, a description of a configuration similar to that of the preferred embodiments described above will be omitted.

The hydraulic system 30D illustrated in FIG. 11 is capable of driving the traveling device 5. The hydraulic system 30D includes a first traveling pump 53L, a second traveling pump 53R, a first traveling motor 36L, and a second traveling motor 36R.

The first traveling pump 53L and the second traveling pump 53R are hydraulic pumps to be driven by the power of the engine 32. Specifically, the first traveling pump 53L and the second traveling pump 53R are swash-plate variable displacement axial pumps to be driven by the power of the engine 32. The first traveling pump 53L and the second traveling pump 53R each include a pressure receiver 53*a* and a pressure receiver 53*b* on which pilot pressures act. The angle of a swash plate of each of the traveling pumps 53L and 53R is changed in accordance with the pilot pressure acting on the pressure receiver 53*a* or 53*b*. The angles of the swash plates are changed to change the outputs (delivery amounts of the hydraulic fluid) and delivery directions of the hydraulic fluid from the first traveling pump 53L and the second traveling pump 53R.

The first traveling pump 53L and the first traveling motor 36L are connected by a circulation fluid passage 57*h*, and the hydraulic fluid delivered from the first traveling pump 53L is supplied to the first traveling motor 36L. The second traveling pump 53R and the second traveling motor 36R are connected by a circulation fluid passage 57*i*, and the hydraulic fluid delivered from the second traveling pump 53R is supplied to the second traveling motor 36R.

The first traveling motor 36L is a hydraulic motor that transmits power to a drive shaft of the traveling device 5 disposed on the left side of the machine body 2. The first traveling motor 36L is rotatable by the hydraulic fluid delivered from the first traveling pump 53L, and the rotational speed (number of rotations) can be changed by the flow rate of the hydraulic fluid. The first traveling motor 36L is connected to a swash-plate switching cylinder 37L. The rotational speed (number of rotations) of the first traveling motor 36L can also be changed by extending or contracting the swash-plate switching cylinder 37L toward either side. That is, the rotational speed of the first traveling motor 36L is set to a low-speed range (first speed) in response to contraction of the swash-plate switching cylinder 37L, and the rotational speed of the first traveling motor 36L is set to a high-speed range (second speed) in response to extension of the swash-plate switching cylinder 37L. That is, the speed stage for the rotational speed of the first traveling motor 36L is switchable between the low-speed first speed stage and the high-speed second speed stage.

The second traveling motor 36R is a hydraulic motor that transmits power to a drive shaft of the traveling device 5 disposed on the right side of the machine body 2. The second traveling motor 36R is rotatable by the hydraulic fluid delivered from the second traveling pump 53R, and the rotational speed (number of rotations) can be changed by the flow rate of the hydraulic fluid. The second traveling motor 36R is connected to a swash-plate switching cylinder 37R. The rotational speed (number of rotations) of the second traveling motor 36R can also be changed by extending or contracting the swash-plate switching cylinder 37R toward either side. That is, the speed stage for the rotational speed of the second traveling motor 36R is set to a low-speed range (first speed) in response to contraction of the swash-plate switching cylinder 37R, and the rotational speed of the second traveling motor 36R is set to a high-speed range (second speed) in response to extension of the swash-plate switching cylinder 37R. That is, the rotational speed of the second traveling motor 36R is switchable between the low-speed first speed stage and the high-speed second speed stage.

The hydraulic system 30D also includes a travel switching valve 34. The travel switching valve 34 is switchable between a first state to set the rotational speeds (numbers of rotations) of the traveling motors 36L and 36R to the first speed and a second state to set the rotational speeds of the traveling motors 36L and 36R to the second speed. The travel switching valve 34 includes first switching valves 71L and 71R and a second switching valve 172.

The first switching valve 71L is connected to the swash-plate switching cylinder 37L of the first traveling motor 36L via a fluid passage, and is a two-position switching valve that is switchable between a first position 71La and a second position 71Lb. When the first switching valve 71L is in the first position 71La, the swash-plate switching cylinder 37L contracts. When the first switching valve 71L is in the second position 71Lb, the swash-plate switching cylinder 37L extends.

The first switching valve 71R is connected to the swash-plate switching cylinder 37R of the second traveling motor 36R via a fluid passage, and is a two-position switching valve that is switchable between a first position 71Ra and a second position 71Rb. When the first switching valve 71R is in the first position 71Ra, the swash-plate switching cylinder 37R contracts. When the first switching valve 71R is in the second position 71Rb, the swash-plate switching cylinder 37R extends.

The second switching valve 172 is a solenoid valve that switches the first switching valve 71L and the first switching valve 71R, and is a two-position switching valve that is switchable between a first position 172*a* and a second position 172*b* upon being energized. The second switching valve 172, the first switching valve 71L, and the first switching valve 71R are connected by a fluid passage 46. When switched to the first position 172*a*, the second switching valve 172 switches the first switching valve 71L and the first switching valve 71R to the first positions 71La and 71Ra, respectively. When switched to the second position 172*b*, the second switching valve 172 switches the first switching valve 71L and the first switching valve 71R to the second positions 71Lb and 71Rb, respectively.

When the second switching valve 172 is in the first position 172*a*, the first switching valve 71L is in the first position 71La, and the first switching valve 71R is in the first position 71Ra, the travel switching valve 34 enters the first state and sets the rotational speeds of the traveling motors 36L and 36R to the first speed. When the second switching valve 172 is in the second position 172*b*, the first switching valve 71L is in the second position 71Lb, and the first switching valve 71R is in the second position 71Rb, the travel switching valve 34 enters the second state and sets the rotational speeds of the traveling motors 36L and 36R to the second speed. That is, the travel switching valve 34 can switch the traveling motors 36L and 36R between the first speed that is a low speed and the second speed that is a high speed.

The switching of the traveling motors 36L and 36R to the first speed or the second speed can be performed by a speed-shift operation member 61. The speed-shift operation member 61 is a push switch or the like operable by the driver or the like of the working machine 1, and is connected to the controller 25. The speed-shift operation member 61 performs a predetermined operation to perform shift-up to switch a speed stage for the rotational speeds of the traveling motors 36L and 36R from the first speed (first speed stage) to the second speed (second speed stage). The speed-shift operation member 61 performs another predetermined operation to perform shift-down to switch the speed stage for the rotational speeds of the traveling motors 36L and 36R from the second speed (second speed stage) to the first speed (first speed stage).

The controller 25 switches the state of the travel switching valve 34 in accordance with the operating state of the speed-shift operation member 61. For example, in response to the speed-shift operation member 61 performing a predetermined operation after the speed stage for the rotational speeds of the traveling motors 36L and 36R are set to the first speed, a second speed command (a command to set the travel switching valve 34 to the second state) indicating a command to increase the rotational speeds of the traveling motors 36L and 36R to the second speed is output from an electric circuit that operates in conjunction with the speed-shift operation member 61 to the controller 25. In response to the speed-shift operation member 61 performing a predetermined operation after the speed stage for the rotational speeds of the traveling motors 36L and 36R are set to the second speed, a first speed command (a command to set the travel switching valve 34 to the first state) indicating a command to decrease the rotational speeds of the traveling motors 36L and 36R to the first speed is output from the electric circuit that operates in conjunction with the speed-shift operation member 61 to the controller 25.

The speed-shift operation member 61 may be an operation switch capable of holding an on state and an off state. When the speed-shift operation member 61 is in the off state, a command to maintain the rotational speeds of the traveling motors 36L and 36R at the first speed is output to the controller 25. When the speed-shift operation member 61 is in the on state, a command to maintain the rotational speeds of the traveling motors 36L and 36R at the second speed is output to the controller 25.

Upon acquiring the command (first speed command) to set the travel switching valve 34 to the first state, the controller 25 deenergizes the solenoid of the second switching valve 172 to switch the travel switching valve 34 to the first state. Upon acquiring the command (second speed command) to set the travel switching valve 34 to the second state, the controller 25 energizes the solenoid of the second switching valve 172 to switch the travel switching valve 34 to the second state.

The hydraulic system 30D includes a first hydraulic pump P1, a second hydraulic pump P2, and a travel operation device (hereinafter simply referred to as "operation device") 54. The first hydraulic pump P1 and the second hydraulic pump P2 are the same as the first hydraulic pump P1 and the second hydraulic pump P2 according to the preferred embodiments described above, respectively. The hydraulic system 30D for the traveling system is connected to a fluid passage 40*a* (FIG. 11, etc.), which is branched at a branch point 48 (FIG. 11, FIG. 1A, etc.) from the third fluid passage 40 to which the first hydraulic pump P1 delivers the pilot fluid. The same applies to other hydraulic systems 30E to 30G for the traveling system described below.

The operation device 54 is a device to operate the first traveling pump 53L and the second traveling pump 53R and is capable of changing the angles of the swash plates (swash-plate angles) of the traveling pumps 53L and 53R. The operation device 54 includes a travel operation member (first operation member, hereinafter simply referred to as "operation member") 159, which is an operation lever or the like, and a plurality of operation valves 55.

The operation member 159 is supported by the operation valves 55 and is swingable (tiltable) in the left-right direction (machine-body width direction of the working machine 1) or the front-rear direction. That is, the operation member 159 is swingable to the right and left from a neutral position N as a reference and is swingable to the front and rear from the neutral position N. In other words, the operation member 159 is swingable in at least four directions relative to the neutral position N. For convenience of description, both the forward and rearward directions, that is, the front-rear direction, are referred to as a first direction. Both the rightward and leftward directions, that is, the left-right direction, may be referred to as a second direction.

The plurality of operation valves 55 are operated by the common, or single, operation member 159. The plurality of operation valves 55 are activated in response to swinging of the operation member 159. The plurality of operation valves 55 are connected to the third fluid passage 40 and can be supplied with the hydraulic fluid (pilot fluid) from the first hydraulic pump P1 via the third fluid passage 40. The plurality of operation valves 55 include an operation valve 55A, an operation valve 55B, an operation valve 55C, and an operation valve 55D.

When the operation member 159 is swung to the front (one direction) in the front-rear direction (first direction), that is, when the operation member 159 is operated forward, the operation valve 55A changes the pressure of the hydraulic fluid to be output in accordance with the forward operation amount (forward operation) of the operation member 159. When the operation member 159 is swung to the rear (the other direction) in the front-rear direction (first direction), that is, when the operation member 159 is operated rearward, the operation valve 55B changes the pressure of the hydraulic fluid to be output in accordance with the rearward operation amount (rearward operation) of the operation member 159. When the operation member 159 is swung to the right (one direction) in the left-right direction (second direction), that is, when the operation member 159 is operated to the right, the operation valve 55C changes the pressure of the hydraulic fluid to be output in accordance with the right operation amount (right operation) of the operation member 159. When the operation member 159 is swung to the left (the other direction) in the left-right direction (second direction), that is, when the operation member 159 is operated to the left, the operation valve 55D changes the pressure of the hydraulic fluid to be output in accordance with the left operation amount (left operation) of the operation member 159.

The plurality of operation valves 55 are connected to the traveling pumps 53L and 53R by travel fluid passages 45. In other words, the traveling pumps 53L and 53R are hydraulic devices that can be activated by the hydraulic fluid output from the operation valves 55 (the operation valve 55A, the operation valve 55B, the operation valve 55C, and the operation valve 55D).

The travel fluid passages 45 include a first travel fluid passage 45*a*, a second travel fluid passage 45*b*, a third travel fluid passage 45*c*, a fourth travel fluid passage 45*d*, and a fifth travel fluid passage 45*e*. The first travel fluid passage 45*a* is a fluid passage connected to the pressure receiver 53*a* of the first traveling pump 53L. The second travel fluid passage 45*b* is a fluid passage connected to the pressure receiver 53*b* of the first traveling pump 53L. The third travel fluid passage 45*c* is a fluid passage connected to the pressure receiver 53*a* of the second traveling pump 53R. The fourth travel fluid passage 45*d* is a fluid passage connected to the pressure receiver 53*b* of the second traveling pump 53R. The fifth travel fluid passage 45*e* is a fluid passage that connects the operation valves 55, the first travel fluid passage 45*a*, the second travel fluid passage 45*b*, the third travel fluid passage 45*c*, and the fourth travel fluid passage 45*d*.

When the operation member 159 is swung to the front (in a direction indicated by an arrow A1 in FIG. 11), the operation valve 55A is operated, and a pilot pressure is output from the operation valve 55A. The pilot pressure acts on the pressure receiver 53*a* of the first traveling pump 53L through the first travel fluid passage 45*a* and also acts on the pressure receiver 53*a* of the second traveling pump 53R through the third travel fluid passage 45*c*. Accordingly, the angles of the swash plates of the first traveling pump 53L and the second traveling pump 53R are changed, and the first traveling motor 36L and the second traveling motor 36R are rotated forward (forward rotation). As a result, the working machine 1 moves straight forward.

When the operation member 159 is swung to the rear (in a direction indicated by an arrow A2 in FIG. 11), the operation valve 55B is operated, and a pilot pressure is output from the operation valve 55B. The pilot pressure acts on the pressure receiver 53*b* of the first traveling pump 53L through the second travel fluid passage 45*b* and also acts on the pressure receiver 53*b* of the second traveling pump 53R through the fourth travel fluid passage 45*d*. Accordingly, the angles of the swash plates of the first traveling pump 53L and the second traveling pump 53R are changed, and the first traveling motor 36L and the second traveling motor 36R are rotated in reverse (rear rotation). As a result, the working machine 1 moves straight rearward.

When the operation member 159 is swung to the right (in a direction indicated by an arrow A3 in FIG. 11), the operation valve 55C is operated, and a pilot pressure is output from the operation valve 55C. The pilot pressure acts on the pressure receiver 53*a* of the first traveling pump 53L through the first travel fluid passage 45*a* and also acts on the pressure receiver 53*b* of the second traveling pump 53R through the fourth travel fluid passage 45*d*. Accordingly, the angles of the swash plates of the first traveling pump 53L and the second traveling pump 53R are changed, and the first traveling motor 36L is rotated forward while the second traveling motor 36R is rotated in reverse. As a result, the working machine 1 turns to the right.

When the operation member 159 is swung to the left (in a direction indicated by an arrow A4 in FIG. 11), the operation valve 55D is operated, and a pilot pressure is output from the operation valve 55D. The pilot pressure acts on the pressure receiver 53*a* of the second traveling pump 53R through the third travel fluid passage 45*c* and also acts on the pressure receiver 53*b* of the first traveling pump 53L through the second travel fluid passage 45*b*. Accordingly, the angles of the swash plates of the first traveling pump 53L and the second traveling pump 53R are changed, and the first traveling motor 36L is rotated in reverse while the second traveling motor 36R is rotated forward. As a result, the working machine 1 turns to the left.

When the operation member 159 is swung in a diagonal direction, the rotation directions and rotational speeds of the first traveling motor 36L and the second traveling motor 36R are determined by the differential pressure between the pilot pressure acting on the pressure receiver 53*a* and the pilot pressure acting on the pressure receiver 53*b*, and the working machine 1 turns to the right or left while moving straight forward or rearward.

Specifically, when the operation member 159 is swung diagonally forward to the left, the working machine 1 turns to the left while moving straight forward at a speed corresponding to the swing angle of the operation member 159. When the operation member 159 is swung diagonally forward to the right, the working machine 1 turns to the right while moving straight forward at a speed corresponding to the swing angle of the operation member 159. When the operation member 159 is swung diagonally rearward to the left, the working machine 1 turns to the left while moving straight rearward at a speed corresponding to the swing angle of the operation member 159. When the operation member 159 is swung diagonally rearward to the right, the working machine 1 turns to the right while moving straight rearward at a speed corresponding to the swing angle of the operation member 159.

The controller 25 is connected to the accelerator members 84*a* and 84*b* and the first measurement device 82. The controller 25 acquires the amounts of operation of the accelerator members 84*a* and 84*b* and acquires the actual rotational speed of the engine 32, which is measured by the first measurement device 82. Then, the controller 25 sets the target engine rotational speed on the basis of the amounts of operation of the accelerator members 84*a* and 84*b*, and controls the driving of the engine 32 while checking the actual rotational speed of the engine 32 so as to realize the target engine rotational speed.

The hydraulic system 30D includes a speed adjustment mechanism (adjustment mechanism) 200. The speed adjustment mechanism 200 changes at least the pilot pressures acting on the pressure receivers 53*a* and 53*b* of the traveling pumps 53L and 53R to adjust the angles of the swash plates of the traveling pumps 53L and 53R to set the speed (vehicle speed) of the working machine 1 to be faster than a predetermined speed (set speed).

The speed adjustment mechanism 200 includes a pressure changing unit 201. The pressure changing unit 201 includes a solenoid proportional valve (solenoid valve or operation valve) disposed in the third fluid passage 40, for example. The controller 25 inputs a control signal to the pressure changing unit 201 to change the opening of the pressure changing unit 201, thereby changing a primary pressure (the pilot pressure of the pilot fluid flowing from the third fluid passage 40 to the operation valves 55, also referred to as a traveling primary pressure) acting on the operation valves 55 from the third fluid passage 40.

Further, the controller 25 is switchable between a first mode (normal mode) to cause the working machine 1 to travel normally and a second mode (creep mode) to cause the working machine to travel at a low speed by keeping the vehicle speed of the working machine 1 low. Switching between the first mode and the second mode can be performed by operation of an operation switch 202 (second operation member) disposed near the operator's seat 8, for example.

Figure 12A:
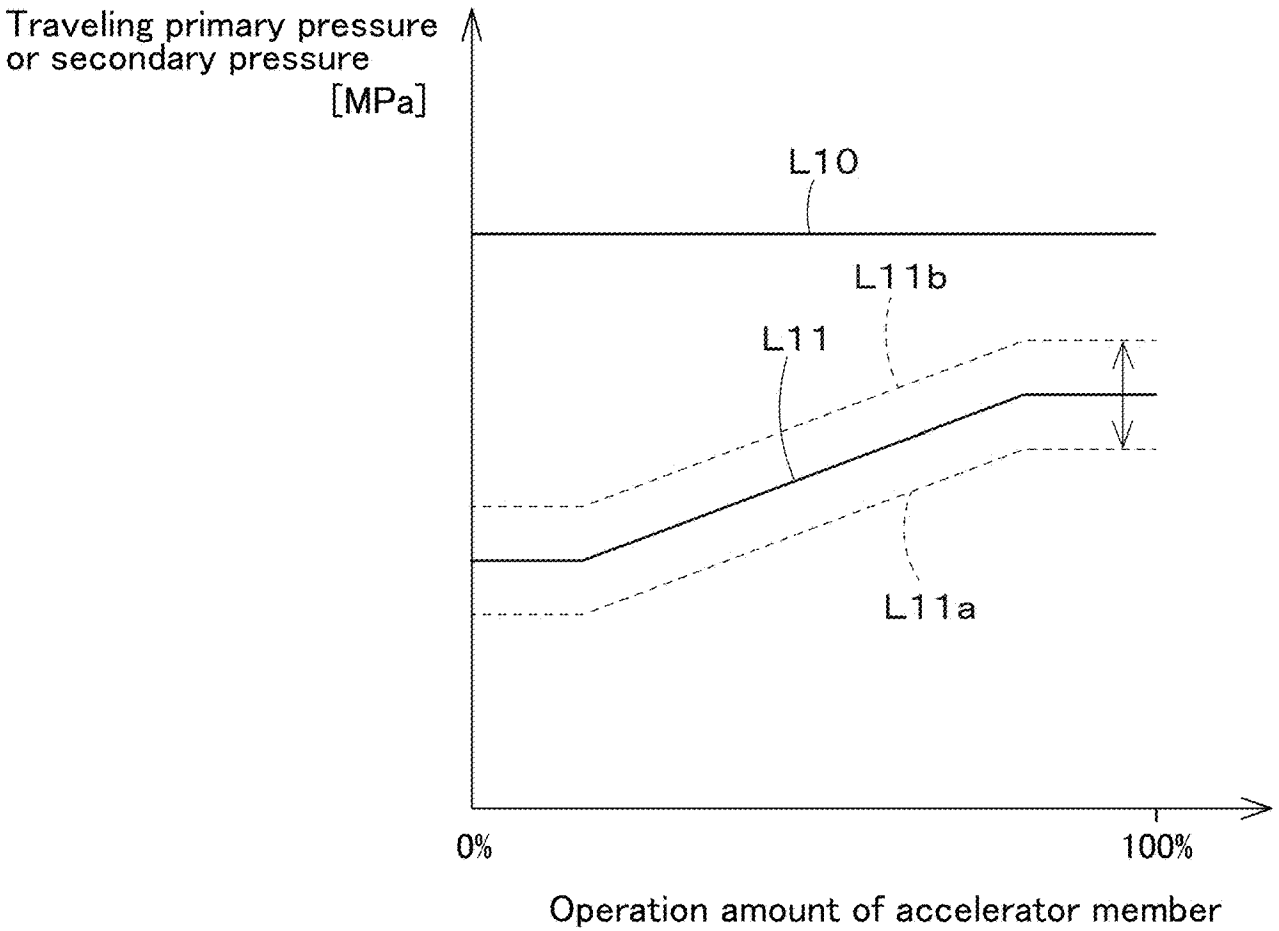
FIG. 12A is a graph illustrating a relationship between an amount of operation of an accelerator member and a traveling primary pressure (or traveling secondary pressure) according to the fifth preferred embodiment of the present invention.

FIG. 12A is a graph illustrating a relationship between an amount of operation of the accelerator member 84 and the traveling primary pressure that is the primary pressure of the operation valves 55 (or a traveling secondary pressure that is a secondary pressure of the operation valves 55). Data of a control map representing the relationship illustrated in FIG. 12A is stored in advance in the storage unit 26. The controller 25 changes the opening of the pressure changing unit 201 in accordance with the control map illustrated in FIG. 12A to change the traveling primary pressure acting on the operation valves 55.

Specifically, for example, in the first mode (normal mode), the controller 25 inputs a control signal to the pressure changing unit 201 so that, as indicated by a control line L10 in FIG. 12A, the traveling primary pressure is kept constant regardless of the amount of operation of the accelerator member 84 (the first accelerator member 84*a* or the second accelerator member 84*b*; the first operation member). In the first mode (normal mode), the rotational speed of the prime mover 32 can be set by operating the accelerator member 84. That is, in the first mode, the controller 25 sets the rotational speed of the engine 32 in accordance with the operating state of the accelerator member 84, and controls the driving of the engine 32 so that the actual rotational speed of the prime mover 32 matches the set rotational speed.

Upon being switched to the second mode (creep mode) by the operation switch 202, as illustrated by a control line L11 in FIG. 12A, the controller 25 sets the primary pressure of the operation valves 55 to a value lower than the pressure set by the control line L10. Then, the controller 25 inputs a control signal to the pressure changing unit 201 in accordance with the control line L11 so that the primary pressure of the operation valves 55 increases as the amount of operation of the accelerator member 84 (the first accelerator member 84*a* or the second accelerator member 84*b*) increases. The control line L11 illustrated in FIG. 12A is an example.

With the operation described above, in the second mode (creep mode), the opening of the pressure changing unit 201, the primary pressure acting on the operation valves 55, and the pilot pressures acting on the pressure receivers 53*a* and 53*b* of the traveling pumps 53L and 53R can be changed in accordance with the amount of operation of the accelerator member 84. In addition, the angles of the swash plates of the traveling pumps 53L and 53R, the delivery amounts of the hydraulic fluid from the traveling pumps 53L and 53R, and the rotational speeds of the traveling motors 36L and 36R can also be changed.

That is, in the second mode, the controller 25 can control the driving of the traveling pumps 53L and 53R, which deliver the hydraulic fluid to activate the traveling motors 36L and 36R serving as actuators of the traveling system of the working machine 1, in accordance with the amount of operation of the accelerator member 84, and can also control the driving of the traveling motors 36L and 36R. As a result, the accuracy of horsepower control and vehicle speed (travel speed) control of the traveling system of the working machine 1 can be improved.

In particular, in the second mode, as the amount of operation of the accelerator member 84 increases, the opening of the pressure changing unit 201 increases, and the primary pressure acting on the operation valves 55 also increases. Thus, the pilot pressures acting on the pressure receivers 53*a* and 53*b* of the traveling pumps 53L and 53R can be changed to increase. In addition, the angles of the swash plates of the traveling pumps 53L and 53R are changed to increase the delivery amounts of the hydraulic fluid from the traveling pumps 53L and 53R and increase the rotational speeds of the traveling motors 36L and 36R, whereby the vehicle speed of the working machine 1 can be increased. As described above, in the second mode, the controller 25 changes the angles of the swash plates of the traveling pumps 53L and 53R, without changing the rotational speed of the engine 32, in accordance with the operating state (amount of operation) of the accelerator member 84 to change the rotational speeds of the traveling motors 36L and 36R and the travel speed of the working machine 1 (traveling device 5).

In the second mode, the controller 25 may cause the speed adjustment mechanism 200 to change the angles of the swash plates of the traveling pumps 53L and 53R in accordance with the operating states of a speed adjustment member 86 and the accelerator member 84 (the first accelerator member 84*a* or the second accelerator member 84*b*) to adjust the rotational speeds of the traveling motors 36L and 36R and the travel speed of the traveling device 5. In this case, first, the controller 25 causes the speed adjustment mechanism 200 to change the angles of the swash plates of the traveling pumps 53L and 53R in accordance with the operating state of the speed adjustment member 86 to adjust the rotational speeds of the traveling motors 36L and 36R and the travel speed of the traveling device 5. Then, in response to an operation of the accelerator member 84, the controller 25 causes the speed adjustment mechanism 200 to change the angles of the swash plates of the traveling pumps 53L and 53R in accordance with the amount of operation of the accelerator member 84 to adjust the rotational speeds of the traveling motors 36L and 36R and the travel speed of the traveling device 5 to be faster than the rotational speeds of the traveling motors 36L and 36R and the travel speed of the traveling device 5 that are adjusted in accordance with the operating state of the speed adjustment member 86.

In the second mode, the controller 25 may shift (translate) the control line L11 (FIG. 12A) in the vertical axis direction in accordance with the operating state of the speed adjustment member 86 to change the adjustment range of the primary pressure of the operation valves 55. The speed adjustment member 86 is a volume switch or the like that temporarily adjusts (changes) the vehicle speed of the working machine 1 with an adjustment width smaller than those of the accelerator member 84 and the speed-shift operation member 61, and is operable by the driver of the working machine 1. The controller 25 detects the operating state of the speed adjustment member 86 in accordance with an electric signal input from an electric circuit (not illustrated) that operates in conjunction with the speed adjustment member 86 in accordance with the operating state of the speed adjustment member 86.

Specifically, the controller 25 is configured such that the adjustment ranges of the vehicle speed of the working machine 1 and the primary pressure (traveling primary pressure) of the operation valves 55 can be set by, for example, operating the speed adjustment member 86. Then, the controller 25 shifts the control line L11 in FIG. 12A in the vertical axis direction in accordance with the adjustment range set by the speed adjustment member 86. More specifically, in the second mode, when a first stage in which the vehicle speed is the lowest is set by the speed adjustment member 86, the controller 25 corrects the data of the control line L11 in FIG. 12A and calculates data of a control line L11*a* obtained by shifting the control line L11 downward. When an N-th stage in which the vehicle speed is the highest is set by the speed adjustment member 86, where N is an integer equal to or greater than 2, the controller 25 corrects the data of the control line L11 and calculates data of a control line L11*b* obtained by shifting the control line L11 upward.

Thereafter, the controller 25 inputs a control signal to the pressure changing unit 201 in accordance with the corrected control line L11*a* or L11*b* and the amount of operation of the accelerator member 84 (the first accelerator member 84*a* or the second accelerator member 84*b*) to change the primary pressure of the operation valves 55. When the adjustment stage of the vehicle speed is set (or changed) by the speed adjustment member 86, the controller 25 changes the rotational speed of the engine 32 in accordance with the adjustment stage.

In another example, in the second mode, when the amount of operation of the accelerator member 84 is equal to or greater than a threshold (for example, the amount of operation of the first accelerator member 84*a* or the second accelerator member 84*b* is equal to or greater than about 80%), in response to the speed adjustment member 86 changing the adjustment stage of the vehicle speed, the controller 25 may correct the data of the control line L11 in the manner described above in accordance with the changed adjustment stage, and calculate data of the corrected control line. In this case, the controller 25 inputs a control signal to the pressure changing unit 201 in accordance with the corrected control line and the amount of operation of the accelerator member 84 to change the primary pressure of the operation valves 55.

When the amount of operation of the accelerator member 84 is less than the threshold (for example, the amount of operation of the first accelerator member 84*a* or the second accelerator member 84*b* is less than about 80%), the controller 25 does not correct the data of the control line L11 even if the adjustment stage of the vehicle speed is changed by the speed adjustment member 86. In this case, the controller 25 inputs a control signal corresponding to the value of the primary pressure corresponding to an operation amount of about 0% of the accelerator member 84 among the values of the primary pressure of the operation valves 55 indicated by the control line L11 to the pressure changing unit 201, and realizes the primary pressure of the operation valves 55. Further, the controller 25 changes the rotational speed of the engine 32 in accordance with the amount of operation of the accelerator member 84 or the adjustment stage of the vehicle speed set by the speed adjustment member 86.

Like the control line L11 described above, the control line L10 may also be corrected by the controller 25 in accordance with the adjustment stage of the vehicle speed set by the speed adjustment member 86 and the amount of operation of the accelerator member 84.

Figure 12B:
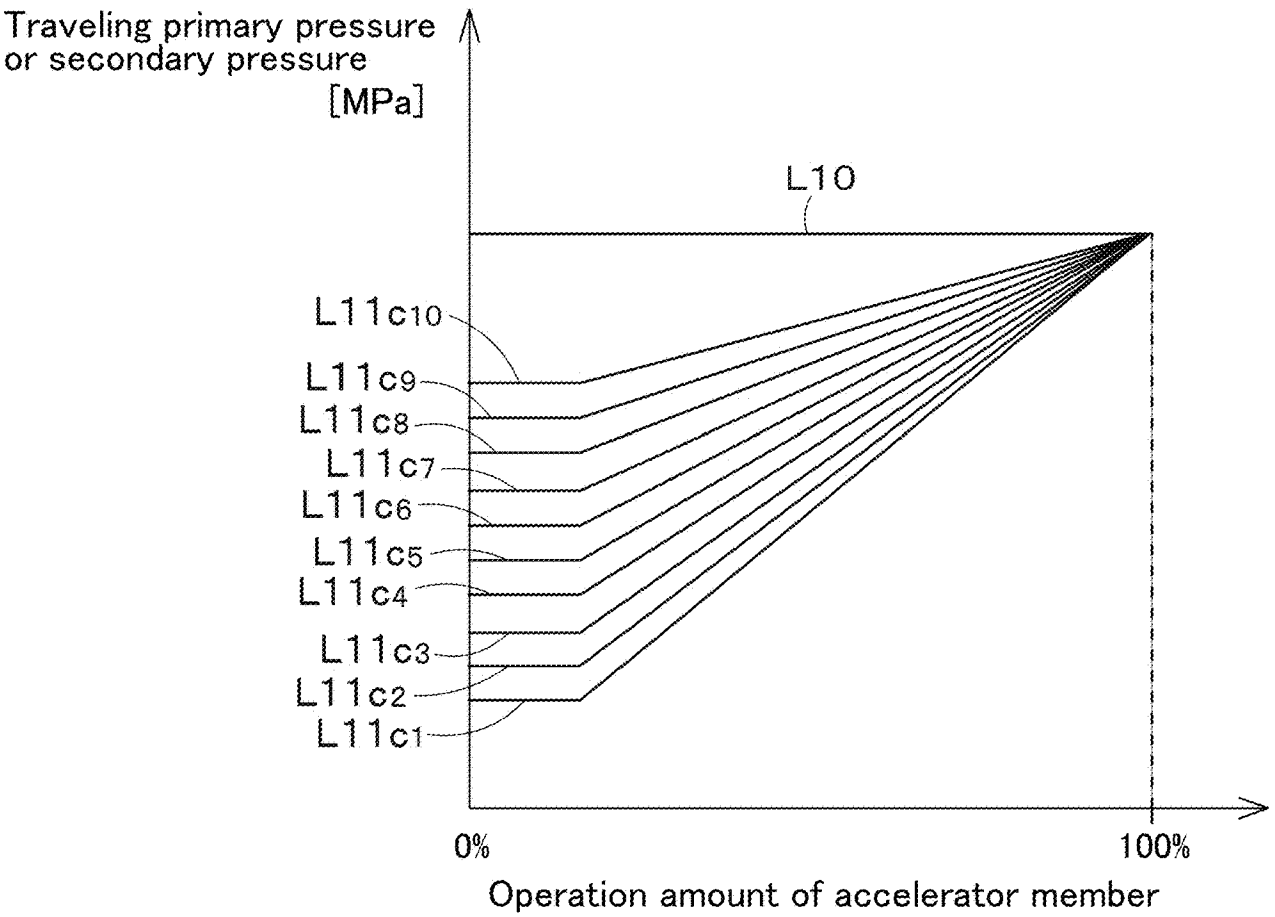
FIG. 12B is a graph illustrating another relationship between an amount of operation of the accelerator member and a traveling primary pressure (or traveling secondary pressure) according to the fifth preferred embodiment of the present invention.

In the second mode, as indicated by control lines L11$c_1$ to L11$c_{10}$ illustrated in FIG. 12B, the controller 25 may change the primary pressure of the operation valves 55 in accordance with the amount of operation of the accelerator member 84.

In the relationship between the amount of operation of the accelerator member 84 and the traveling primary pressure (or secondary pressure) illustrated in the graph in FIG. 12B, the amount of operation of the accelerator member 84 when operated to the maximum is set to about 100%. Data of the control lines L11$c_1$ to L11$c_{10}$ and L10 illustrated in FIG. 12B is stored in the storage unit 26 in advance. Alternatively, the data of at least one of the control lines L11$c_1$ to L11$c_{10}$ may be stored in the storage unit 26 in advance, and the controller 25 may calculate the data of the remaining control lines on the basis of the stored data.

In this case, the controller 25 adopts one of the control lines L11$c_1$ to L11$c_{10}$ in accordance with the adjustment stage of the vehicle speed set by the speed adjustment member 86. Specifically, for example, the controller 25 is configured such that the vehicle speed of the working machine 1 can be adjusted in ten stages by the speed adjustment member 86. The controller 25 adopts one of the control lines L11$c_1$ to L11$c_{10}$ in descending order of slope such that the control lines L11$c_1$, L11$c_2$, . . . , and L11$c_{10}$ are adopted in this order as the number of stages of the adjustment stage set by the speed adjustment member 86 increases, such as a first stage in which the vehicle speed is the lowest, a second stage in which the vehicle speed is the second lowest, . . . , and a tenth stage in which the vehicle speed is the highest.

More specifically, for example, when the first stage in which the vehicle speed is the lowest is set by the speed adjustment member 86, the controller 25 adopts the data of the control line L11$c_1$. For example, when the tenth stage in which the vehicle speed is the highest is set, the controller 25 adopts the data of the control line L11$c_{10}$. The controller 25 inputs a control signal to the pressure changing unit (proportional valve) 201 in accordance with an adopted one of the control lines L11$c_1$ to L11$c_{10}$ and the amount of operation of the accelerator member 84 to change the primary pressure of the operation valves 55.

As described above, the controller 25 selects one of the control lines L11$c_1$ to L11$c_{10}$ in response to an operation of the speed adjustment member 86. That is, the controller 25 sets an adjustment stage that is a range in which the traveling primary pressure that is the primary pressure of the operation valves 55 (or the traveling secondary pressure that is the secondary pressure of the operation valves 55, and thus the angles of the swash plates of the traveling pumps 53L and 53R, the rotational speeds of the traveling motors 36L and 36R, and the travel speed of the traveling device 5) is adjustable. In response to an operation of the accelerator member 84, the controller 25 adjusts the traveling primary pressure or the like in the adjustment stage in accordance with the amount of operation of the accelerator member 84 and the selected one of the control lines L11$c_1$ to L11$c_{10}$.

Further, in response to an operation of the accelerator member 84 by a predetermined amount or more, the controller 25 changes the traveling primary pressure or the like so that the traveling primary pressure or the like increases in the corresponding adjustment stage in accordance with the amount of operation of the accelerator member 84 and the selected one of the control lines L11$c_1$ to L11$c_{10}$. That is, in the second mode (creep mode), the adjustment stage or the like of the vehicle speed of the working machine 1 is set in response to an operation of the speed adjustment member 86, and the vehicle speed or the like of the working machine 1 is changed within the set adjustment stage in response to an operation of the accelerator member 84.

In the first mode, the controller 25 adopts the control line L10 and inputs a control signal to the pressure changing unit (proportional valve) 201 so that the primary pressure of the operation valves 55 is kept at a constant pressure indicated by the control line L10 regardless of the amount of operation of the accelerator member 84. The primary pressure of the operation valves 55 set on the basis of the control lines L11$c_1$ to L11$c_{10}$ in the second mode has the same value as the primary pressure (constant pressure) of the operation valves 55 indicated by the control line L10 in the first mode when the amount of operation of the accelerator member 84 is 100%.

In another example, the controller 25 may perform correction to shift the control line L10 or L11 in FIG. 12A or the control lines L11$c_1$ to L11$c_{10}$ in FIG. 12B in the vertical axis direction in accordance with the load (load factor or the like) of the engine 32 or the difference between the actual rotational speed of the engine 32 and the target engine rotational speed.

For example, when the amount of operation of the first accelerator member 84*a* out of the first accelerator member 84*a* and the second accelerator member 84*b* is less than a predetermined amount (such as about 80%), the controller 25 may set the primary pressure of the operation valves 55 on the basis of the control line L10 or L11 or any one of the control lines L11$c_1$ to L11$c_{10}$ and the amount of operation of the first accelerator member 84*a*. When the amount of operation of the first accelerator member 84*a* is equal to or greater than the predetermined amount, the controller 25 may set the primary pressure of the operation valves 55 on the basis of the control line L10 or L11 or any one of the control lines L11$c_1$ to L11$c_{10}$ and the amount of operation of the second accelerator member 84*b*.

In the preferred embodiment described above, in the second mode (creep mode), the primary pressure acting on the operation valves 55 is changed. Alternatively, the secondary pressure (also referred to as a traveling secondary pressure), which is the pressure of the pilot fluid discharged from the operation valves 55, may be changed. In this case, the control data illustrated in FIG. 12A or 12B can be used. The operation device 54 is preferably configured as a joystick or the like capable of outputting an electric signal corresponding to its operating state.

Sixth Preferred Embodiment

Figure 13:
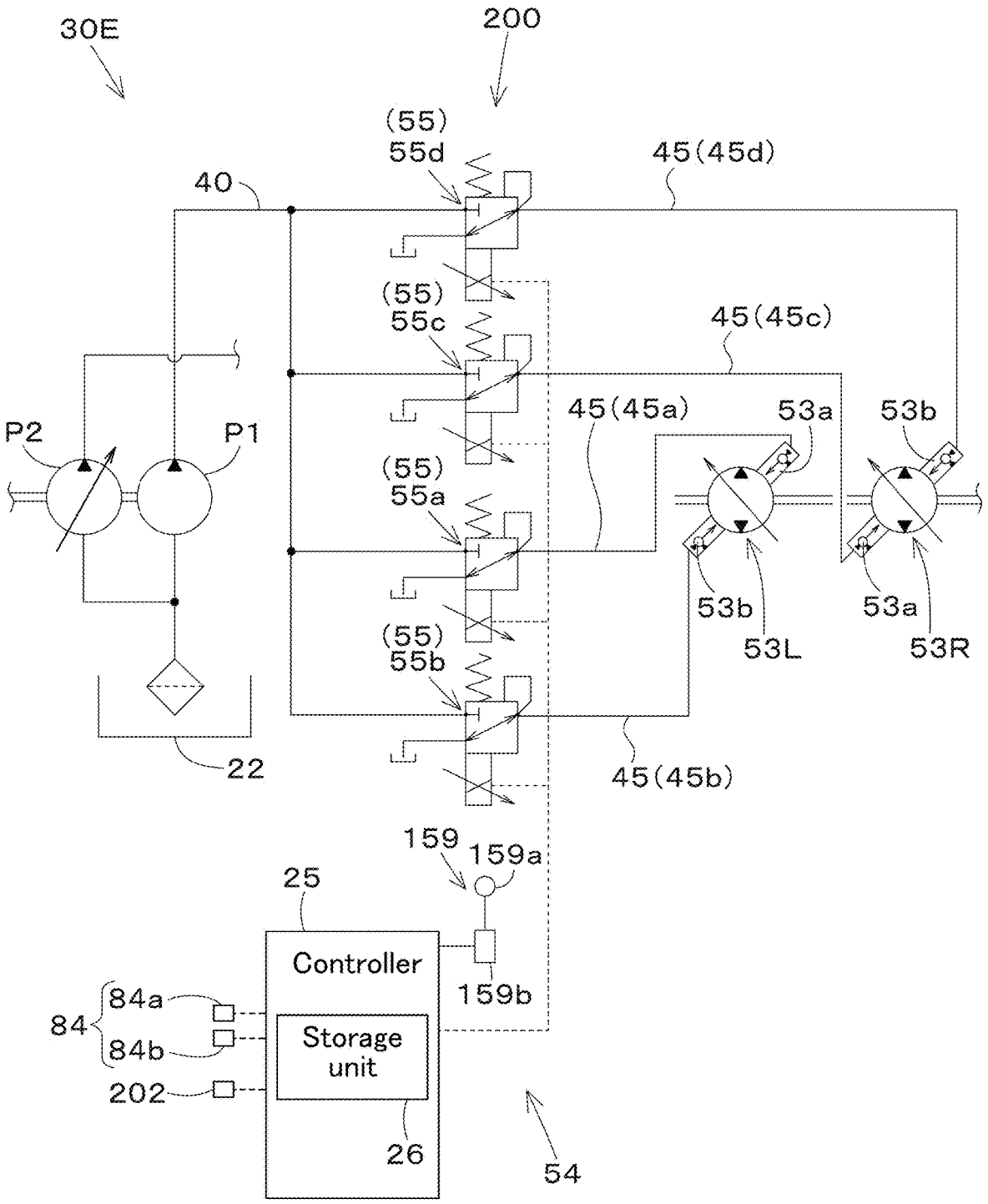
FIG. 13 is a diagram illustrating a main portion of a hydraulic system for a traveling system of a working machine according to a sixth preferred embodiment of the present invention.

FIG. 13 is a diagram illustrating a main portion of a hydraulic system 30E for the traveling system of the working machine 1 according to a sixth preferred embodiment. An operation device 54 of the hydraulic system 30E includes an operation member (travel operation member) 159 that operates travel of the working machine 1, and operation valves 55*a*, 55*b*, 55*c*, and 55*d*. The operation member 159 includes a joystick and an operation part 159*a* and an electric circuit 159*b* that operates in conjunction with the operation part 159*a*. The operation member 159, which includes a joystick, is hereinafter referred to as a joystick 159, for convenience.

The operation part 159*a* of the joystick 159 is swingable in the left-right direction (machine-body width direction) or the front-rear direction. The electric circuit 159*b* inputs an operation signal (electric signal) corresponding to the amount and direction of operation of the operation part 159*a* to the controller 25. The controller 25 detects the amount and direction of operation of the joystick 159 (the operation part 159*a*) on the basis of the operation signal input from the electric circuit 159*b*.

The operation valves 55*a* to 55*d* are each a solenoid proportional valve (solenoid valve). The operation valves 55*a* to 55*d* are disposed in intermediate portions of the travel fluid passages 45 (45*a* to 45*d*) connected to the third fluid passage 40. More specifically, the operation valve 55*a* is connected to an intermediate portion of the first travel fluid passage 45*a*. The first travel fluid passage 45*a* has a first end connected to the third fluid passage 40, and a second end connected to the pressure receiver 53*a* of the first traveling pump 53L. The operation valve 55*b* is connected to an intermediate portion of the second travel fluid passage 45*b*. The second travel fluid passage 45*b* has a first end connected to the third fluid passage 40, and a second end connected to the pressure receiver 53*b* of the first traveling pump 53L.

The operation valve 55*c* is connected to an intermediate portion of the third travel fluid passage 45*c*. The third travel fluid passage 45*c* has a first end connected to the third fluid passage 40, and a second end connected to the pressure receiver 53*a* of the second traveling pump 53R. The operation valve 55*d* is connected to an intermediate portion of the fourth travel fluid passage 45*d*. The fourth travel fluid passage 45*d* has a first end connected to the third fluid passage 40, and a second end connected to the pressure receiver 53*b* of the second traveling pump 53R.

When the operation part 159*a* is swung to the front, the controller 25 outputs a control signal to the operation valve 55*a* and the operation valve 55*c* to tilt the swash plates of the traveling pumps 53L and 53R in the directions for forward rotation (forward movement) of the traveling motors 36L and 36R. When the operation part 159*a* is swung to the rear, the controller 25 outputs a control signal to the operation valve 55*b* and the operation valve 55*d* to tilt the swash plates of the traveling pumps 53L and 53R in the directions for reverse rotation (rearward movement) of the traveling motors 36L and 36R. When the operation part 159*a* is swung to the right, the controller 25 outputs a control signal to the operation valve 55*a* and the operation valve 55*d* to tilt the swash plate of the first traveling pump 53L in the direction for forward rotation of the first traveling motor 36L and tilt the swash plate of the second traveling pump 53R in the direction for reverse rotation of the second traveling motor 36R. When the operation part 159*a* is swung to the left, the controller 25 outputs a control signal to the operation valve 55*b* and the operation valve 55*c* to tilt the swash plate of the first traveling pump 53L in the direction for reverse rotation of the first traveling motor 36L and tilt the swash plate of the second traveling pump 53R in the direction for forward rotation of the second traveling motor 36R.

The operation valves 55*a* to 55*d* also function as pressure changing units included in the speed adjustment mechanism 200. The controller 25 changes the opening of the operation valves 55*a* to 55*d* in accordance with the amount of operation of the joystick 159 to change the secondary pressure (traveling secondary pressure) of the operation valves 55*a* to 55*d*.

Figure 14A:
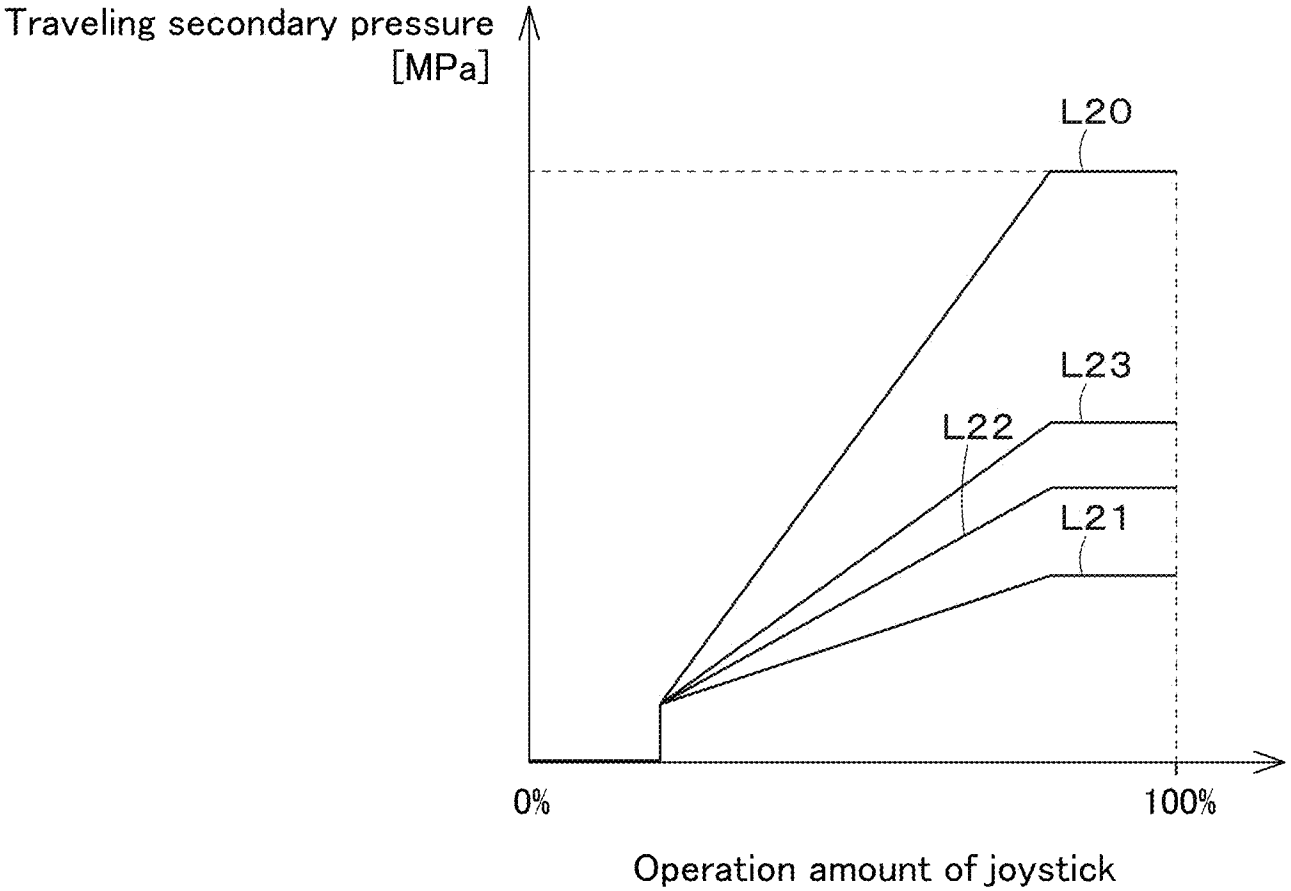
FIG. 14A is a graph illustrating a relationship between an amount of operation of a joystick and a traveling secondary pressure according to the sixth preferred embodiment of the present invention.

FIG. 14A is a graph illustrating a relationship between the amount of operation of the joystick 159 and the traveling secondary pressure. A control map representing the relationship illustrated in FIG. 14A is stored in advance in the storage unit 26 of the controller 25.

When switched to the first mode (normal mode) by the operation switch 202 (FIG. 13), the controller 25 sets the secondary pressure of the operation valves 55*a* to 55*d* in accordance with a control line L20 illustrated in FIG. 14A and the amount of operation of the joystick 159, and outputs a control signal to the operation valves 55*a* to 55*d* so as to realize the set secondary pressure. That is, in the first mode, the controller 25 increases the opening of the operation valves 55*a* to 55*d* to increase the secondary pressure output from the operation valves 55*a* to 55*d* as the amount of operation of the joystick 159 increases. In the first mode, the controller 25 does not change the slope or the like of the control line L20 regardless of the amount of operation of the accelerator member 84.

On the other hand, when switched to the second mode (creep mode) by the operation switch 202, the controller 25 sets the secondary pressure of the operation valves 55*a* to 55*d* on the basis of any one of control lines L21 to L23 illustrated in FIG. 14A and the amount of operation of the joystick 159, and outputs a control signal to the operation valves 55*a* to 55*d* so as to realize the set secondary pressure. That is, at this time, the controller 25 sets the secondary pressure of the operation valves 55*a* to 55*d* to a value lower than the pressure set on the basis of the control line L20 used in the first mode. Further, the controller 25 changes the secondary pressure output from the operation valves 55*a* to 55*d* in accordance with the amount of operation of the joystick 159.

When the joystick 159 is operated to the maximum, the amount of operation of the joystick 159 becomes about 100%. When the first accelerator member 84*a* of the accelerator member 84 is operated to the maximum, the amount of operation of the first accelerator member 84*a* also becomes about 100%, and when the second accelerator member 84*b* of the accelerator member 84 is operated to the maximum, the amount of operation of the second accelerator member 84*b* also becomes about 100%.

For example, in the second mode, a speed adjustment stage corresponding to the control line L21 in FIG. 14A is selected in response to an operation of the speed-shift operation member 61 (FIG. 11) or the like (or the speed adjustment member 86). When the first accelerator member 84*a* is operated by a certain amount (i.e., about 80%) or more and the amount of operation of the second accelerator member 84*b* is less than about 10%, the controller 25 sets the secondary pressure of the operation valves 55*a* to 55*d* on the basis of the control line L21 and the amount of operation of the joystick 159. When the amount of operation of the second accelerator member 84*b* ranges from about 10% to less than about 90%, the controller 25 sets the secondary pressure of the operation valves 55*a* to 55*d* on the basis of the control line L22 and the amount of operation of the joystick 159. When the amount of operation of the second accelerator member 84*b* is about 90% or more, the controller 25 sets the secondary pressure of the operation valves 55*a* to 55*d* on the basis of the control line L23 and the amount of operation of the joystick 159.

The secondary pressure of the operation valves 55*a* to 55*d* set on the basis of the control lines L21 to L23 in the second mode has a value smaller than the secondary pressure of the operation valves 55*a* to 55*d* set on the basis of the control line L20 in the first mode. When the amount of operation of the joystick 159 is equal to or greater than the predetermined amount, the secondary pressure of the operation valves 55*a* to 55*d* is set on the basis of the control lines L21, L22, and L23 such that the secondary pressures set on the basis of the control lines L21, L22, and L23 are in descending order from highest to lowest.

Upon setting the secondary pressure of the operation valves 55*a* to 55*d* on the basis of any one of the control lines L21 to L23 and the amount of operation of the joystick 159 in the way described above, the controller 25 outputs a control signal to the operation valves 55*a* to 55*d* to control the opening of the operation valves 55*a* to 55*d* so as to realize the set secondary pressure.

With the operation described above, in the second mode (creep mode), the secondary pressure output from the operation valves 55*a* to 55*d* increases as the amount of operation of the joystick (travel operation member) 159 increases. Thus, the pilot pressures acting on the pressure receivers 53*a* and 53*b* of the traveling pumps 53L and 53R can be changed to increase the vehicle speed of the working machine 1. That is, the controller 25 makes the rotational speeds of the traveling motors 36L and 36R and the travel speed of the traveling device 5, which are adjusted in the second mode in accordance with the amount of operation of the joystick 159, slower than the rotational speeds of the traveling motors 36L and 36R and the travel speed of the traveling device 5, which are adjusted in the first mode in accordance with the same amount of operation of the traveling operation member 159. In addition, the controller 25 can control the traveling pumps 53L and 53R in accordance with the amount of operation of the joystick 159 to improve the accuracy of horsepower control and vehicle speed control of the traveling system of the working machine 1.

In the second mode, in response to an operation of the first accelerator member 84*a* by a certain amount or more and an operation of the second accelerator member 84*b* by a predetermined amount, the controller 25 selects one of the control lines L21 to L22. That is, the controller 25 sets an adjustment stage, which is a range in which the traveling secondary pressure that is the secondary pressure of the operation valves 55*a* to 55*d* (and thus the angles of the swash plates of the traveling pumps 53L and 53R, the rotational speeds of the traveling motors 36L and 36R, and the travel speed of the traveling device 5) is adjustable. Then, the controller 25 adjusts the traveling secondary pressure or the like in accordance with the operating state of the joystick 159 and the selected control line. In response to an operation of the joystick 159 by a predetermined amount or more, the controller 25 changes the traveling secondary pressure so that the traveling secondary pressure increases in the adjustment stage described above in accordance with the amount of operation of the joystick 159 and the selected control line.

As described above, in response to an operation of the joystick 159 after an operation of the accelerator members 84*a* and 84*b*, the traveling secondary pressure is adjusted, and the angles of the swash plates of the traveling pumps 53L and 53R, the rotational speeds of the traveling motors 36L and 36R, and the travel speed of the traveling device 5 are also adjusted. As a result, the vehicle speed of the working machine 1 can be changed. Further, as indicated by the control lines L21 to L23 in FIG. 14A, the adjustment range of the traveling secondary pressure by the joystick 159 is smaller than the adjustment range of the traveling secondary pressure by the second accelerator member 84*b*. Thus, in response to an operation of the joystick 159 after the adjustment range of the vehicle speed of the working machine 1 is set in response to an operation of the second accelerator member 84*b*, the vehicle speed of the working machine 1 can be adjusted with an adjustment range smaller than that of the second accelerator member 84*b*.

Further, the vehicle speed of the working machine 1 corresponding to the amount of operation of the joystick 159 in the second mode can be reduced less than the vehicle speed of the working machine 1 corresponding to the amount of operation of the joystick 159 in the first mode. In addition, the degree of reduction in the vehicle speed of the working machine 1 can be set by the operation of the second accelerator member 84*b*.

In the preferred embodiment described above, in the second mode, the controller 25 adopts one of the control lines L21 to L23 in accordance with the amount of operation of the accelerator member 84. Alternatively, for example, the controller 25 may adopt one of the control lines L21 to L23 in accordance with the adjustment stage of the vehicle speed set by the speed adjustment member 86.

Specifically, for example, when the first stage in which the vehicle speed is the lowest is set by the speed adjustment member 86, the controller 25 adopts the control line L21. When the N-th stage in which the vehicle speed is the highest is set, where N is a natural number equal to or greater than 3, the controller 25 adopts the control line L23. Further, when an (N−M)-th stage between the first stage and the N-th stage is set, where M is a natural number equal to or greater than 1 and less than N, preferably, M=N/2, the controller 25 adopts the control line L22.

In the preferred embodiment described above, the pilot pressure (the primary pressure or the secondary pressure of the operation valves 55*a* to 55*d*) of the traveling system of the working machine 1 is changed in accordance with the amount of operation of the joystick 159. However, the delivery amounts of the hydraulic fluid from the traveling pumps 53L and 53R or the rotational speeds of the traveling motors 36L and 36R (FIG. 11) may be changed in accordance with the amount of operation of an electric operation member such as the joystick 159. A preferred embodiment presenting this case will be described hereinafter. In the following description, the joystick 159 is adopted as an example of the electric operation member.

Figure 14B:
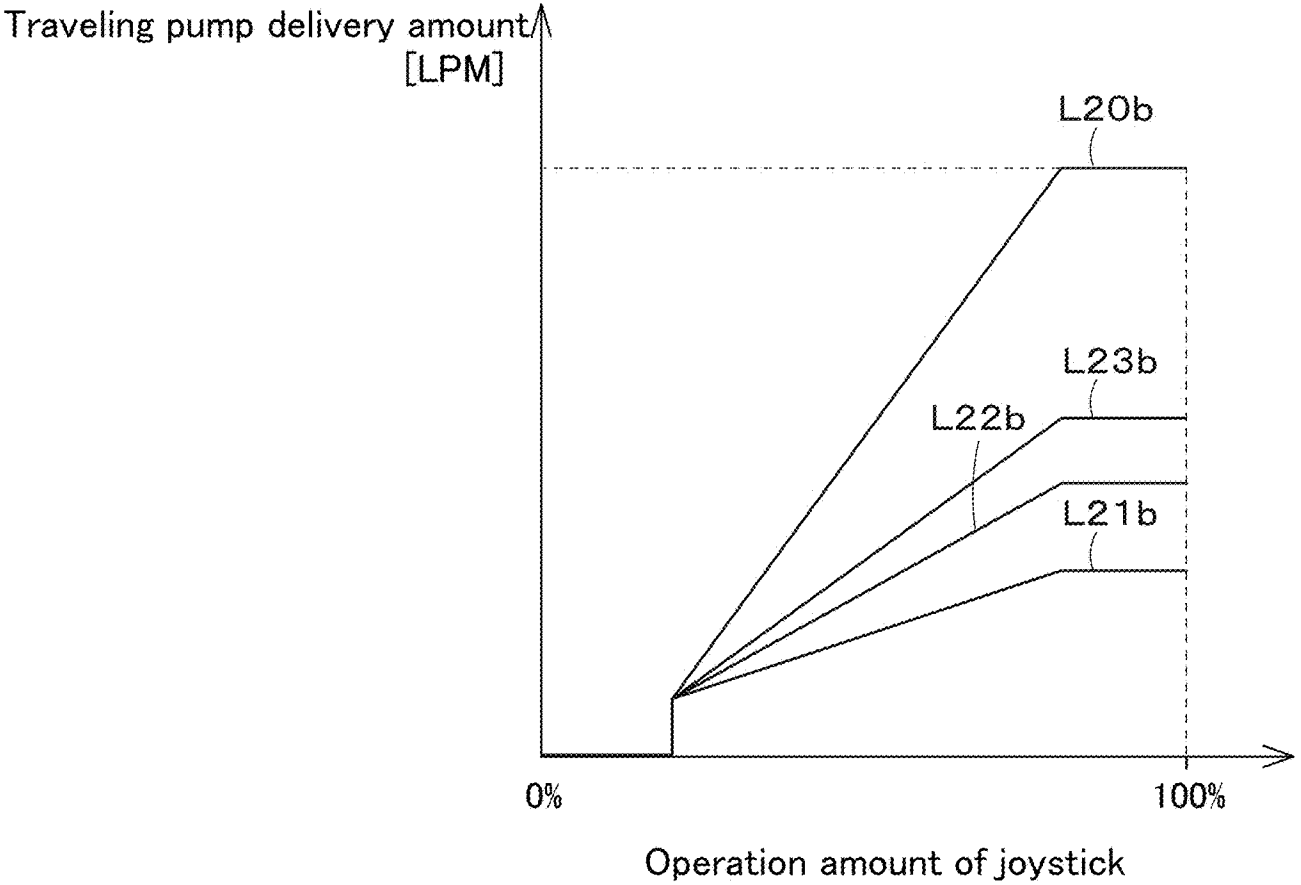
FIG. 14B is a graph illustrating a relationship between an amount of operation of the joystick and a delivery amount of fluid from a traveling pump.
Figure 14C:
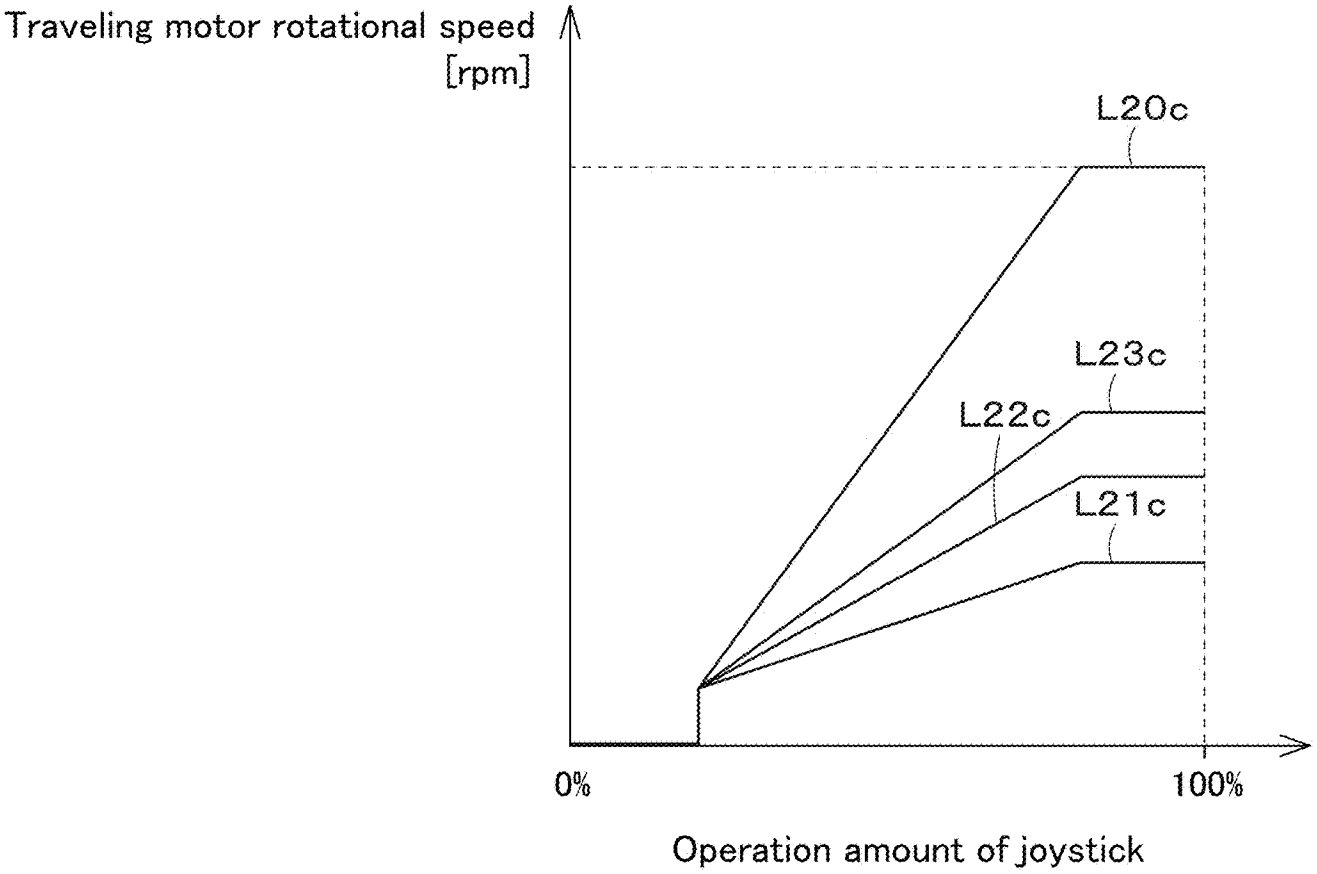
FIG. 14C is a graph illustrating a relationship between an amount of operation of the joystick and a rotational speed of a traveling motor.

FIG. 14B is a graph illustrating a relationship between the amount of operation of the joystick 159 and the delivery amount of the hydraulic fluid from the traveling pumps 53L and 53R. FIG. 14C is a graph illustrating a relationship between the amount of operation of the joystick 159 and the rotational speed of the traveling motors 36L and 36R. A control map representing the relationship illustrated in FIG. 14B or a control map representing the relationship illustrated in FIG. 14C is stored in advance in the storage unit 26 of the controller 25.

Upon being switched to the first mode (normal mode) by the operation switch 202, the controller 25 adopts a control line L20*b* or L20*c*. Upon being switched to the second mode (creep mode) by the operation switch 202, the controller 25 adopts one of control lines L21*b* to L23*b* or one of control lines L21*c* to L23*c*.

For example, a speed adjustment stage corresponding to the control line L21*b* or L21*c* is selected by the speed-shift operation member 61 or the like, and the first accelerator member 84*a* is operated by a certain amount (i.e., about 80%) or more. In this case, when the amount of operation of the second accelerator member 84*b* is less than about 10%, the controller 25 adopts the control line L21*b* or L21*c*. When the amount of operation of the second accelerator member 84*b* ranges from about 10% to less than about 90%, the controller 25 adopts the control line L22*b* or L22*c*. When the amount of operation of the second accelerator member 84*b* is about 90% or more, the controller 25 adopts the control line L23*b* or L23*c*. In another example, when the amount of operation of the second accelerator member 84*b* is about 90% or more, the controller 25 may adopt not only the control line L23*b* or L23*c* but also the control line L20*b* or L20*c* as candidates.

As described above, upon adopting one of the control lines L20*b* to L23*b* or one of the control lines L20*c* to L23*c*, the controller 25 sets the delivery amount of the hydraulic fluid from the traveling pumps 53L and 53R or the rotational speed of the traveling motors 36L and 36R in accordance with the adopted control line and the amount of operation of the joystick 159, and outputs a control signal to the operation valves 55*a* to 55*d* so as to realize the set delivery amount of the hydraulic fluid or the set rotational speed.

In another example, the controller 25 may set the secondary pressure of the operation valves 55*a* to 55*d*, the delivery amount of the hydraulic fluid from the traveling pumps 53L and 53R, or the rotational speed of the traveling motors 36L and 36R in accordance with arithmetic expressions such as equations (5) to (7) below. Equations (5) to (7) are arithmetic expressions used when the controller 25 is switched to the second mode by the operation switch 202, the amount of operation of the first accelerator member 84*a* is equal to or greater than a threshold (for example, equal to or greater than about 80%), the amount of operation of the second accelerator member 84*b* is equal to or greater than about 10%, and the first stage is set as the adjustment stage of the vehicle speed by the speed adjustment member 86.

Secondary pressure of operation valves 55*a* to 55*d*= (secondary pressure of operation valves 55*a* to 55*d* corresponding to amount of operation of joystick 159 in accordance with control line L21 in FIG. 14A)×[1+constant×(amount of operation of second accelerator member 84*b* (%)−10%)] (5)

Upon calculating the secondary pressure of the operation valves 55*a* to 55*d* in accordance with Equation (5) above, the controller 25 compares the calculated value with the secondary pressure (set value) of the operation valves 55*a* to 55*d* corresponding to the amount of operation of the joystick 159, which is set on the basis of the control line L21 in FIG. 14A. If the calculated value of the secondary pressure of the operation valves 55*a* to 55*d* is larger than the set value, the controller 25 controls the opening of the operation valves 55*a* to 55*d* so as to realize the calculated value (the secondary pressure of the operation valves 55*a* to 55*d*). On the other hand, if the calculated value of the secondary pressure of the operation valves 55*a* to 55*d* is equal to or less than the set value, the controller 25 controls the opening of the operation valves 55*a* to 55*d* so as to realize the set value (the secondary pressure of the operation valves 55*a* to 55*d*).

Delivery amount of hydraulic fluid from traveling pumps 53L and 53R=(delivery amount of hydraulic fluid from traveling pumps 53L and 53R corresponding to amount of operation of joystick 159 in accordance with control line L21*b* in FIG. 14B)×[1+constant×(amount of operation of second accelerator member 84*b* (%)−10%)] (6)

Upon calculating the delivery amount of the hydraulic fluid from the traveling pumps 53L and 53R in accordance with Equation (6) above, the controller 25 compares the calculated value with the amount of delivery (set value) of the traveling pumps 53L and 53R corresponding to the amount of operation of the joystick 159, which is set on the basis of the control line L21*b* in FIG. 14B. If the calculated value of the delivery amount of the hydraulic fluid from the traveling pumps 53L and 53R is larger than the set value, the controller 25 controls the opening of the operation valves 55*a* to 55*d* so as to realize the calculated value (the delivery amount of the hydraulic fluid from the traveling pumps 53L and 53R). On the other hand, if the calculated value of the delivery amount of the hydraulic fluid from the traveling pumps 53L and 53R is equal to or less than the set value, the controller 25 controls the opening of the operation valves 55*a* to 55*d* so as to realize the set value (the delivery amount of the hydraulic fluid from the traveling pumps 53L and 53R).

The opening of the operation valves 55*a* to 55*d* corresponding to the delivery amount of the hydraulic fluid from the traveling pumps 53L and 53R or control data indicating a control signal to be input to the operation valves 55*a* to 55*d* from the controller 25 to realize the opening of the operation valves 55*a* to 55*d* is stored in the storage unit 26 in advance.

Rotational speed of traveling motors 36L and 36R= (rotational speed of traveling motors 36L and 36R corresponding to amount of operation of joystick 159 in accordance with control line L21*c* in FIG. 14C)×[1+constant×(amount of operation of second accelerator member 84*b* (%)−10%)] (7)

Upon calculating the rotational speed of the traveling motors 36L and 36R in accordance with Equation (7) above, the controller 25 compares the calculated value with the rotational speed (set value) of the traveling motors 36L and 36R corresponding to the amount of operation of the joystick 159, which is set on the basis of the control line L21*c* in FIG. 14C. If the calculated value of the rotational speed of the traveling motors 36L and 36R is larger than the set value, the controller 25 controls the opening of the operation valves 55*a* to 55*d* so as to realize the calculated value (the rotational speed of the traveling motors 36L and 36R). On the other hand, if the calculated value of the rotational speed of the traveling motors 36L and 36R is equal to or less than the set value, the controller 25 controls the opening of the operation valves 55*a* to 55*d* so as to realize the set value (the rotational speed of the traveling motors 36L and 36R).

The opening of the operation valves 55*a* to 55*d* corresponding to the rotational speed of the traveling motors 36L and 36R or control data indicating a control signal to be input to the operation valves 55*a* to 55*d* from the controller 25 to realize the opening of the operation valves 55*a* to 55*d* is stored in the storage unit 26 in advance.

Upon being switched to the first mode by the operation switch 202, the controller 25 adopts control lines L20, L20*b*, and L20*c* in Equations (5) to (7) above.

When the controller 25 is switched to the second mode by the operation switch 202 and the second stage or higher is set as the adjustment stage of the vehicle speed by the speed adjustment member 86, the controller 25 applies one of the control lines L21 to L23, one of the control lines L21*b* to L23*b*, and one of the control lines L21*c* to L23*c* to Equations (5) to (7) above in accordance with the adjustment stage.

In another example, when the working tool 11 (FIG. 24) of the working machine 1 is replaceable, the controller 25 may cause a detector such as a sensor to detect the type of the working tool 11 attached to the working machine 1, and change the constant (correction coefficient) in at least one of Equations (5) to (7) above in accordance with the type of the working tool 11. Instead of the joystick 159, any other electric operation member configured to output an electric signal in accordance with its operating state may be used, or any other operation member configured to output a hydraulic signal in accordance with its operating state may be used.

Further, the controller 25 may perform correction to shift the control lines L20 to L23, L20*b* to L23*b*, and L20*c* to L23*c* in FIGS. 14A to 14C in the vertical axis direction in accordance with the load (load factor or the like) of the engine 32 or the difference between the actual rotational speed of the engine 32 and the target engine rotational speed.

For example, when the amount of operation of the first accelerator member 84*a* is less than a predetermined amount (such as about 80%), the controller 25 may adopt one of the control lines L20 to L23, one of the control lines L20*b* to L23*b*, or one of the control lines L20*c* to L23*c* in accordance with the amount of operation of the first accelerator member 84*a*, and set the secondary pressure of the operation valves 55*a* to 55*d*, the delivery amount of the hydraulic fluid from the traveling pumps 53L and 53R, or the rotational speed of the traveling motors 36L and 36R in accordance with the adopted control line and the amount of operation of the joystick 159.

For example, when the amount of operation of the first accelerator member 84*a* is equal to or greater than the predetermined amount, the controller 25 may adopt one of the control lines L20 to L23, one of the control lines L20*b* to L23*b*, or one of the control lines L20*c* to L23*c* in accordance with the amount of operation of the second accelerator member 84*b*, and set the secondary pressure of the operation valves 55*a* to 55*d*, the delivery amount of the hydraulic fluid from the traveling pumps 53L and 53R, or the rotational speed of the traveling motors 36L and 36R in accordance with the adopted control line and the amount of operation of the joystick 159.

Further, in the second mode, in response to an operation of the joystick (travel operation member) 159, the controller 25 causes the speed adjustment mechanism 200 to change the angles of the swash plates of the traveling pumps 53L and 53R in accordance with the amount of operation of the joystick 159 to adjust the rotational speed of the traveling motors 36L and 36R and the travel speed of the traveling device 5. When the amount of operation of the joystick 159 is constant, that is, when the rotational speed of the traveling motors 36L and 36R and the travel speed of the traveling device 5 are adjusted to be constant by the speed adjustment mechanism 200 in accordance with the amount of operation of the joystick 159, in response to an operation of the accelerator member 84 (the first accelerator member 84*a* or the second accelerator member 84*b*), the controller 25 may cause the speed adjustment mechanism 200 to change the angles of the swash plates of the traveling pumps 53L and 53R, without changing the rotational speed of the engine 32, in accordance with the amount of operation of the accelerator member 84 to change (re-adjust) the rotational speed of the traveling motors 36L and 36R and the travel speed of the traveling device 5.

For example, in the second mode, the controller 25 may cause the speed adjustment mechanism 200 to change the angles of the swash plates of the traveling pumps 53L and 53R in accordance with the operating state of the speed adjustment member 86 to adjust the rotational speed of the traveling motors 36L and 36R and the travel speed of the traveling device 5. Thereafter, when the amount of operation of the first accelerator member 84*a* is equal to or greater than a certain amount, in response to an operation of the second accelerator member 84*b*, the controller 25 may cause the speed adjustment mechanism 200 to change the angles of the swash plates of the traveling pumps 53L and 53R in accordance with the amount of operation of the second accelerator member 84*b* to adjust the rotational speed of the traveling motors 36L and 36R and the travel speed of the traveling device 5. In this case, the controller 25 adjusts the rotational speed of the traveling motors 36L and 36R and the travel speed of the traveling device 5, which are different from the rotational speed of the traveling motors 36L and 36R and the travel speed of the traveling device 5 that are adjusted in accordance with the operating state of the speed adjustment member 86, in accordance with the amount of operation of the second accelerator member 84*b*.

Specifically, for example, in the control data illustrated in FIG. 14A, the controller 25 selects a speed adjustment stage corresponding to one of the control lines L21 to L23 in accordance with the operating state of the speed adjustment member 86. When the first accelerator member 84*a* is operated by a certain amount (i.e., about 80%) or more, in response to a further operation of the second accelerator member 84*b*, the controller 25 shifts the selected one of the control lines L21 to L23 in the vertical axis direction in accordance with the amount of operation of the second accelerator member 84*b*. At this time, the controller 25 shifts the selected one of the control lines L21 to L23 in the vertical axis direction such that the selected control line does not overlap the other control lines among the control lines L21 to L23.

Accordingly, the controller 25 adjusts the rotational speed of the traveling motors 36L and 36R and the travel speed of the traveling device 5, which are different from the rotational speed of the traveling motors 36L and 36R and the travel speed of the traveling device 5 that are adjusted in accordance with the operating state of the speed adjustment member 86, in accordance with the amount of operation of the second accelerator member 84*b*.

Further, the controller 25 may input a control signal to all, any one, or any two or more of the operation valves 55*a* to 55*d* in accordance with the secondary pressure of the operation valves 55*a* to 55*d*, the delivery amount of the hydraulic fluid from the traveling pumps 53L and 53R, or the rotational speed of the traveling motors 36L and 36R, which is set in the way described above, to control the opening of the operation valve or valves.

In the sixth preferred embodiment described above, in the second mode (creep mode), the secondary pressure of the operation valves 55*a* to 55*d* or the like is changed. Alternatively, a valve different from the operation valves 55*a* to 55*d* may be used to change the pilot pressures acting on the pressure receivers 53*a* and 53*b* of the traveling pumps 53L and 53R, the angles of the swash plates of the traveling pumps 53L and 53R, the angles of the swash plates of the traveling motors 36L and 36R, or the rotational speeds of the traveling motors 36L and 36R. Alternatively, the traveling pumps 53L and 53R or the traveling motors 36L and 36R may be controlled.

Figure 15:
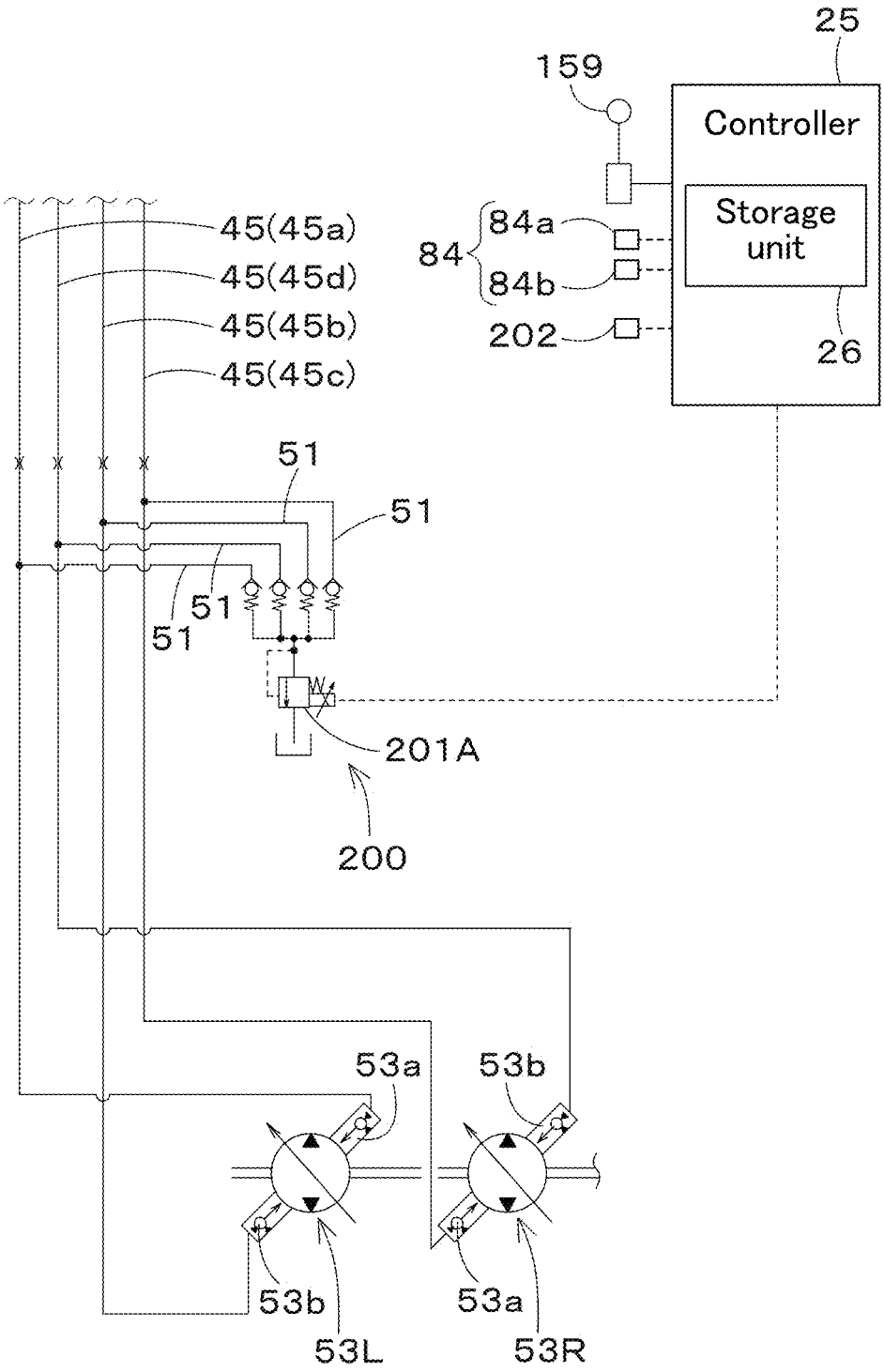
FIG. 15 is a diagram illustrating a modification of a speed adjustment mechanism.

FIG. 15 is a diagram illustrating a modification of the speed adjustment mechanism 200. In the speed adjustment mechanism 200 illustrated in FIG. 15, a pressure changing unit 201A is connected to branch fluid passages 51, each of which is branched from one of the travel fluid passages 45*a* to 45*d*. The pressure changing unit 201A is, for example, a variable relief valve (solenoid valve). The travel fluid passages 45*a* to 45*d* are connected to the operation valves (solenoid proportional valve) 55*a* to 55*d*, as illustrated in FIG. 13.

The controller 25 changes an opening of the pressure changing unit 201A in accordance with, for example, the control map illustrated in FIG. 12A and the amount of operation of the accelerator member 84 to change the pilot pressure acting on the travel fluid passages 45*a* to 45*d*. Specifically, upon being switched to the first mode (normal mode) by the operation switch 202, the controller 25 fixes the opening of the pressure changing unit 201A to the maximum (fully open state) or a predetermined opening in accordance with the control line L10 in FIG. 12A regardless of the amount of operation of the accelerator member 84 to keep the pilot pressure acting on the travel fluid passages 45*a* to 45*d* (the secondary pressure of the operation valves 55*a* to 55*d*) constant.

On the other hand, upon being switched to the second mode (creep mode) by the operation switch 202, the controller 25 sets the opening of the pressure changing unit 201A to be lower than the opening of the pressure changing unit 201A that is set when the control line L10 is adopted, in accordance with the control line L11 in FIG. 12A and the amount of operation of the accelerator member 84, to keep the pilot pressure acting on the travel fluid passages 45*a* to 45*d* (the secondary pressure of the operation valves 55*a* to 55*d*) lower than in the first mode. Further, the controller 25 increases the opening of the pressure changing unit 201A so that the pilot pressure acting on the travel fluid passages 45*a* to 45*d* increases as the amount of operation of the accelerator member 84 increases.

That is, in the second mode (creep mode), as the amount of operation of the accelerator member 84 increases, the opening of the pressure changing unit 201A increases, whereby the pilot pressures acting on the pressure receivers 53*a* and 53*b* of the traveling pumps 53L and 53R can be changed to increase. In addition, the angles of the swash plates of the traveling pumps 53L and 53R are changed to increase the delivery amounts of the hydraulic fluid from the traveling pumps 53L and 53R and increase the rotational speeds of the traveling motors 36L and 36R, whereby the vehicle speed (travel speed) of the working machine 1 can be increased.

When the pressure changing unit 201A in FIG. 15 and the control map illustrated in FIG. 12A are used in combination, the controller 25 may change the control line L10 in accordance with the load of the engine 32 or the difference between the actual rotational speed of the engine 32 and the target engine rotational speed. The load of the engine 32 may be, for example, an opening of a throttle valve detected by a sensor or the like or the load factor of the engine 32.

When the load of the engine 32 is equal to or greater than a first threshold, the controller 25 may shift the control line L10 downward (in the pressure reduction direction) to set the secondary pressure of the operation valves 55*a* to 55*d* to a low value. Alternatively, when the difference between the actual rotational speed of the engine 32 and the target engine rotational speed is equal to or greater than a second threshold, the controller 25 may shift the control line L10 downward to set the secondary pressure of the operation valves 55*a* to 55*d* to a low value. In these cases, the controller 25 may shift the control line L10 in the direction of change in the secondary pressure of the operation valves 55*a* to 55*d* in conjunction with anti-stall control for preventing stall of the engine 32.

Alternatively, the controller 25 may perform proportional-integral-derivative (PID) control or proportional-integral (PI) control to shift the control line L10 in FIG. 12A in the vertical axis direction in accordance with the load of the engine 32 or the difference between the actual rotational speed of the engine 32 and the target engine rotational speed to obtain a new control line. Alternatively, the controller 25 may not only shift the control line L10 but also shift the control line L11 in the second mode in the vertical axis direction in a manner similar to that described above.

Further, the controller 25 may use the pressure changing unit 201A in FIG. 15 and the control map in FIG. 12A in combination to change the secondary pressure of the operation valves 55*a* to 55*d* in FIG. 11 (pilot pressures acting on the pressure receivers 53*a* and 53*b* of the traveling pumps 53L and 53R).

Seventh Preferred Embodiment

FIG. 16A is a table illustrating a relationship between an engine rotational speed and an LS differential pressure according to a seventh preferred embodiment. Any one of the hydraulic systems 30A to 30C for the working system illustrated in FIGS. 1A, 1B, 3, and 10A or any one of the hydraulic systems 30D and 30E for the traveling system illustrated in FIGS. 11 and 13 is applicable as a hydraulic system according to the seventh preferred embodiment. The speed adjustment mechanism 200 illustrated in FIG. 15 is also applicable.

In the seventh preferred embodiment, the controller 25 executes automatic idle control to control the driving of the engine 32 to keep the actual rotational speed of the engine 32 low. More specifically, for example, in the automatic idle control, the controller 25 makes the actual rotational speed of the engine 32 match a predetermined target engine rotational speed for the automatic idle control, or adjusts the actual rotational speed of the engine 32 to be equal to or less than the target engine rotational speed for the automatic idle control.

The automatic idle control is started in response to a trigger event, such as leaving the operation member 58 for work or the operation member 159 for travel in non-operating status for a certain period of time or more, shutting off supply of pilot fluid to the operation device 52 or 54 by an unload valve (not illustrated) (hydraulic lock state), operating a parking switch (not illustrated) to provide a command to activate a braking device (not illustrated), or operating an operation switch to provide a command to execute the automatic idle control.

In response to an operation of one of the operation members 58, 159, and 84 during the execution of the automatic idle control, the controller 25 stops the automatic idle control and returns to a normal state. In the normal state, the controller 25 controls the rotational speed of the engine 32 so as to match a set rotational speed of the engine 32, which is set by any one of the operation members 86, 159, and 84 operable by the driver with their hand (hereinafter referred to as the hand operation members 86, 159, and 84) or set by the accelerator member 84.

Further, the controller 25 sets or changes the LS differential pressure in conjunction with the automatic idle control. For example, while the controller 25 is not executing the automatic idle control (normal time), as indicated by the first and second columns from the left in FIG. 16A, the controller 25 sets the LS differential pressure in accordance with the engine rotational speed (actual rotational speed). Then, the controller 25 causes the hydraulic control unit 75 or any one of the hydraulic control units 75A to 75C to realize the set LS differential pressure.

While the controller 25 is executing the automatic idle control, as indicated by the first and third columns from the left in FIG. 16A, the controller 25 sets the LS differential pressure to a fixed value (for example, 1.5 MPa) even if the engine rotational speed (actual rotational speed) changes. The fixed value of the LS differential pressure is the same as the value of the LS differential pressure that is set when the engine rotational speed (actual rotational speed) is maximum as described in the first preferred embodiment and the like (see the control line L1 in FIG. 2A, FIG. 2B, and the like).

That is, during the execution of the automatic idle control, the controller 25 sets a large predetermined differential pressure (the third column from the left in FIG. 16A) that is equal to or greater than a predetermined differential pressure (the second column from the left in FIG. 16A) corresponding to the engine rotational speed (actual rotational speed) as the LS differential pressure, and fixes the set LS differential pressure even if the engine rotational speed changes. Then, the controller 25 causes the hydraulic control unit 75 or any one of the hydraulic control units 75A to 75C to realize and maintain the set LS differential pressure (fixed value).

With the operation described above, even if the automatic idle control is executed and the actual rotational speed of the engine 32 is decreased, a pressure (the LS differential pressure in the third column from the left in FIG. 16A) equal to or greater than a predetermined pressure (the LS differential pressure in the second column from the left in FIG. 16A) corresponding to the actual rotational speed is set as the LS differential pressure, and the set LS differential pressure is realized. Accordingly, in response to an operation of the operation member 58, the hydraulic actuators 14 or 15 or any other hydraulic actuator can be quickly activated to immediately perform work with the working device 4 in accordance with the operating state of the joystick 159. This makes it possible to improve the accuracy of horsepower control of the working system of the working machine 1.

During the execution of the automatic idle control, a predetermined pressure corresponding to a maximum rotational speed of the engine 32 (the LS differential pressure in the bottom row of the second column from the left in FIG. 16A) is set as the LS differential pressure, and the set LS differential pressure is realized. This makes it possible to more quickly activate the hydraulic actuators 14 or 15 or any other hydraulic actuator, the working device 4, and the like in response to an operation of the operation member 58.

In another example, during the execution of the automatic idle control, the controller 25 may set an LS differential pressure corresponding to the rotational speed (target engine rotational speed) of the engine 32 that is set by the accelerator member 84. Accordingly, a pressure equal to or greater than a predetermined pressure corresponding to the actual rotational speed of the engine 32 can be set as the LS differential pressure.

The controller 25 may change the primary pressure or the secondary pressure (traveling primary pressure or secondary pressure) of the operation valves 55 (the operation valves 55A to 55D in FIG. 11 or the operation valves 55*a* to 55*d* in FIG. 13) in conjunction with the automatic idle control. The relationship between the engine rotational speed and the traveling primary pressure or the secondary pressure in this case is illustrated in a table in FIG. 16B.

In an example illustrated in FIG. 16B, while the controller 25 is not executing the automatic idle control (normal time), as indicated by the first and second columns from the left in FIG. 16B, the controller 25 sets the traveling primary pressure or the secondary pressure in accordance with the engine rotational speed (actual rotational speed).

While the controller 25 is executing the automatic idle control, as indicated by the first and third columns from the left in FIG. 16B, the controller 25 sets the traveling primary pressure or the secondary pressure of the operation valves 55 to a fixed value (for example, 2.6 MPa) even if the engine rotational speed (actual rotational speed) changes. The fixed value of the primary pressure or the secondary pressure of the operation valves 55 is the same as the value (2.6 MPa) of the primary pressure or the secondary pressure of the operation valves 55, which is set when the engine rotational speed (actual rotational speed) is maximum (2600 rpm) (see the bottom row of the second column from the left in FIG. 16B).

That is, while executing the automatic idle control, the controller 25 causes the pressure changing unit (201, 201A, or 55*a* to 55*d*) described above to set the primary pressure or the secondary pressure (pilot pressure) of the operation valves 55*a* to 55*d* to a large predetermined pressure equal to or greater than a predetermined pressure corresponding to the engine rotational speed, and fixes (maintains) the set pressure even if the engine rotational speed changes. Then, the controller 25 causes the pressure changing unit (201, 201A, or 55*a* to 55*d*) to realize and maintain the set primary or secondary pressure (fixed value).

With the operation described above, even if the automatic idle control is executed and the actual rotational speed of the engine 32 is decreased, a pressure (the pressure in the third column from the left in FIG. 16B) equal to or greater than a predetermined pressure (the pressure in the second column from the left in FIG. 16B) corresponding to the actual rotational speed is set as the primary or secondary pressure of the operation valves 55, and the set primary or secondary pressure is realized. Accordingly, in response to an operation of the joystick 159, the traveling pumps 53L and 53R and the traveling motors 36L and 36R can be quickly activated (caused to react) to immediately allow the working machine 1 to travel using the traveling device 5 in accordance with the operating state of the joystick 159. The accuracy of horsepower control of the traveling system of the working machine 1 can be improved.

During the execution of the automatic idle control, a predetermined pressure corresponding to a maximum rotational speed of the engine 32 (the pressure in the bottom row of the second column from the left in FIG. 16B) is set as the primary or secondary pressure of the operation valves 55, and the set primary or secondary pressure is realized. This makes it possible to more quickly activate the traveling pumps 53L and 53R, the traveling motors 36L and 36R, the traveling device 5, and the like in accordance with the operating state of the joystick 159.

In another example, during the execution of the automatic idle control, the controller 25 may set the primary or secondary pressure of the operation valves 55 corresponding to the rotational speed (target engine rotational speed) of the engine 32 that is set by the accelerator member 84. Accordingly, a pressure equal to or greater than a predetermined pressure corresponding to the actual rotational speed of the engine 32 can be set as the primary or secondary pressure of the operation valves 55. In place of the pressure changing unit 201, 201A, or 55*a* to 55*d*, an activation valve 167 (FIG. 18) may be used to change the primary pressure or the secondary pressure of the operation valves 55.

The controller 25 changes a control signal (current value) to be input to the pressure changing unit (201, 201A, or 55*a* to 55*d*) described above to change the primary pressure of the operation valves 55.

As illustrated in FIG. 13 and the like, the operation valves 55 may include the solenoid proportional valves 55*a* to 55*d*, and the controller 25 may change, for example, a control signal (applied current value) to be input to the solenoid proportional valves 55*a* to 55*d* to change the secondary pressure of the solenoid proportional valves 55*a* to 55*d*. Alternatively, as illustrated in FIG. 15, the pressure changing unit 201A disposed in the travel fluid passages 45*a* to 45*d* may include a variable relief valve, and the controller 25 may change a control signal to be input to the variable relief valve (i.e., the pressure changing unit 201A) to change the secondary pressure of the solenoid proportional valves 55*a* to 55*d*.

Figure 17:
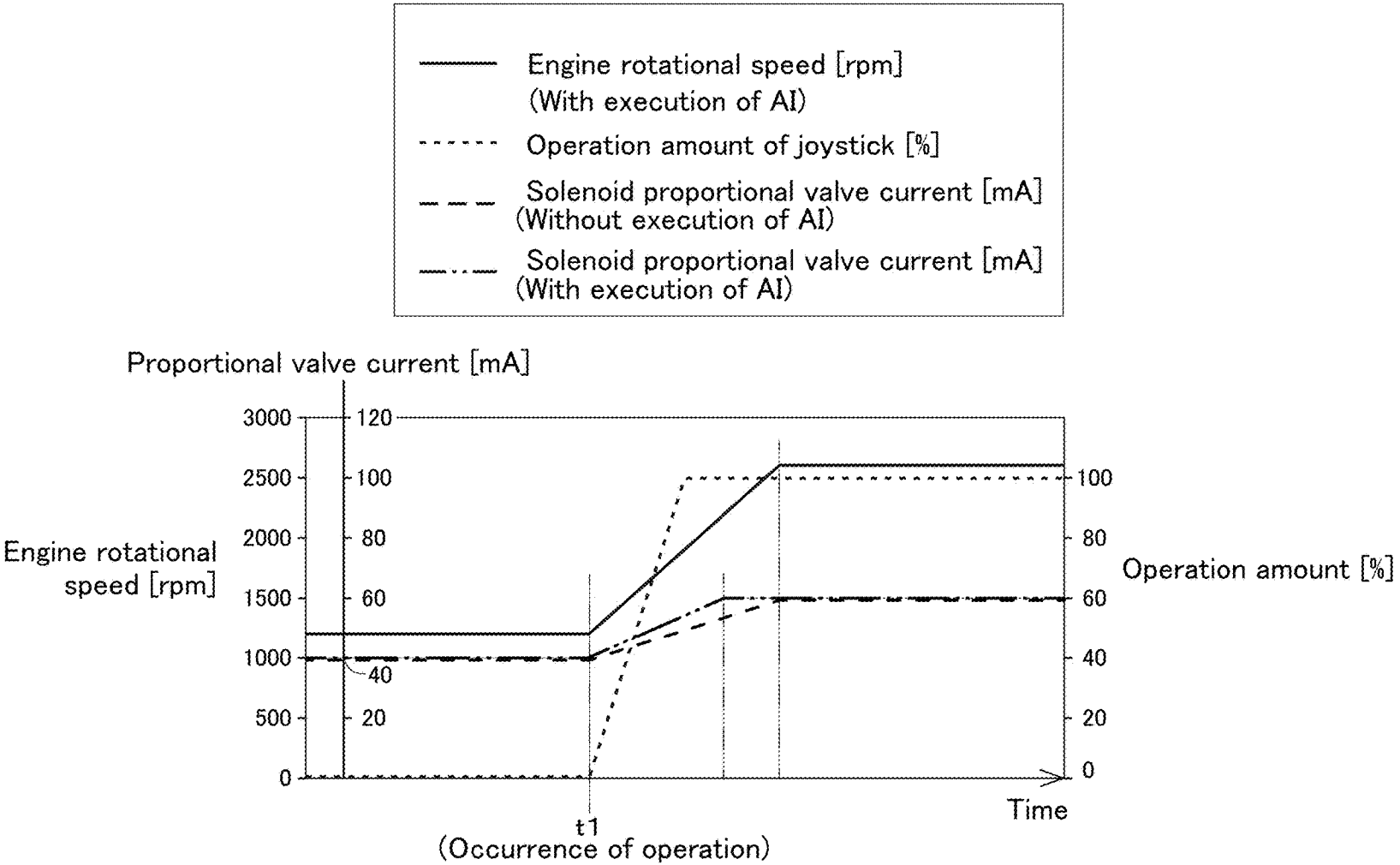
FIG. 17 is a diagram illustrating a relationship among an amount of operation of an operation member, an engine rotational speed, and a proportional valve current according to the seventh preferred embodiment of the present invention.

To cause the solenoid proportional valves (the pressure changing unit 201, 201A, or 55*a* to 55*d*) to change the traveling primary pressure or the traveling secondary pressure (pilot pressure) in accordance with the amount of operation of the operation member 159, 84, or 58 for travel, the controller 25 may change a current value (control signal) to be input to the solenoid proportional valves (the pressure changing unit 201, 201A, or 55*a* to 55*d*) between when the automatic idle control is being executed and the normal time during which the automatic idle control is not being executed. In this case, in an example, the relationship among the amount of operation of the joystick 159, the engine rotational speed, and the current to be input to the solenoid proportional valve 201 is illustrated in a graph in FIG. 17. In FIG. 17, the horizontal axis represents time.

As illustrated in FIG. 17, when the joystick 159 is operated at time t1 (amount of operation>0%) during the execution of the automatic idle control (with execution of AI), the controller 25 sets the current to be input to the solenoid proportional valve 201 thereafter (after the time t1 in the horizontal axis in FIG. 17) in a manner indicated by a two dot chain line in FIG. 17 in accordance with the amount of operation of the joystick 159 indicated by a dotted line in FIG. 17. That is, in response to an operation of the joystick 159 during the execution of the automatic idle control, the current value (indicated by the two dot chain line in FIG. 17) to be input from the controller 25 to the solenoid proportional valve 201 is steeply larger than a current value (indicated by a broken line in FIG. 17) to be input from the controller 25 to the solenoid proportional valve 201 in response to an operation of the joystick 159 at the normal time during which the automatic idle control is not being executed.

Thus, the input current (indicated by the two dot chain line in FIG. 17) from the controller 25 to the solenoid proportional valve 201 in response to an operation of the joystick 159 during the execution of the automatic idle control matches a current value corresponding to the amount of operation of the joystick 159 more quickly than the input current (indicated by the broken line in FIG. 17) from the controller 25 to the solenoid proportional valve 201 in response to an operation of the joystick 159 at the normal time. In addition, the primary pressure or the secondary pressure of the operation valves 55 in response to an operation of the joystick 159 during the execution of the automatic idle control matches a pressure corresponding to the amount of operation of the joystick 159 more quickly than the primary pressure or the secondary pressure of the operation valves 55 in response to an operation of the joystick 159 at the normal time.

With the operation described above, even if the automatic idle control is executed and the actual rotational speed of the engine 32 is decreased, in response to an operation of the joystick 159, the traveling pumps 53L and 53R and the traveling motors 36L and 36R can be quickly caused to react to immediately allow the working machine 1 to travel using the traveling device 5 in accordance with the operating state of the joystick 159. The accuracy of horsepower control of the traveling system of the working machine 1 can be improved.

Further, in response to an operation of the joystick 159 during the execution of the automatic idle control, the controller 25 may apply a high voltage to the solenoid proportional valve 201 and input a current value corresponding to the amount of operation of the joystick 159 to the solenoid proportional valve 201. Accordingly, the traveling pumps 53L and 53R and the traveling motors 36L and 36R are controlled by the pilot pressure corresponding to the amount of operation of the joystick 159, whereby the working machine 1 can be quickly returned from the automatic idle state to the normal state.

The timing at which the input current (indicated by the broken line in FIG. 17) from the controller 25 to the solenoid proportional valve 201 in response to an operation of the joystick 159 at the normal time during which the automatic idle control is not being executed matches the current value corresponding to the amount of operation of the joystick 159 is substantially the same as the timing at which the actual rotational speed of the engine 32 (not illustrated in FIG. 17) in response to an operation of the joystick 159 at the normal time matches the rotational speed corresponding to the amount of operation of the joystick 159.

Further, the input current from the controller 25 to the solenoid proportional valve 201 in response to an operation of the joystick 159 to the maximum (100%) during the execution of the automatic idle control may be set to be the same value as that of the input current from the controller 25 to the solenoid proportional valve 201 in response to an operation of the joystick 159 to the maximum (100%) at the normal time.

The preferred embodiment described above presents an example in which the primary pressure of the operation valves 55 is changed by the solenoid proportional valve 201 in accordance with the amount of operation of the operation member 159 for travel. However, the present invention is not limited to this example. For example, a solenoid proportional valve may be provided that changes the primary pressure of the control valves 56 (the pilot pressure of the pilot fluid flowing into the control valves 56) or the secondary pressure of the control valves 56 (the pilot pressure of the pilot fluid flowing out of the control valves 56) in accordance with the amount of operation of the operation member 58 for work (FIG. 1A and the like). In this case, for example, the control map illustrated in FIG. 17 may be applied to set or change the primary pressure or the secondary pressure of the control valves 56.

In the first preferred embodiment illustrated in FIGS. 1A to 2B, the coefficient α in Equation (2) to calculate the second control line L2 (FIG. 2A) is changed between the travel-priority mode and the work-priority mode of the working machine 1. Additionally, for example, the coefficient α in Equation (2) may be changed in conjunction with the activation valve 167 illustrated in FIG. 18.

Eighth Preferred Embodiment

Figure 18:
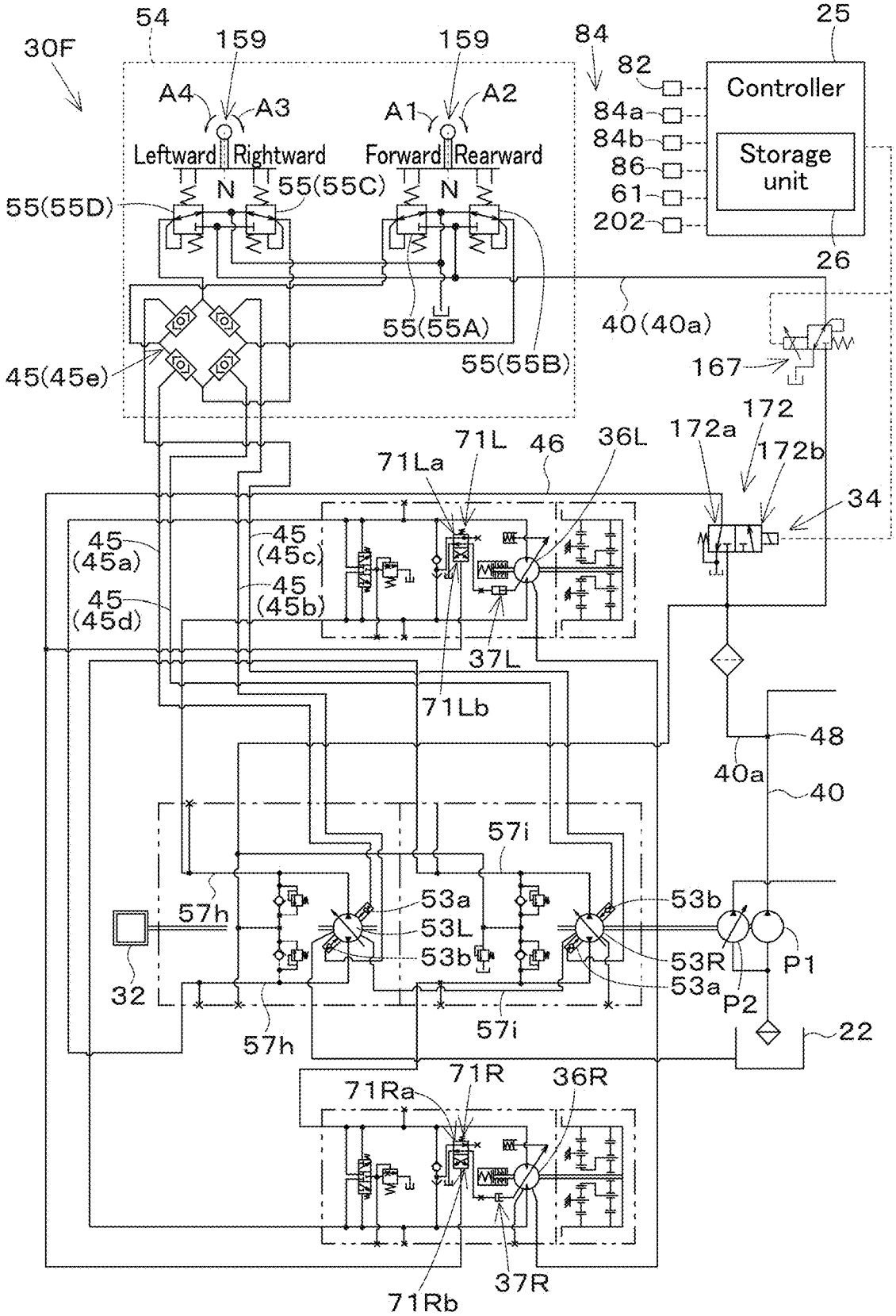
FIG. 18 is an overall view of a hydraulic system for a traveling system of a working machine according to an eighth preferred embodiment of the present invention.

FIG. 18 is an overall view of a hydraulic system 30F for the traveling system of the working machine 1 according to an eighth preferred embodiment. The hydraulic system 30F illustrated in FIG. 18 is provided with the activation valve 167 in place of the pressure changing unit 201 of the speed adjustment mechanism 200 illustrated in FIG. 11. The other configuration of the hydraulic system 30F is the same as that of the hydraulic system 30D illustrated in FIG. 11. The activation valve 167 is a solenoid proportional valve (solenoid valve) and is disposed in the third fluid passage 40. The activation valve 167 is a valve (also referred to as an anti-stall valve) to prevent an engine stall of the working machine 1. The activation valve 167 changes the pilot pressure of the pilot fluid acting on the operation valves 55 (55A to 55D) (the primary pressure of the operation valves 55, that is, the traveling primary pressure).

The controller 25 controls the opening of the activation valve 167 to execute control to prevent an unintentional stop (engine stall) of the engine 32, that is, anti-stall control. In the anti-stall control, for example, when a drop rotational speed, which is a difference between a target engine rotational speed set by the accelerator member 84 and an actual rotational speed of the engine 32, which is detected by the first measurement device 82, is equal to or greater than a threshold, the controller 25 reduces the output of the traveling pumps 53L and 53R (a force for delivering the hydraulic fluid) to prevent an engine stall.

The activation valve 167 is disposed in the third fluid passage 40 through which the pilot fluid flows. The controller 25 changes the opening of the activation valve 167 to change the pilot pressures acting on the pressure receivers 53*a* and 53*b* of the traveling pumps 53L and 53R. The controller 25 changes a control signal (which may be a current signal or a voltage signal) to be input to the activation valve 167 to change the opening of the activation valve 167.

In response to the change in the opening of the activation valves 167, the pilot pressure (traveling primary pressure) acting on the operation valves 55 (55A to 55D) from the activation valve 167 is changed, and the pilot pressures acting on the pressure receivers 53*a* and 53*b* of the traveling pumps 53L and 53R are also changed. In addition, the angles of the swash plates of the traveling pumps 53L and 53R are changed, the delivery amounts of the hydraulic fluid from the traveling pumps 53L and 53R are changed, and the rotational speeds of the traveling motors 36L and 36R are also changed. That is, the controller 25 changes the opening of the activation valve 167 to change the traveling primary pressure, and controls the delivery amounts of the hydraulic fluid from the traveling pumps 53L and 53R and the output of the traveling motors 36L and 36R. This makes it possible to prevent the occurrence of an engine stall of the working machine 1 and improve the accuracy of horsepower control of the traveling system of the working machine 1.

In addition, the hydraulic system 30F for the traveling system illustrated in FIG. 18 is combined with any of the hydraulic systems 30A to 30C for the working system illustrated in FIGS. 1A, 1B, 3, and 7A to 10A, in which case the controller 25 changes the opening of the activation valve 167 to change the pilot pressure acting on the third fluid passage 40, thereby also changing the pilot pressure acting on any other fluid passage connected to the third fluid passage 40, such as the fluid passage 41, 41B, 41C, 41D, or 41A. That is, the pilot pressure to activate the opening changing unit 76 is changed. Accordingly, the activation states of the opening changing unit 76, the flow rate compensation valve 72, and the swash-plate variable unit 73 are changed, and in response to the change of the activation states, the angle of the swash plate of the second hydraulic pump P2, the output of the second hydraulic pump P2 (the delivery amount of the hydraulic fluid from the second hydraulic pump P2), and the LS differential pressure are changed. As described above, the controller 25 can also change the LS differential pressure by controlling activation of the activation valve (solenoid valve) 167, and can improve the accuracy of horsepower control of the working system of the working machine 1.

In addition, the hydraulic system 30D, 30E, or the like for the traveling system illustrated in FIG. 11, 13, or 15 is combined with any of the hydraulic systems 30A to 30C for the working system illustrated in FIGS. 1A, 1B, 3, and 7A to 10A, which allows the controller 25 to also change the LS differential pressure by controlling activation of the solenoid valve 201, 55*a* to 55*d*, or 201A and to improve the accuracy of horsepower control of the working system of the working machine 1.

Figure 19:
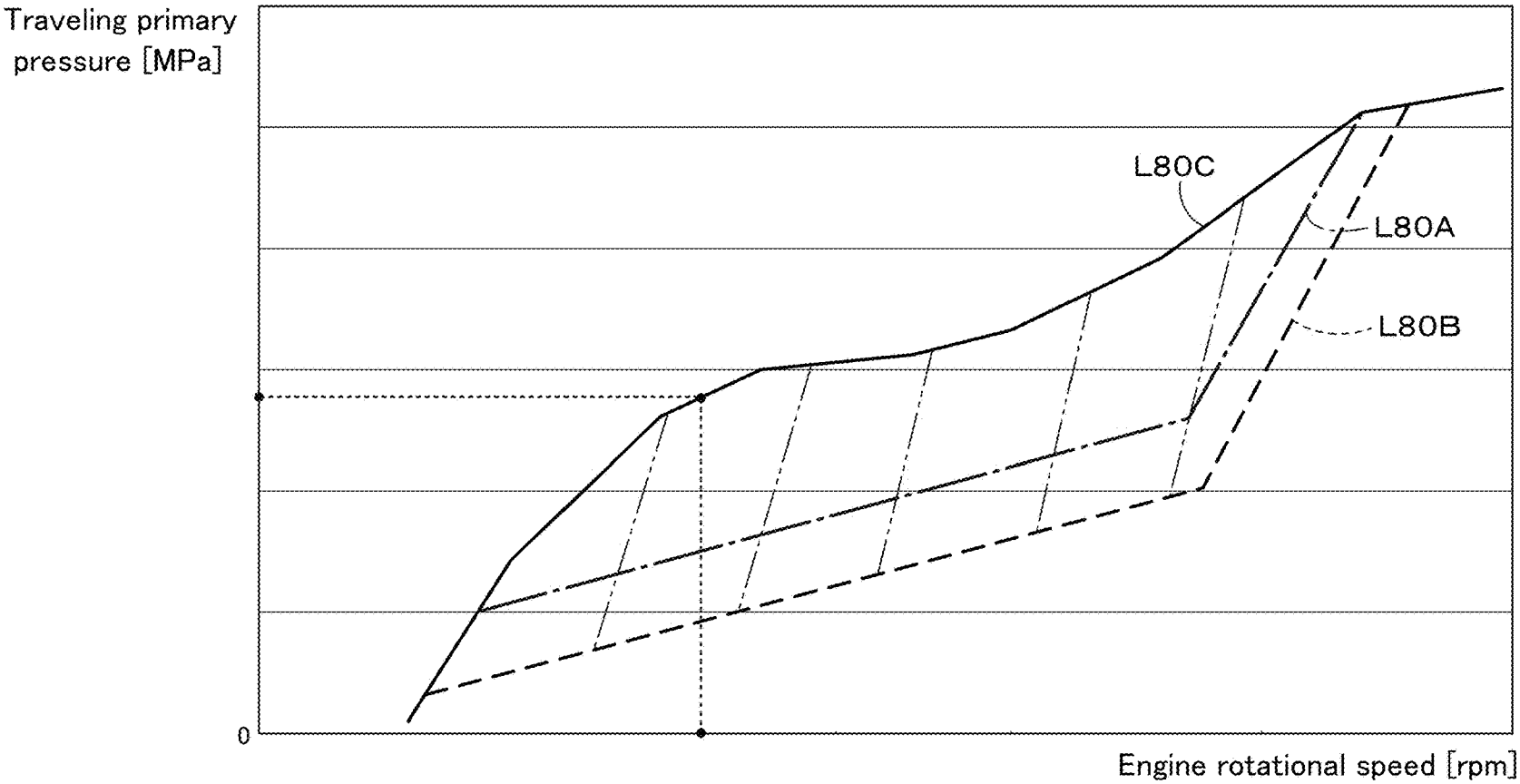
FIG. 19 is a graph illustrating a relationship between an engine rotational speed and a traveling primary pressure according to the eighth preferred embodiment of the present invention.

FIG. 19 is a graph illustrating a relationship between the engine rotational speed and the traveling primary pressure according to the eighth preferred embodiment. Data of a control map representing the relationship illustrated in FIG. 19 is stored in advance in the storage unit 26 of the controller 25. The traveling primary pressure is the pilot pressure of the pilot fluid flowing from the activation valve 167 toward the operation device 54 in the third fluid passage 40. In other words, the traveling primary pressure is the primary pressure of the pilot fluid acting on the plurality of operation valves 55A, 55B, 55C, and 55D in the operation member 159 that performs the traveling operation of the working machine 1. A plurality of control lines L80A, L80B, and L80C illustrated in FIG. 19 are control data to be used by the controller 25 to set the traveling primary pressure.

For example, during the execution of the anti-stall control, when the drop rotational speed, which is the difference between the target engine rotational speed and the actual rotational speed of the engine 32, is less than a predetermined threshold, the controller 25 sets the traveling primary pressure on the basis of the control line L80C and the actual rotational speed. More specifically, as indicated by thin dotted lines in FIG. 19, a traveling primary pressure at an intersection between the rotational speed (actual rotational speed) of the engine 32 and the control line L80 is set. The control line L80C is shifted in a direction in which the traveling primary pressure increases (upward in FIG. 19) compared with the control line L80A. Accordingly, when the controller 25 adopts the control line L80C, the traveling primary pressure is set to be higher than when the controller 25 adopts the control line L80A or L80B.

On the other hand, during the execution of the anti-stall control, when the drop rotational speed of the engine 32 is equal to or greater than the threshold, the controller 25 sets the traveling primary pressure on the basis of the actual rotational speed of the engine 32 and one of the control lines L80A and L80B. The control line L80B is shifted in a direction in which the traveling primary pressure decreases (downward in FIG. 19) compared with the control line L80A. Accordingly, when the controller 25 adopts the control line L80B, the traveling primary pressure is set to be lower than when the controller 25 adopts the control line L80A or L80C.

For example, when the drop rotational speed of the engine 32 is equal to or greater than the threshold and is equal to or greater than a predetermined value greater than the threshold, the controller 25 sets the traveling primary pressure on the basis of the control line L80B and the actual rotational speed of the engine 32. When the drop rotational speed of the engine 32 is equal to or greater than the threshold and is less than the predetermined value, the controller 25 sets the traveling primary pressure on the basis of the control line L80A and the actual rotational speed of the engine 32.

In another example, the controller 25 may adopt one of the control lines L80A, L80B, and L80C on the basis of a variable other than the drop rotational speed. For example, when the working machine 1 is in the travel-priority mode, the controller 25 adopts the control line L80A regardless of the drop rotational speed, and adopts the largest candidate coefficient value among a plurality of different candidate coefficient values stored in advance as the coefficient $\alpha$ in Equations (2) to (4) presented in the first preferred embodiment. When the working machine 1 is in the work-priority mode, the controller 25 adopts the control line L80B regardless of the drop rotational speed, and adopts the smallest candidate coefficient value as the coefficient $\alpha$.

In addition, a slight travel-priority mode in which travel is slightly prioritized over work and a slight work-priority mode in which work is slightly prioritized over travel may be provided between the travel-priority mode and the work-priority mode. In this case, when the working machine 1 is in the slight travel-priority mode, the controller 25 adopts the control line L80A and adopts, as the coefficient $\alpha$, a candidate coefficient value that is smaller than the candidate coefficient value adopted in the travel-priority mode and larger than the candidate coefficient value adopted in the work-priority mode. When the working machine 1 is in the slight work-priority mode, the controller 25 adopts the control line L80B and adopts, as the coefficient $\alpha$, a candidate coefficient value that is smaller than the candidate coefficient value adopted in the slight travel-priority mode and larger than the candidate coefficient value adopted in the work-priority mode.

As described above, the control line L80A or L80B is adopted and the coefficient $\alpha$ is changed regardless of the drop rotational speed in accordance with the implementation of the mode indicating which of the travel and the work of the working machine 1 is to be prioritized. As a result, the controller 25 can calculate the second control line L2 (FIG. 2A) on the basis of the coefficient $\alpha$ in accordance with any one of the Equations (2) to (4) above. When the actual rotational speed of the engine 32 is lower than the target engine rotational speed or when the actual rotational speed is lower than a rotational speed obtained by subtracting a predetermined value from the target engine rotational speed, the controller 25 can set or change the LS differential pressure on the basis of the second control line L2 and the actual rotational speed of the engine 32.

That is, the controller 25 can set or change the LS differential pressure in accordance with the priority state of the travel and work of the working machine 1 and the actual rotational speed of the engine 32, and can change the delivery amount of the hydraulic fluid from the second hydraulic pump P2 in accordance with the LS differential pressure. Further, the controller 25 can set the traveling primary pressure on the basis of the control line L80A, L80B, or L80C and the actual rotational speed of the engine 32, and can change the delivery amounts of the hydraulic fluid from the traveling pumps 53L and 53R in accordance with the traveling primary pressure. As a result, the accuracy of horsepower control of the working system and the traveling system of the working machine 1 can be improved.

Ninth Preferred Embodiment

Figure 20A:
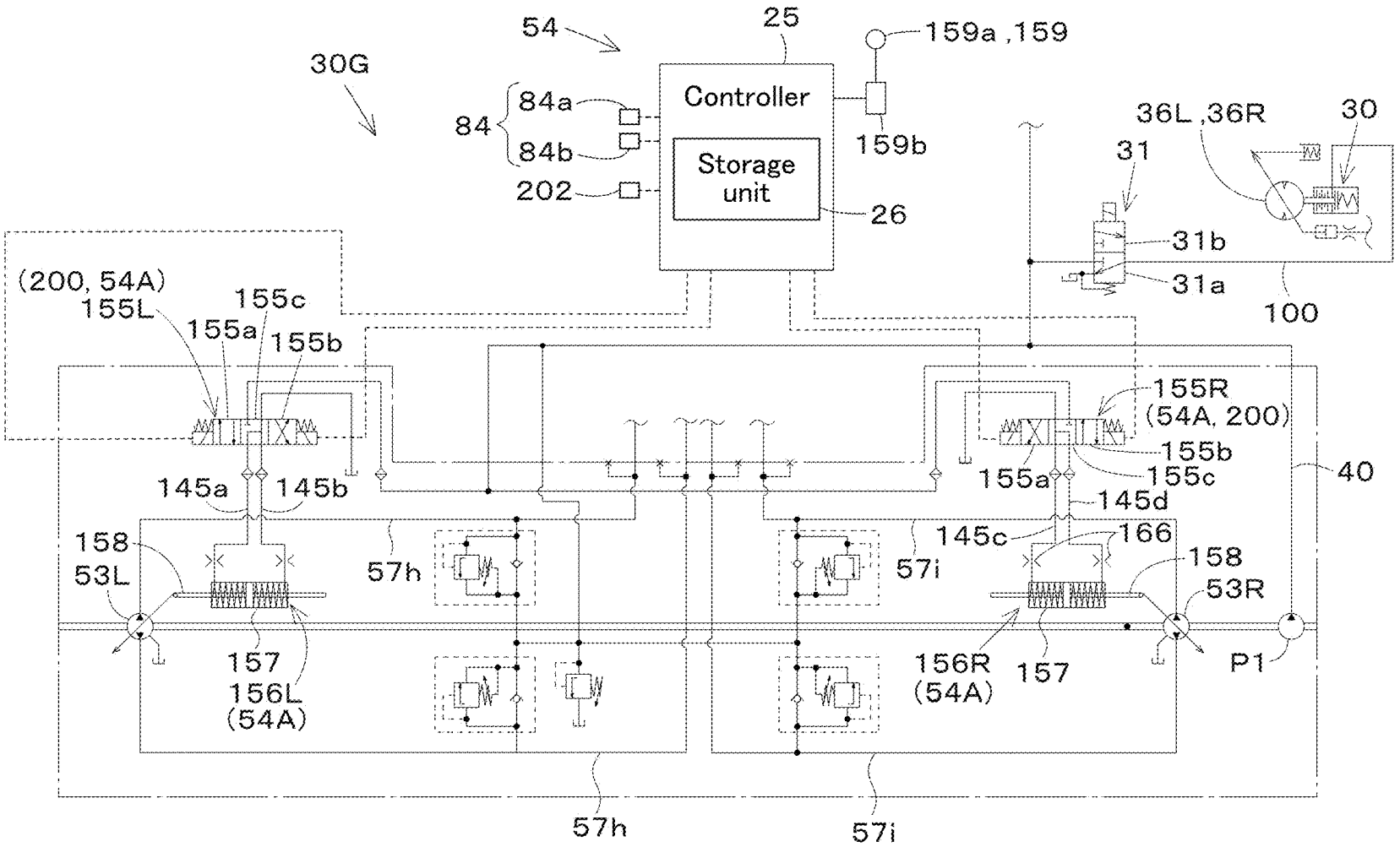
FIG. 20A is a diagram illustrating a main portion of a hydraulic system for a traveling system of a working machine according to a ninth preferred embodiment of the present invention.

FIG. 20A is a diagram illustrating a main portion of a hydraulic system 30G for the traveling system of the working machine 1 according to a ninth preferred embodiment. The hydraulic system 30G includes, as an operation device 54A for travel and an adjustment mechanism 200, operation valves 155L and 155R and hydraulic regulators 156L and 156R. The hydraulic system 30G further includes elements (not illustrated in FIG. 20A) of the traveling system of the working machine 1, such as the controller 25 and the traveling motors 36L and 36R described above, in addition to the configuration illustrated in FIG. 20A.

Each of the hydraulic regulators 156L and 156R includes a supply chamber 157 to which the hydraulic fluid can be supplied, and a piston rod 158 disposed in the supply chamber 157. The piston rod 158 of the hydraulic regulator 156L is coupled to the swash plate of the first traveling pump 53L. The piston rod 158 of the hydraulic regulator 156R is coupled to the swash plate of the second traveling pump 53R. In response to the activation (linear movement) of the piston rods 158 of the hydraulic regulators 156L and 156R, the angles of the swash plates of the traveling pumps 53L and 53R are changed.

The operation valve 155L is a solenoid proportional valve (solenoid valve) that operates the hydraulic regulator 156L and is switchable among a first position 155*a*, a second position 155*b*, and a neutral position 155*c*. The position of the operation valve 155L is changed in response to movement of a spool of the operation valve 155L in accordance with a control signal output from the controller 25. The operation valve 155L has a first port connected to the supply chamber 157 of the hydraulic regulator 156L through a first travel fluid passage 145*a*. The operation valve 155L has a second port connected to the supply chamber 157 of the hydraulic regulator 156L through a second travel fluid passage 145*b*.

The operation valve 155R is a solenoid proportional valve (solenoid valve) that operates the hydraulic regulator 156R and is switchable among the first position 155*a*, the second position 155*b*, and the neutral position 155*c*. The position of the operation valve 155R is changed in response to movement of a spool of the operation valve 155R in accordance with a control signal output from the controller 25. The operation valve 155R has a first port connected to the supply chamber 157 of the hydraulic regulator 156R through a fourth travel fluid passage 145*d*. The operation valve 155R has a second port connected to the supply chamber 157 of the hydraulic regulator 156R through a third travel fluid passage 145*c*.

The operation valves 155L and 155R are each switched from the neutral position 155*c* to the first position 155*a* or the second position 155*b* in accordance with a control signal input from the controller 25. The controller 25 inputs a control signal to the operation valve 155L and the operation valve 155R to switch the operation valve 155L and the operation valve 155R to the first position 155*a*. Accordingly, the swash plates of the first traveling pump 53L and the second traveling pump 53R tilt in the directions for forward rotation of the traveling motors 36L and 36R, which enables the first traveling motor 36L and the second traveling motor 36R to rotate forward.

The controller 25 outputs a control signal to the operation valve 155L and the operation valve 155R to switch the operation valve 155L and the operation valve 155R to the second position 155*b*. Accordingly, the swash plates of the first traveling pump 53L and the second traveling pump 53R tilt in the directions for reverse rotation of the traveling motors 36L and 36R, which enables the first traveling motor 36L and the second traveling motor 36R to rotate in reverse.

The controller 25 outputs a control signal to the operation valve 155L and the operation valve 155R to switch the operation valve 155L to the first position 155*a* and switch the operation valve 155R to the second position 155*b*. Accordingly, the swash plate of the first traveling pump 53L tilts in the direction for forward rotation of the first traveling motor 36L, which enables the first traveling motor 36L to rotate forward, and the swash plate of the second traveling motor 36R tilts in the direction for reverse rotation of the second traveling motor 36R, which enables the second traveling pump 53R to rotate in reverse.

The controller 25 outputs a control signal to the operation valve 155L and the operation valve 155R to switch the operation valve 155L to the second position 155*b* and switch the operation valve 155R to the first position 155*a*. Accordingly, the swash plate of the first traveling pump 53L tilts in the direction for reverse rotation of the first traveling motor 36L, which enables the first traveling motor 36L to rotate in reverse, and the swash plate of the second traveling pump 53R tilts in the direction for forward rotation of the second traveling motor 36R, which enables the second traveling motor 36R to rotate forward.

Further, the controller 25 can output a control signal to the operation valves 155L and 155R to change the opening of the operation valves 155L and 155R, each of which is in the first position 155*a* or the second position 155*b*. The controller 25 changes the position or opening of the operation valves 155L and 155R in accordance with the operating states of the operation members 159 and 84, thereby changing the pilot pressure acting on the travel fluid passages 145*a* to 145*d*, that is, the pressure of the pilot fluid to adjust the angles of the swash plates of the traveling pumps 53L and 53R. The hydraulic fluid delivered from the first traveling pump 53L is supplied to the traveling motor 36L described above, and the hydraulic fluid delivered from the second traveling pump 53R is supplied to the traveling motor 36R described above. Even when the operation valves (solenoid valves) 155L and 155R described above are used, the pilot pressures (that is, the traveling primary pressures and the traveling secondary pressures) of the pilot fluid flowing into and out of the operation valves 155L and 155R are changed in the manners illustrated in FIGS. 12A, 12B, and 14A to 14C to change the angles of the swash plates of the traveling pumps 53L and 53R. As a result, the rotation directions and the rotational speeds of the traveling motors 36L and 36R can be changed.

Figure 20B:
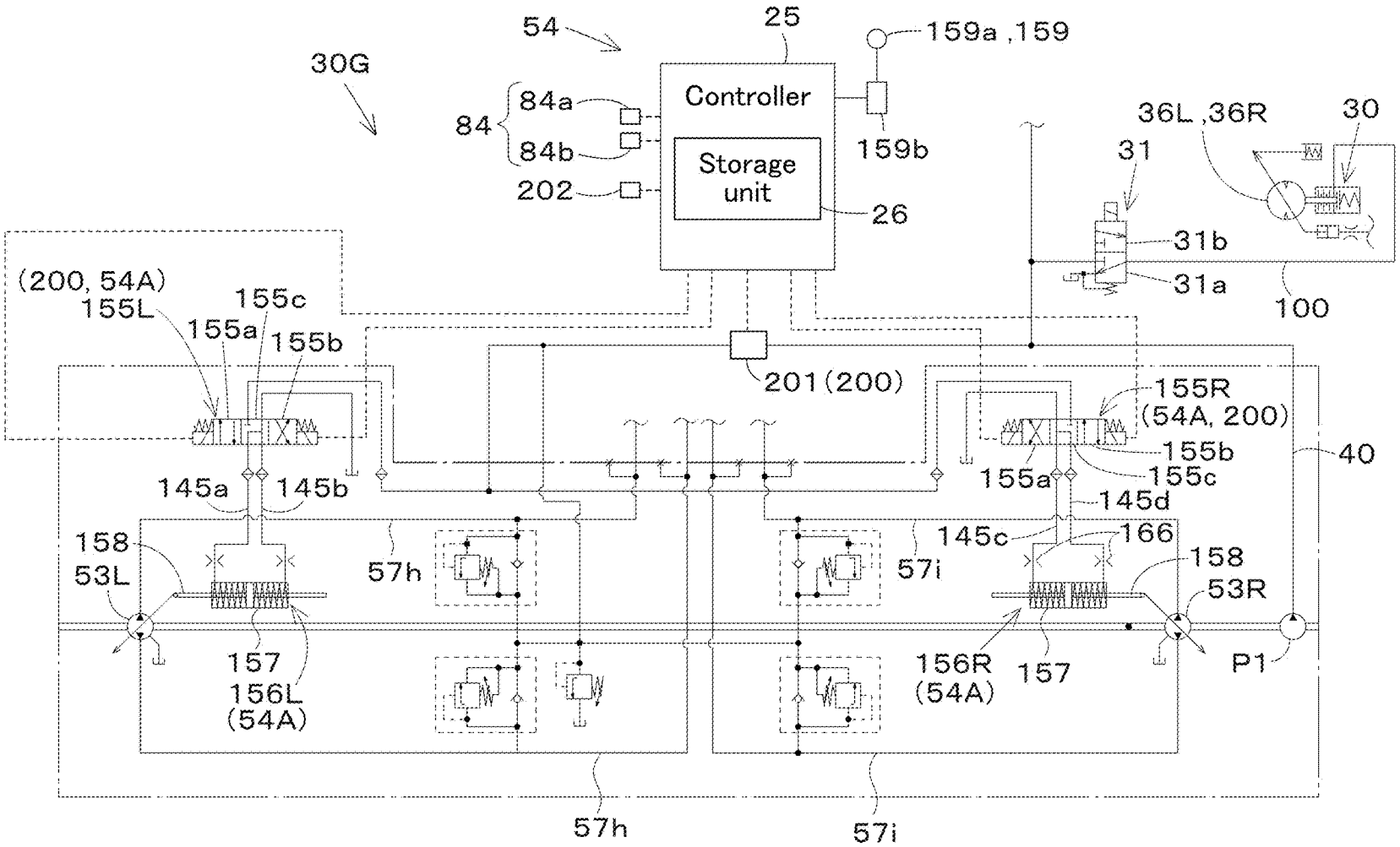
FIG. 20B is a diagram illustrating another example of the hydraulic system for the traveling system of the working machine according to the ninth preferred embodiment of the present invention.

In another example, as illustrated in FIG. 20B, the pressure changing unit 201 may be disposed in the third fluid passage 40 to which the pilot fluid is delivered from the first hydraulic pump P1. In this case, the controller 25 changes the position or opening of the operation valves 155L and 155R or the opening of the pressure changing unit 201 in accordance with the operating states of the operation members 159 and 84 to change the pressure of the pilot fluid to adjust the angles of the swash plates of the traveling pumps 53L and 53R (pilot pressure acting on the travel fluid passages 145*a* to 145*d*). As described above, the use of the operation valves 155L and 155R in combination with the pressure changing unit 201 makes it possible to change the angles of the swash plates of the traveling pumps 53L and 53R and the rotational directions and the rotational speeds of the traveling motors 36L and 36R in a finer change range, and it is possible to improve the accuracy of the speed control of the traveling device 5 and the working machine 1.

In addition, the hydraulic system 30G for the traveling system illustrated in FIG. 20A is combined with any of the hydraulic systems 30A to 30C for the working system illustrated in FIGS. 1A, 1B, 3, and 7A to 10A, in which case the controller 25 changes the positions of the solenoid proportional valves 155L and 155R to change the pilot pressure acting on the third fluid passage 40, thereby also changing the pilot pressure acting on any other fluid passage connected to the third fluid passage 40, such as the fluid passage 41, 41B, 41C, 41D, or 41A. Accordingly, the pilot pressure to activate the opening changing unit 76 is changed, the activation states of the opening changing unit 76, the flow rate compensation valve 72, and the swash-plate variable unit 73 are changed, and in response to the change of the activation states, the angle of the swash plate of the second hydraulic pump P2, the output of the second hydraulic pump P2, and the LS differential pressure are changed. As described above, the controller 25 can also change the LS differential pressure by controlling activation of the solenoid proportional valves (solenoid valves) 155L and 155R, and can improve the accuracy of horsepower control of the working system of the working machine 1.

In the seventh preferred embodiment described above (FIGS. 16A to 17), the controller 25 may calculate the target engine rotational speed for the automatic idle control in accordance with, for example, a set rotational speed of the engine 32, which is set by any one of the hand operation members 86, 159, and 84 operable by the driver with their hand, a reference rotational speed stored in the storage unit 26, and Equation (8) below.

$$\text{Target engine rotational speed for automatic idle control} = (\text{set rotational speed} - \text{reference rotational speed}) \times \text{coefficient} + \text{reference rotational speed} \quad (8)$$

Specifically, for example, when the reference rotational speed is about 1000 rpm, the set rotational speed is about 1500 rpm, and the coefficient is about 0.5, the target engine rotational speed for the automatic idle control is about 1250 rpm (=(1500−1000)×0.5+1000), as given in Equation (8). For example, when the reference rotational speed is about 1000 rpm, the set rotational speed is about 2000 rpm, and the coefficient is about 0.5, the target engine rotational speed for the automatic idle control is about 1500 rpm (=(2000−1000)×0.5+1000), as given in Equation (8).

Any value may be set as the coefficient in Equation (8). For example, when the working machine 1 is used in a cold climate, a value larger than about 0.5 may be set as the coefficient to further increase the target engine rotational speed for the automatic idle control. For example, when the temperature of the cooling water or the hydraulic fluid provided in the working machine 1 becomes higher than a threshold, a value smaller than about 0.5 may be set as the coefficient to further reduce the target engine rotational speed for the automatic idle control.

Further, for example, the lowest engine rotational speed (rotational speed generally referred to as "idling rotational speed") that can be set by any one of the hand operation members 86, 159, and 84 or the accelerator member 84 may be set as the reference rotational speed in Equation (8). Further, the target engine rotational speed for the automatic idle control may be set using a calculation formula or method other than the Equation (8).

In response to an operation of the operation member 58 or 159 while the automatic idle control is performed (during the automatic idle control), the controller 25 terminates the automatic idle control and returns to the normal state. Then, the controller 25 controls the driving of the engine 32, changes the LS differential pressure, changes control lines in various control maps, changes the traveling primary pressure or the secondary pressure, or performs other processing on the basis of the target engine rotational speed set by the accelerator member 84 and the actual rotational speed of the engine 32, which is measured by the first measurement device 82.

Further, after the operation of the operation member 58 or 159, the controller 25 may set the LS differential pressure to a fixed value until the actual rotational speed of the engine 32 reaches the target engine rotational speed, that is, as indicated by a thick solid line in FIG. 17, until the engine rotational speed (actual rotational speed) remains constant after rising. Accordingly, when the automatic idle control has been executed before the operation of the operation member 58 or 159, the actual rotational speed of the engine 32 can be made to match the target engine rotational speed more quickly than when the automatic idle control has not been executed (the normal time) before the operation of the operation member 58 or 159.

In the seventh preferred embodiment, since the travel pressure (the primary pressure and the secondary pressure of the operation valves 55) increases as the current to be input from the controller 25 to the solenoid proportional valve 201 increases, the input current of the solenoid proportional valve 201 and the travel pressure are proportional to each other. In another example, the input current of the solenoid proportional valve 201 and the travel pressure may be inversely proportional to each other. In this case, the controller 25 controls the input current of the solenoid proportional valve 201 so that the travel pressure reaches a desired pressure.

Tenth Preferred Embodiment

In the working machine 1, the automatic idle control and anti-stall control described above may be performed in conjunction with each other. A tenth preferred embodiment presenting this case will be described below.

Figure 21:
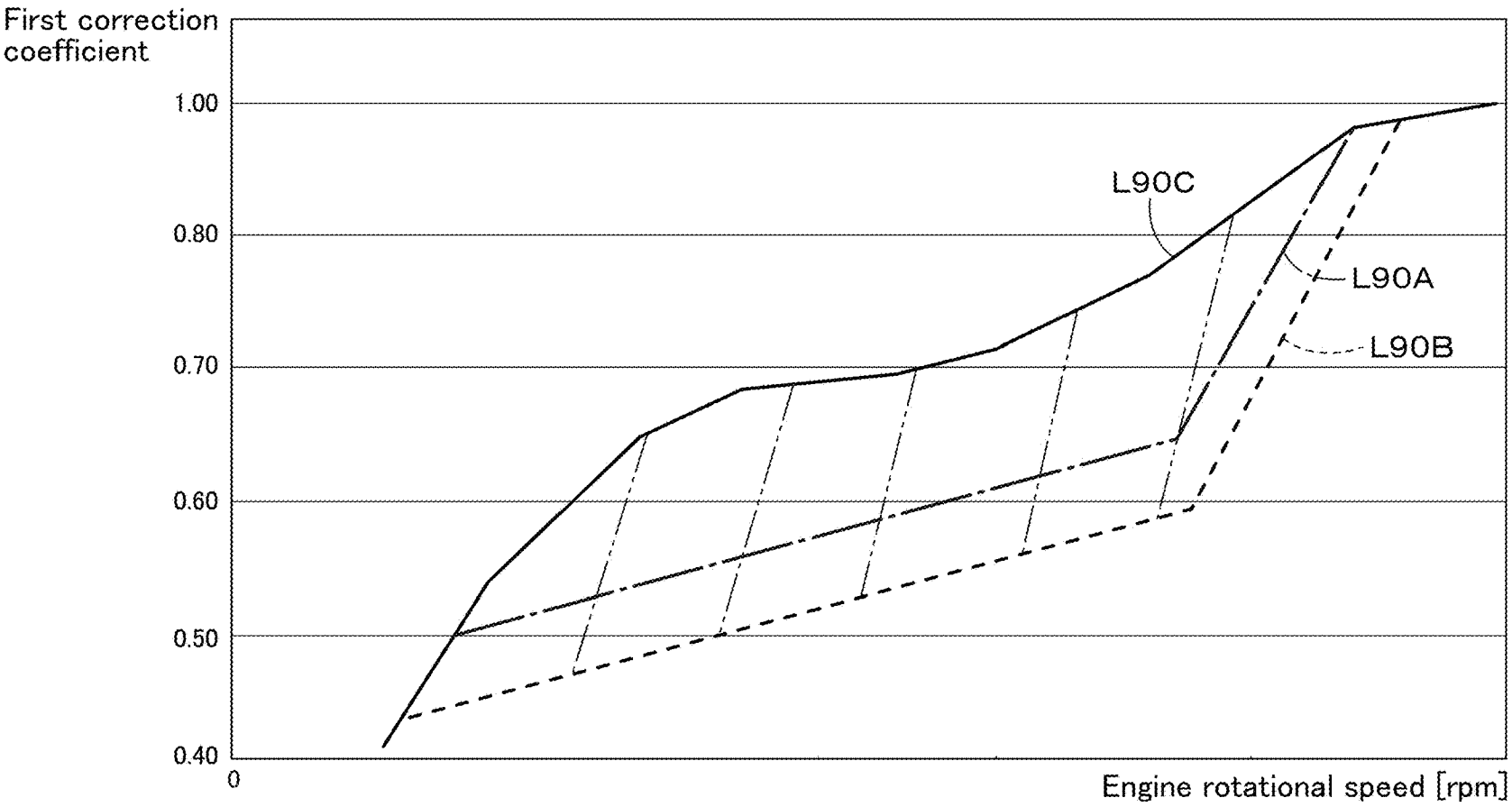
FIG. 21 is a graph illustrating a relationship between an engine rotational speed and a first correction coefficient according to a tenth preferred embodiment of the present invention.

FIG. 21 is a graph illustrating a relationship between an engine rotational speed and a first correction coefficient according to the tenth preferred embodiment. A hydraulic system for the working machine 1 according to the tenth preferred embodiment has the same configuration as the hydraulic system 30E or 30G illustrated in FIG. 13, 20A, or 20B, for example. A control map illustrated in FIG. 21 is used in the controller 25 in place of the control map illustrated in FIG. 19. Data of the control map representing the relationship illustrated in FIG. 21 is stored in advance in the storage unit 26 of the controller 25.

The first correction coefficient is a correction value used to control the traveling pumps 53L and 53R during the execution of the anti-stall control by the working machine 1. More specifically, the first correction coefficient is a current correction value for correcting the current value to be input to the operation valves 55*a* to 55*d* (FIG. 13) or the operation valves 155L and 155R (FIG. 20A or 20B), which are solenoid proportional valves, during the execution of the anti-stall control. In FIG. 21, control lines L90A, L90B, and L90C are control data to obtain a first correction coefficient corresponding to the actual rotational speed of the engine 32.

For example, when both the anti-stall control and the automatic idle control are being executed by the working machine 1, or when only the anti-stall control is being executed and the drop rotational speed of the engine 32 is less than a threshold, the controller 25 sets the first correction coefficient on the basis of the control line L90C and the actual rotational speed. The control line L90C is shifted in a direction in which the first correction coefficient increases (upward in FIG. 21) compared with the control line L90A. Accordingly, when the controller 25 adopts the control line L90C, the first correction coefficient is set to be larger than when the controller 25 adopts the control line L90A or L90B.

On the other hand, when only the anti-stall control among the anti-stall control and the automatic idle control is being executed and the drop rotational speed of the engine 32 is equal to or greater than the threshold, the controller 25 sets the first correction coefficient on the basis of the actual rotational speed of the engine 32 and one of the control lines L90A and L90B. The control line L90B is shifted in a direction in which the first correction coefficient decreases (downward in FIG. 21) compared with the control line L90A. Accordingly, when the controller 25 adopts the control line L90B, the first correction coefficient is set to be smaller than when the controller 25 adopts the control line L90A or L90C.

For example, when the drop rotational speed of the engine 32 is equal to or greater than the threshold and is equal to or greater than a predetermined value greater than the threshold, the controller 25 sets the first correction coefficient on the basis of the control line L90B and the actual rotational speed of the engine 32. When the drop rotational speed of the engine 32 is equal to or greater than the threshold and is less than the predetermined value, the controller 25 sets the first correction coefficient on the basis of the control line L90A and the actual rotational speed of the engine 32.

Figure 22:
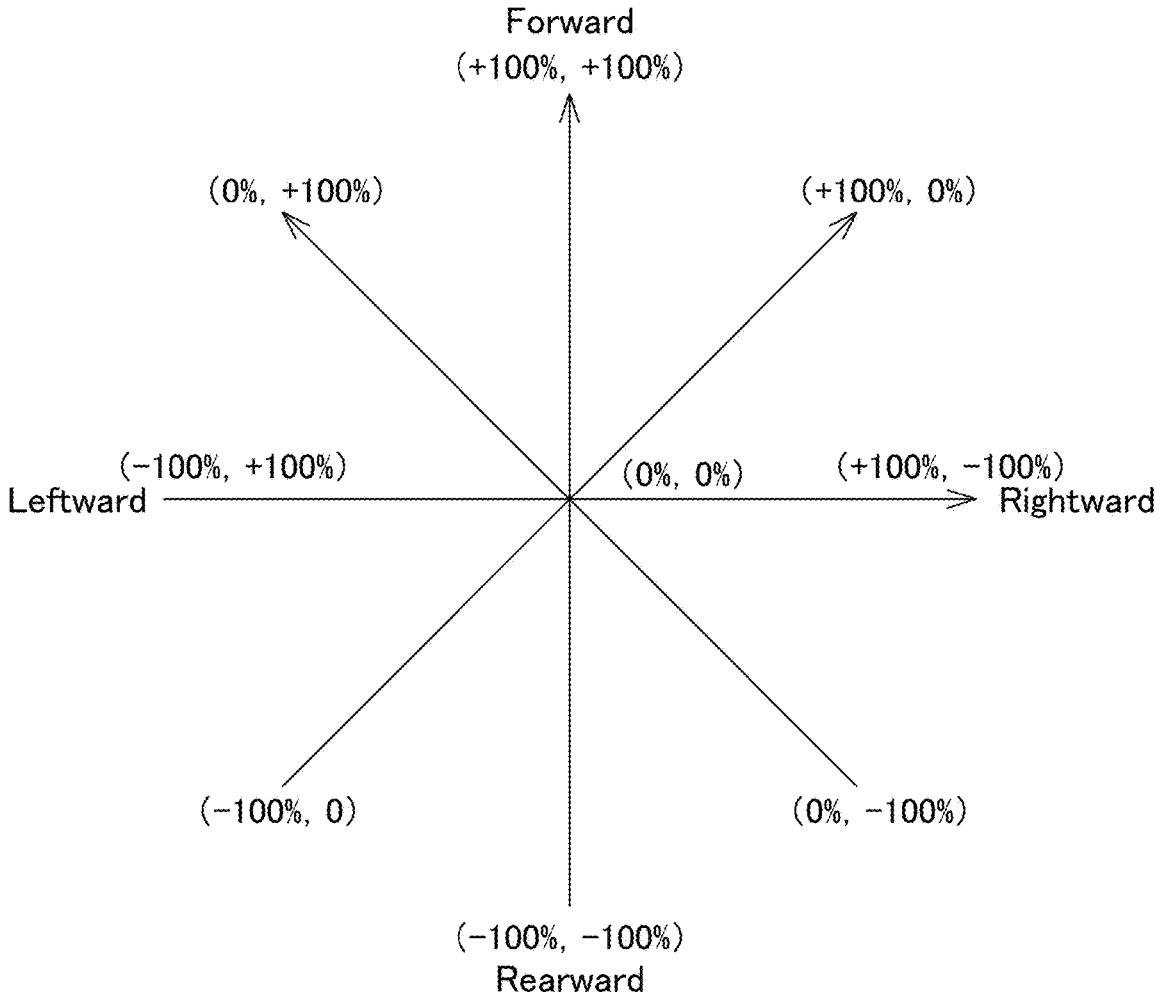
FIG. 22 is a diagram illustrating an example of operation directions and command values of the joystick.

FIG. 22 is a diagram illustrating an example of operation directions and command values of the joystick 159. Directions parallel to arrows illustrated in FIG. 22 indicate an example of operation directions of the joystick 159. Two numerical values (in %) in parentheses illustrated near the tip and tail of each arrow represent an operation direction, an operation amount, and a command value of the joystick 159.

The command value of the joystick 159 is a command value to control the traveling pumps 53L and 53R (specifically, the swash plates thereof) using the operation valves (solenoid proportional valves) 55*a* to 55*d* or 155L and 155R. More specifically, a left numerical value (in %) in parentheses is a command value to control the first traveling pump 53L (i.e., the swash plate thereof), and a right numerical value in the parentheses is a command value to control the second traveling pump 53R (i.e., the swash plate thereof). A plus (+) command value (positive numerical value) indicates a swash plate position of each of the traveling pumps 53L and 53R in the direction for forward rotation of each of the traveling motors 36L and 36R, and a minus (−) command value (negative numerical value) indicates a swash plate position of each of the traveling pumps 53L and 53R in the direction for reverse rotation of each of the traveling motors 36L and 36R.

For example, the values (0%, 0%) indicate that the joystick 159 is in the neutral position (not in operation), the operation amount is "0" (no operation), and the command values to control the traveling pumps 53L and 53R are "0" (no command). For example, the values (+100%, +100%) indicate that the operation direction of the joystick 159 is forward, the operation amount is 100% which is the maximum, and both the command value to control the first traveling pump 53L and the command value to control the second traveling pump 53R are 100% as the maximum signal values for forward rotation of the traveling motors 36L and 36R. That is, for example, when the joystick 159 is maximally operated to the right (+100%, −100%), the operation amount is the maximum, or 100%, the command value for the first traveling pump 53L is 100% as the maximum signal value for forward rotation of the first traveling motor 36L, and the command value for the second traveling pump 53R is 100% as the maximum signal value for reverse rotation of the second traveling motor 36R.

When the joystick 159 is swung in any direction, an electric signal corresponding to the operating state of the joystick 159 is input from the joystick 159 (the electric circuit 159*b* in FIG. 13) to the controller 25. The controller 25 detects the operation direction, the operation amount, and the command value of the joystick 159 on the basis of the electric signal.

Figure 23:
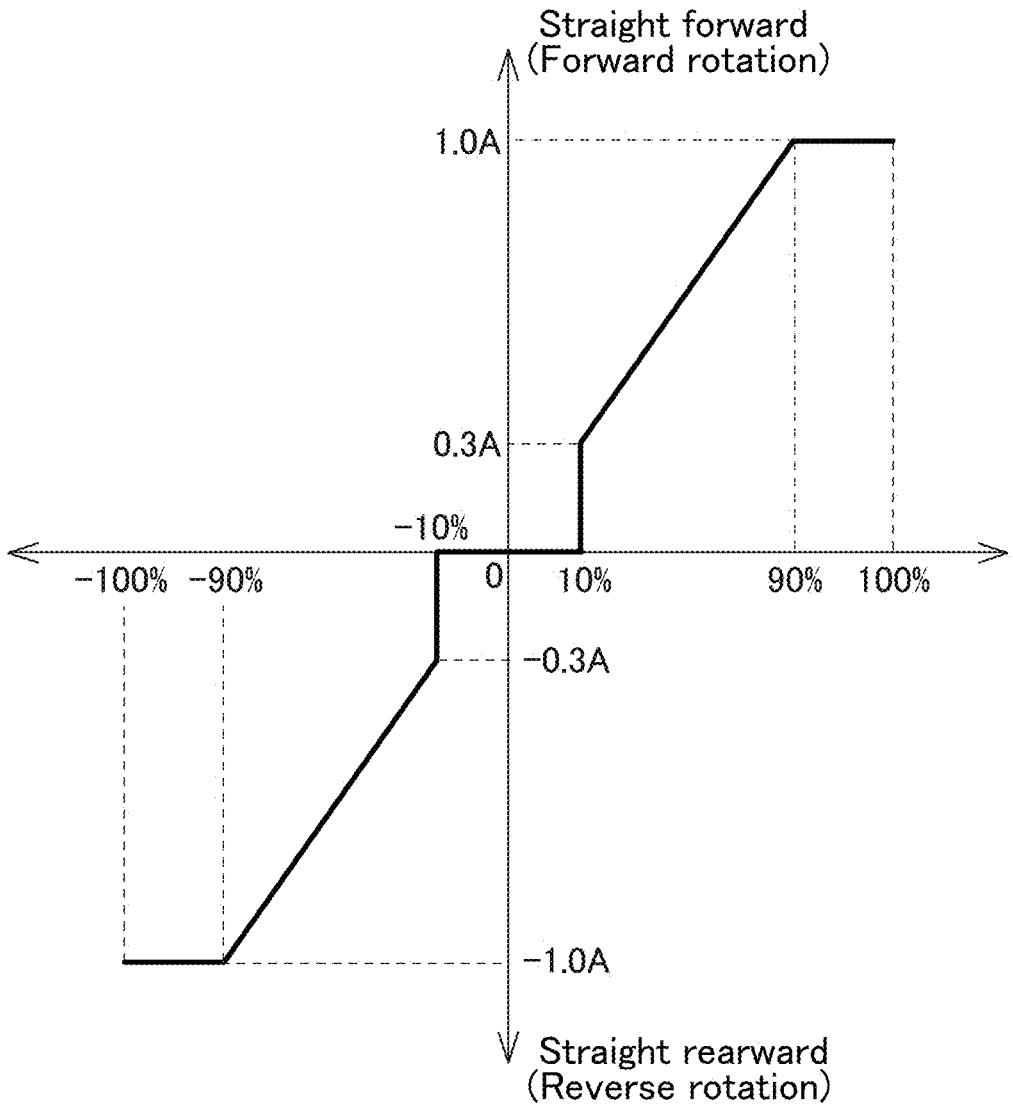
FIG. 23 is a diagram illustrating a relationship between a command value and an operation current value.

FIG. 23 is a diagram illustrating a relationship between a command value and an operation current value. A control map representing the relationship illustrated in FIG. 23 is stored in advance in the storage unit 26 of the controller 25. After detecting a command value on the basis of an electric signal input from the joystick 159, the controller 25 sets an operation current value to be input to the operation valves (solenoid proportional valves) 55*a* to 55*d* or 155L and 155R on the basis of the command value and the control map illustrated in FIG. 23.

If the anti-stall control has not been executed, upon setting an operation current value, the controller 25 inputs the operation current value to the operation valves 55*a* to 55*d* or 155L and 155R as a control signal to control the traveling pumps 53L and 53R using the operation valves 55*a* to 55*d* or 155L and 155R.

If the anti-stall control has been executed, the controller 25 sets the operation current value in the way described above and also sets the first correction coefficient in accordance with the control map illustrated in FIG. 21 and the actual rotational speed of the engine 32. Then, the controller 25 corrects the operation current value using the first correction coefficient to obtain an anti-stall current value. At this time, for example, the controller 25 multiplies the operation current value by the first correction coefficient (about 0.4 to about 1) to obtain a current value, and sets the obtained current value as the anti-stall current value. The determined anti-stall current value is equal to or less than the operation current value.

If both the anti-stall control and the automatic idle control have been executed before the operation of the joystick 159, the controller 25 sets the first correction coefficient on the basis of the control line L90C illustrated in FIG. 21 and the actual rotational speed of the engine 32. In response to an operation of the joystick 159, the controller 25 sets an operation current value and then corrects the operation current value using the first correction coefficient, which is based on the control line L90C and the like, to determine the anti-stall current value. The determined anti-stall current value is equal to or greater than the anti-stall current value (the product of the operation current value and the first correction coefficient based on any one of the control lines L90A and L90B) that is determined when only the anti-stall control is executed before the operation of the joystick 159 and the drop rotational speed is equal to or greater than the threshold. The determined anti-stall current value is also equal to or less than the operation current value.

If the anti-stall control has been executed, the controller 25 inputs the anti-stall current value to the operation valves (solenoid proportional valves) 55*a* to 55*d* or 155L and 155R as a control signal to control the traveling pumps 53L and 53R using the operation valves 55*a* to 55*d* or 155L and 155R.

As described above, as the operation current value or the anti-stall current value input from the controller 25 to the operation valves 55*a* to 55*d* or 155L and 155R increases, the traveling secondary pressure increases, and the delivery amount of the hydraulic fluid from the traveling pumps 53L and 53R increases.

In another example, the controller 25 may perform PID control or PI control to input a current value corresponding to the target engine rotational speed or the actual rotational speed of the engine 32 to the operation valves 55*a* to 55*d* or 155L and 155R. In this case, for example, the controller 25 multiplies the set operation current value or anti-stall current value by a coefficient (control gain) or the like used in the PID control to determine a current value to be input to the operation valves 55*a* to 55*d* or 155L and 155R.

If both the anti-stall control and the automatic idle control have been executed, in response to stop of the automatic idle control upon an operation of the joystick 159, the controller 25 increases the rotational speed of the engine 32 in accordance with the operating state (operation direction and operation amount) of the joystick 159. At this time, the controller 25 may correct the target engine rotational speed, which is set in accordance with the operation direction and the operation amount of the joystick 159, using the first correction coefficient set on the basis of the control line L90C (FIG. 21) and the actual rotational speed of the engine 32.

If both the anti-stall control and the automatic idle control have been executed, in response to an operation of the joystick 159, the controller 25 increases the rotational speed of the engine 32 in accordance with the operating state of the joystick 159. At this time, the controller 25 may set the secondary pressure (the secondary pressure of the operation valves 55*a* to 55*d* or 155L and 155R), the delivery amount of (the hydraulic fluid from) the traveling pumps 53L and 53R, or the rotational speed of the traveling motors 36L and 36R in accordance with Equations (9) to (11) below.

Travel secondary pressure=(secondary pressure of operation valves 55*a* to 55*d* corresponding to amount of operation of joystick 159 in accordance with control line L20 in FIG. 14A×[1+constant×(target engine rotational speed/actual rotational speed)] (9)

Delivery amount of hydraulic fluid from traveling pumps 53L and 53R=(delivery amount of hydraulic fluid from traveling pumps 53L and 53R corresponding to amount of operation of joystick 159 in accordance with control line L20*b* in FIG. 14B×[1+constant×(target engine rotational speed/actual rotational speed)] (10)

Rotational speed of traveling motors 36L and 36R=(rotational speed of traveling motors 36L and 36R corresponding to amount of operation of joystick 159 in accordance with control line L20*c* in FIG. 14C×[1+constant×(target engine rotational speed/actual rotational speed)] (11)

Upon setting the secondary pressure, the delivery amount of the hydraulic fluid from the traveling pumps 53L and 53R, or the rotational speed of the traveling motors 36L and 36R in accordance with the corresponding one of Equations (9) to (11) above, the controller 25 controls the opening of the operation valves 55*a* to 55*d* or 155L and 155R so as to realize the set value.

The preferred embodiments disclosed herein should be considered in all respects illustrative and not restrictive. The scope of the present invention is defined not by the foregoing description but by the claims, and is intended to include meanings equivalent to the claims and all modifications within the scope.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A hydraulic system for a working machine, the hydraulic system comprising:

a prime mover;

at least one traveling device including at least one of a plurality of crawlers or a plurality of wheels to cause the working machine to travel;

at least one traveling motor to transmit power to the at least one traveling device;

at least one variable displacement traveling pump to be driven by power from the prime mover to supply hydraulic fluid to the at least one traveling motor;

a plurality of first operators including at least two of a dial having a rotatable knob, a pedal, a lever, or a joystick to be operated by a user to drive the at least one traveling device;

a second operator including a switch to be operated by the user to perform switching to one of a first mode in which the working machine is caused to travel or a second mode in which the working machine is caused to travel at a travel speed lower than in the first mode;

a controller configured or programmed to control at least one of the prime mover or the at least one variable displacement traveling pump in accordance with an operation amount of the plurality of first operators and/or an operating state of the second operator; and an adjuster including a solenoid valve fluidly connected to at least one pressure receiver of the at least one variable displacement traveling pump to adjust an angle of at least one swash plate of the at least one variable displacement traveling pump by hydraulically moving the at least one swash plate; wherein the plurality of first operators include:

an accelerator including at least one of the dial having the rotatable knob or the pedal to be operated by the user to input a target rotational speed of the prime mover in the first mode; and a travel operator including at least one of the lever or the joystick to be operated by the user to adjust a rotational speed of the at least one traveling motor in the first mode and in the second mode; and the controller is configured or programmed to:

in the first mode, set the target rotational speed in accordance with an operation amount of the accelerator and control driving of the prime mover based on the set target rotational speed such that a rotational speed of the prime mover matches the target rotational speed; and in the second mode, (i) cause the adjuster to change the angle of the at least one swash plate of the at least one variable displacement traveling pump in accordance with an operation amount the of the travel operator to adjust the rotational speed of the at least one traveling motor and the travel speed of the working machine, and (ii) in response to an operation of the accelerator when the operation amount of the travel operator is constant, cause the adjuster to change the angle of the at least one swash plate of the at least one variable displacement traveling pump without changing the rotational speed of the prime mover in accordance with the operation amount of the accelerator to adjust the rotational speed of the at least one traveling motor and the travel speed of the working machine.

2. The hydraulic system according to claim 1, further comprising:

a hydraulic pump to be driven by the power from the prime mover to deliver pilot fluid to adjust the angles of the at least one swash plate of the at least one variable displacement traveling pump; and at least one operation valve to allow pilot pressure to act on the at least one pressure receiver of the at least one variable displacement traveling pump in accordance with the operation amount of the travel operator, the at least one operation valve being connected to a fluid passage which allows the pilot fluid delivered by the hydraulic pump to flow therein, the pilot pressure being a pressure of the pilot fluid; wherein the adjuster includes the solenoid valve to change the pilot pressure acting on the at least one operation valve, the solenoid valve being connected to the fluid passage;

the plurality of first operators include a speed adjuster including a volume switch to be operated by the user to temporarily adjust the rotational speed of the at least one traveling motor in the second mode with an adjustment width smaller than the travel operator; and the controller is configured or programmed to control an opening of the solenoid valve in accordance with at least one of the operation amount of the accelerator or an operation amount of the speed adjuster to change the pilot pressure.

3. The hydraulic system according to claim 1, further comprising:

a hydraulic pump to be driven by the power from the prime mover to deliver pilot fluid to adjust the angle of the at least one swash plate of the at least one variable displacement traveling pump; wherein the adjuster includes at least one operation valve to allow pilot pressure to act on the at least one pressure receiver of the at least one variable displacement traveling pump, the pilot pressure being a pressure of the pilot fluid; and the controller is configured or programmed to control at least one opening of the at least one operation valve in accordance with the operation amount of at least one of the travel operator or the accelerator to change the pilot pressure.

4. The hydraulic system according to claim 1, further comprising:

a hydraulic pump to be driven by the power from the prime mover to deliver pilot fluid to adjust the angle of the at least one swash plate of the at least one variable displacement traveling pump; wherein the adjuster includes:

at least one operation valve to allow pilot pressure to act on the at least one pressure receiver of the at least one variable displacement traveling pump, the at least one operation valve being connected to a fluid passage which allows the pilot fluid delivered by the hydraulic pump to flow therein, the pilot pressure being a pressure of the pilot fluid; and the solenoid valve to change the pilot pressure which acts from the at least one operation valve on the at least one pressure receiver of the at least one variable displacement traveling pump, the solenoid valve being connected to the fluid passage; and the controller is configured or programmed to control an opening of the solenoid valve in accordance with the operation amount of at least one of the travel operator or the accelerator to change the pilot pressure.

5. The hydraulic system according to claim 1, further comprising:

a hydraulic pump to be driven by the power from the prime mover to deliver pilot fluid to adjust the angle of the at least one swash plate of the at least one variable displacement traveling pump; wherein the adjuster includes:

at least one hydraulic regulator including a piston rod coupled to the at least one swash plate of the at least one variable displacement traveling pump, the at least one hydraulic regulator being operable to change the angles of the at least one swash plate in response to activation of the piston rod; and at least one operation valve switchable among a neutral position in which the pilot fluid is not allowed to be supplied to the at least one hydraulic regulator, a first position in which the pilot fluid is allowed to be supplied to the at least one hydraulic regulator in a first direction, and a second position in which the pilot fluid is allowed to be supplied to the at least one hydraulic regulator in a second direction; and the controller is configured or programmed to change an activation state of the at least one operation valve in accordance with the operation amount of at least one of the travel operator or the accelerator to change a pilot pressure which is a pressure of the pilot fluid.

6. The hydraulic system according to claim 1, wherein the plurality of first operators include a speed adjuster including a volume switch to be operated by the user to temporarily adjust the rotational speed of the at least one traveling motor in the second mode with an adjustment width smaller than the travel operator; and the controller is configured or programmed to:

in the second mode, cause the adjuster to change the angle of the at least one swash plate of the at least one variable displacement traveling pump in accordance with an operation amount of the speed adjuster to adjust the rotational speed of the at least one traveling motor and the travel speed of the working machine; and in response to an operation of the accelerator, cause the adjuster to change the angle of the at least one swash plate of the at least one variable displacement traveling pump in accordance with the operation amount of the accelerator to adjust the rotational speed of the at least one traveling motor and the travel speed of the working machine; and perform a control such that the rotational speed of the at least one traveling motor and the travel speed of the working machine adjusted by changing the angle of the at least one swash plate in accordance with the operation amount of the accelerator are faster than the rotational speed of the at least one traveling motor and the travel speed of the working machine adjusted by changing the angle of the at least one swash plate in accordance with the operation amount of the speed adjuster.

7. The working machine according to claim 1, wherein the controller is configured or programmed to:

in the first mode and in the second mode, cause the adjuster to change the angle of the at least one swash plate of the at least one variable displacement traveling pump in accordance with the operation amount of the travel operator to adjust the rotational speed of the at least one traveling motor and the travel speed of the working machine; and perform a control such that, when the operation amount of the travel operator in the first mode and the operation amount of the travel operator in the second mode are the same, the rotational speed of the at least one traveling motor and the travel speed of the working machine are adjusted in the second mode to be slower than the rotational speed of the at least one traveling motor and the travel speed of the working machine adjusted in the first mode.

8. The hydraulic system according to claim 1, wherein the controller is configured or programmed to:

in the first mode, set the target rotational speed in accordance with the operation amount of the accelerator and control driving of the prime mover such that the rotational speed of the prime mover matches the target rotational speed; and in the second mode, (i) set an adjustment range of the rotational speed of the at least one traveling motor and an adjustment range of the travel speed of the working machine in accordance with an operation amount of the travel operator when the operation amount of the accelerator is equal to or greater than a predetermined amount, and (ii) cause the adjuster to change the angle of the at least one swash plate of the at least one variable displacement traveling pump in accordance with the operation amount of the travel operator to adjust the rotational speed of the at the at least one traveling motor and the travel speed of the working machine within the set adjustment ranges.

9. The hydraulic system according to claim 1, wherein the plurality of first operators include a speed adjuster including a volume switch to be operated by the user to temporarily adjust the rotational speed of the at least one traveling motor in the second mode with an adjustment width smaller than the travel operator; and the controller is configured or programmed to, in the second mode:

cause the adjuster to change the angle of the at least one swash plate of the at least one variable displacement traveling pump in accordance with an operation amount of the speed adjuster to adjust the rotational speed of the at least one traveling motor and the travel speed of the working machine;

in response to an operation of the travel operator when an operation amount of the accelerator is equal to or greater than a predetermined amount, cause the adjuster to change the angle of the at least one swash plate of the at least one variable displacement traveling pump in accordance with an operation amount of the travel operator to adjust the rotational speed of the at least one traveling motor and the travel speed of the working machine; and perform a control such that the rotational speed of the at least one traveling motor and the travel speed of the working machine adjusted by changing the angle of the at least one swash plate in accordance with the operation amount of the speed adjuster differ from the rotational speed of the at least one traveling motor and the travel speed of the working machine adjusted by changing the angle of the at least one swash plate in accordance with the operation amount of the travel operator.

* * * * *